US010448711B2

(12) United States Patent
Kallman et al.

(10) Patent No.: US 10,448,711 B2
(45) Date of Patent: Oct. 22, 2019

(54) ACCESSORY CONTACTS

(71) Applicant: Apple Inc., Cupertino, CA (US)

(72) Inventors: Benjamin J. Kallman, Menlo Park, CA (US); Eric S. Jol, San Jose, CA (US); Michael B. Wittenberg, Sunnyvale, CA (US); Stephen E. Dey, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/711,878

(22) Filed: Sep. 21, 2017

(65) Prior Publication Data

US 2018/0090890 A1 Mar. 29, 2018

Related U.S. Application Data

(60) Provisional application No. 62/399,099, filed on Sep. 23, 2016, provisional application No. 62/399,059, filed on Sep. 23, 2016.

(51) Int. Cl.
*A44C 5/14* (2006.01)
*A44C 5/08* (2006.01)
(Continued)

(52) U.S. Cl.
CPC ..... *A44C 5/14* (2013.01); *A44C 5/08* (2013.01); *A44C 5/105* (2013.01); *A45F 5/00* (2013.01); *G04B 37/1486* (2013.01); *G04G 99/00* (2013.01); *H01R 13/18* (2013.01); *H01R 13/20* (2013.01); *H01R 13/2421* (2013.01); *H01R 13/2428* (2013.01); *H01R 13/4534* (2013.01); *H01R 13/506* (2013.01);
(Continued)

(58) Field of Classification Search
CPC ..... A44C 5/147; A44C 5/2057; H01R 12/88; H01R 12/89
USPC ..... 439/259, 263, 131, 289, 310
See application file for complete search history.

(56) References Cited

U.S. PATENT DOCUMENTS 3,058,796 A 10/1962 McDougall
3,670,491 A * 6/1972 Weschler ..... G04C 10/00 136/205

(Continued)

OTHER PUBLICATIONS

Advisory Action dated Mar. 28, 2019 in U.S. Appl. No. 15/711,853. 4 pages.

(Continued)

*Primary Examiner* — Tulsidas C Patel
*Assistant Examiner* — Marcus E Harcum
(74) *Attorney, Agent, or Firm* — Kilpatrick Townsend & Stockton LLP

(57) ABSTRACT

A first connector assembly may be connectable to a second connector assembly using a sliding attachment process, in which a front portion of the first connector assembly is inserted into an end of a slot in the second connector assembly and slides laterally along the slot until electrical contacts on the two connector assemblies are aligned. Electrical contacts of the first connector assembly may be biased proud to make contact with recessed electrical contacts in the second connector assembly. A retraction mechanism may be provided to retract the electrical contacts of the first connector assembly during lateral sliding. An interlock mechanism may be provided to prevent unwanted operation of the retraction mechanism.

12 Claims, 57 Drawing Sheets

(51) Int. Cl.

| | |
|---|---|
| ***G04B 37/14*** | (2006.01) |
| ***A44C 5/10*** | (2006.01) |
| ***H01R 13/18*** | (2006.01) |
| ***H01R 13/20*** | (2006.01) |
| ***H01R 13/453*** | (2006.01) |
| ***H01R 13/506*** | (2006.01) |
| ***H01R 13/631*** | (2006.01) |
| ***H01R 13/74*** | (2006.01) |
| ***H01R 13/24*** | (2006.01) |
| ***H01R 13/633*** | (2006.01) |
| ***A45F 5/00*** | (2006.01) |
| ***G04G 99/00*** | (2010.01) |

(52) U.S. Cl.
CPC ..... *H01R 13/633* (2013.01); *H01R 13/6315* (2013.01); *H01R 13/745* (2013.01); *A44C 5/147* (2013.01); *A44D 2203/00* (2013.01); *A45F 2005/008* (2013.01); *A45F 2200/0516* (2013.01)

(56) References Cited

U.S. PATENT DOCUMENTS

| | | | | |
|---|---|---|---|---|
| 5,781,511 | A | 7/1998 | Yasukawa et al. | |
| 7,070,458 | B2 | 7/2006 | Axenböck et al. | |
| 9,141,086 | B1 * | 9/2015 | Rohrbach | G04B 37/1486 |
| 9,166,334 | B1 | 10/2015 | Huang et al. | |
| 10,016,029 | B2 * | 7/2018 | Yabe | A44C 5/147 |
| 10,058,148 | B1 * | 8/2018 | Wittenberg | A44C 5/147 |
| 2011/0147036 | A1 * | 6/2011 | Cheng | G06F 1/1656 174/59 |
| 2012/0052704 | A1 * | 3/2012 | Yen | H01R 13/4538 439/131 |
| 2014/0377986 | A1 * | 12/2014 | Endo | H01R 13/2421 439/519 |
| 2016/0040698 | A1 * | 2/2016 | Perkins | A44B 17/0011 24/664 |
| 2016/0069371 | A1 * | 3/2016 | Chen | F16B 21/12 403/326 |
| 2017/0181510 | A1 * | 6/2017 | Novak | A44C 5/147 |
| 2019/0094809 | A1 * | 3/2019 | Park | G04B 37/081 |

OTHER PUBLICATIONS

Non-Final Office Action dated Jun. 12, 2018 in U.S. Appl. No. 15/711,853. 7 pages.

Final Office Action dated Nov. 19, 2018 in U.S. Appl. No. 15/711,853. 7 pages.

Apple Inc., ""Change Your Apple Watch Band"", Available at:https://support.apple.com/en-us/HT204818, Sep. 15, 2016, 2 pages.

* cited by examiner

ACCESSORY CONTACTS

CROSS-REFERENCES TO RELATED APPLICATIONS

This application claims the benefit of U.S. Provisional Application No. 62/399,059, filed Sep. 23, 2016, and also claims the benefit of U.S. Provisional Application No. 62/399,099, filed Sep. 23, 2016. The disclosures of both applications are incorporated herein by reference for all purposes.

This application is related to U.S. application Ser. No. 15/711,853 filed on Sep. 21, 2017, the disclosure of which is incorporated herein by reference.

BACKGROUND

Electronic devices often include one or more connector receptacles though which they may provide and receive power and data. This power and data may be conveyed over cables that may include a connector insert at each end of a cable. The connector inserts may be inserted into receptacles in the communicating electronic devices.

In other electronic systems, contacts on a first electronic device may be in direct physical and electrical contact with contacts on a second electronic device without the need for an intervening cable. In such systems, a connector insert may be formed as part of the first electronic device, while a connector receptacle may be formed as part of the second electronic device.

The electrical contacts on these directly connecting connector inserts and connector receptacles may be substantially formed on outside surfaces of the electronic devices. These surfaces may come into direct contact to form electrical connections between electronic devices to convey power and data.

Like other connector systems, there are potential drawbacks to this arrangement. For example, these connectors may be large. Since electronic devices are becoming ever smaller, the presence of large connectors may be non-optimal. Also, since the contacts are at the surfaces of the electronic devices, they may be exposed to corroding fluids that may shorten device lifespan. Since the electronic devices come into physical contact, the connector contacts may become damaged when a connection is formed. Electronic devices may also have fluids spilled on them or they may become partially submerged. Resulting moisture leakage may damage the electronic device housing the connector assembly. Also, connector systems may be manufactured in the millions of units. Accordingly, any simplification in the assembly process may noticeably reduce manufacturing costs. Further, a failure of the connector system may render an entire electronic device inoperable, so reliability may be important for maintaining customer satisfaction.

Thus, what is needed are connector assemblies that may be space efficient, have a high corrosion resistance, are difficult to damage, reduce or prevent moisture leakage into an electronic device housing the connector assembly, are readily assembled, and are reliable.

SUMMARY

Accordingly, embodiments of the present invention may provide connector assemblies that may be space efficient, have a high corrosion resistance, are difficult to damage, reduce or prevent moisture leakage into an electronic device housing the connector assembly, are readily assembled, and are reliable. Connector assemblies described herein may be used to connect a first electronic device to a second electronic device. Some embodiments of the present invention may be adapted for environments where corrosion of electrical contacts of a connector assembly is a particular concern, such as where the electronic device is expected to be routinely exposed to moisture. In such environments, it may be desirable to provide a water-resistant seal around the electrical contacts when they are connected. Some embodiments of the present invention may also be adapted for environments where the connection between the electronic devices may be subject to various mechanical stresses.

For example, in some embodiments of the present invention, a first electronic device may be a watch band, and a second electronic device may be a watch body unit. The watch body unit may include a user interface (e.g., display, speakers, user input controls such as a touchscreen, button, dial, etc.), and supporting electronic components, such as processors, memory, battery, sensors, wireless communication circuitry, and the like. The watch band may include active electronic components (e.g., sensors, battery, processor, etc.) that may interoperate with the supporting electronics of the watch body unit to augment or enhance functionality of the watch body unit. the watch body unit may include a connector receptacle, e.g., a slot formed in a top or bottom edge surface of the watch body unit, and the watch band may include a connector insert, e.g., a lug at the end of the watch band that may be inserted into the slot of the watch body unit.

In some embodiments of the present invention, a first connector assembly (e.g., a connector insert) may be connectable to a second connector assembly (e.g., a connector receptacle) using a sliding attachment process, in which a front portion of the first connector assembly is inserted into an end of a slot in the second connector assembly and slides laterally along the slot until electrical contacts on the two connector assemblies are aligned. In some embodiments, the electrical contacts of the second connector assembly may be slightly recessed into the housing of the second connector assembly and fixed in position, while the electrical contacts of the first connector assembly may be biased proud so that when the connector assemblies are in alignment, the electrical contacts of the first connector assembly may enter the recess and make contact with the electrical contacts of the second connector assembly. Such biasing may be achieved using pogo pins or curved contacts with a spring force that establishes a forward bias.

It may be desirable to protect the electrical contacts of the first connector assembly against damage that may occur during lateral sliding of the connector assemblies. Accordingly, in some embodiments, the first connector assembly may include a retraction mechanism that can be operated to retract the electrical contacts of the first connector assembly into a "retracted" position during the sliding attachment (or detachment) process and to extend the electrical contacts forward into an "engaged" position when the first connector assembly is aligned with the second connector assembly so that electrical contact can be established and maintained. In the retracted position, the front ends of the electrical contacts may be flush with or recessed within the surface of the housing of the first connector assembly, so that the electrical contacts need not touch or rub against the surface of the second connector assembly during lateral sliding. In the engaged position, the front ends of the electrical contacts may extend beyond the front surface of the housing of the first connector assembly, allowing electrical contact with corresponding contacts of the second connector assembly to be maintained. In some embodiments, the first connector assembly may also include an interlock mechanism to prevent lateral sliding of the first connector assembly while the electrical contacts are in the engaged position. The interlock mechanism may also inhibit the electrical contacts from spontaneously moving into or out of the extended position; a user-operable eject mechanism may be provided to allow a user to release the interlock.

Some embodiments of the present invention may rely on pressure from the complementary assembly to press the electrical contacts into the retracted position during insertion; a forward bias on the electrical contacts may automatically push them into contact once alignment is established. While this approach may be effective, repeated insertion and removal may result in wear on the electrical contacts due to friction.

Accordingly, some embodiments of the present invention may incorporate a retraction mechanism to allow a user to move the electrical contacts between the engaged and retracted positions. For example, the electrical contacts of a connector assembly (e.g., a connector insert) may be attached to a movable sled mounted within the housing of the connector assembly. The sled may be movable along an axis perpendicular to the front face of the connector assembly between a retracted position, in which the electrical contacts are protected by the housing of the connector assembly, and an engaged position, in which the electrical contacts extend far enough outside the housing to make contact with electrical contacts in a complementary connector assembly (e.g., a connector receptacle). A user-operable sled control mechanism may be provided to allow the user to move the sled between the extended and retracted positions. In operation, a user may ensure the sled is in the retracted position before inserting the first connector assembly into a complementary connector assembly. Once the connector assemblies are aligned, the user may operate the sled control mechanism to move the sled into the engaged position. In some embodiments, when the sled is moved into the engaged position, an interlock mechanism may engage to prevent unintended movement of the sled out of the engaged position. To decouple the connector assemblies, the user may operate an eject button or the like to release the interlock mechanism. In some embodiments, releasing the interlock mechanism may result in the sled automatically returning to the retracted position; in other embodiments, the user may manually move the sled to the retracted position. The user may then slide the connector assemblies apart.

A number of different sled control mechanisms may be implemented. For example, a plunger or the like at the rear of the sled may be provided to push the sled forward into the engaged position. In operation, the user may slide the connector assembly into alignment with a complementary connector assembly, then push on the plunger, which operates to push the sled forward into the engaged position. In some embodiments, pushing the sled into the engaged position may automatically engage an interlock, and a return spring may automatically retract the sled into the retracted position when the interlock is released. In other embodiments, the user may be able to manually retract the sled, e.g., by pulling on the plunger.

As another example, a movable sled may be mechanically coupled to an exposed pull-tab or other exposed area. In operation, the user may slide the connector assembly into alignment with a complementary connector assembly, then pull on the exposed pull-tab, which operates the lever to push the sled forward into the engaged position. In some embodiments, pushing the sled into the engaged position may automatically engage an interlock, and a return spring may automatically retract the sled into the retracted position when the interlock is released. In other embodiments, the user may be able to manually retract the sled, e.g., by pushing in on the pull-tab.

As another example, a movable sled may be mechanically coupled to an external slider control, which may be movable in a direction transverse to the direction of travel of the sled. The slider control may be located on a side or end surface of the connector assembly. In operation, the user may slide the connector assembly into alignment with a complementary connector assembly, then slide the slider control from an "open" position to a "closed" position to move the sled forward into the engaged position. In some embodiments, moving the sled into the engaged position may automatically engage an interlock, and a return spring may automatically retract the sled into the retracted position when the interlock is released. In other embodiments, the user may be able to manually retract the sled, e.g., by sliding the slider control in the opposite direction.

As another example, a movable sled may be mechanically coupled to a rotary control (e.g., a set screw or the like). In operation, the user may turn the rotary control from an open" position to a "closed" position to move the sled forward into the engaged position and may turn the rotary control in the opposite direction to move the sled backward into the retracted position. In some embodiments, an interlock mechanism may be provided to prevent movement of the sled while the connector assembly is being inserted into or removed from a complementary connector assembly.

In still other embodiments of the present invention, a sliding engagement path may be replaced with a plug-in path, in which a first connector assembly is designed as a plug that may be inserted into a sleeve extending forward from a second connector assembly. This may simplify the mechanical design of the connector assemblies, as retracting the electrical contacts to avoid damage during sliding may not be needed. Bayonet latches or the like may be used to hold the first connector assembly in contact with the second connector assembly.

In any of these and other embodiments of the present invention, water-resistant sealing may be provided around the contacts. For example, connector assembly housing or portions thereof may be covered with rubber or other pliable and water-resistant materials. In some embodiments, forward portions of the electrical contacts may be surrounded by a covering of rubber or other pliable and water-resistant materials.

In various embodiments of the present invention, the components of the connector assemblies may be formed in various ways of various materials. For example, conductive portions may be formed by stamping, metal-injection molding, machining, micro-machining, 3-D printing, or other manufacturing process. The conductive portions may be formed of stainless steel, steel, copper, copper titanium, phosphor bronze, palladium, palladium silver, or other material or combination of materials. They may be plated or coated with nickel, gold, or other material. The nonconductive portions, such as the housings and other portions, may be formed using injection or other molding, 3-D printing, machining, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials. The transformer cores may be formed of ferrite material, such as a soft ferrite. The transformer cores may be sintered or subjected to other manufacturing steps. The flexible circuit boards may be replaced with printed circuit boards (PCBs) or other appropriate substrates.

Embodiments of the present invention may provide connector assemblies that may be located in, or may connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These connector assemblies may provide interconnect paths for signals that are compliant with various standards such as Universal Serial Bus (USB), High-Definition Multimedia Interface® (HDMI), Digital Visual Interface (DVI), Ethernet, DisplayPort, Thunderbolt™, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DETAILED DESCRIPTION

Figure 1A:
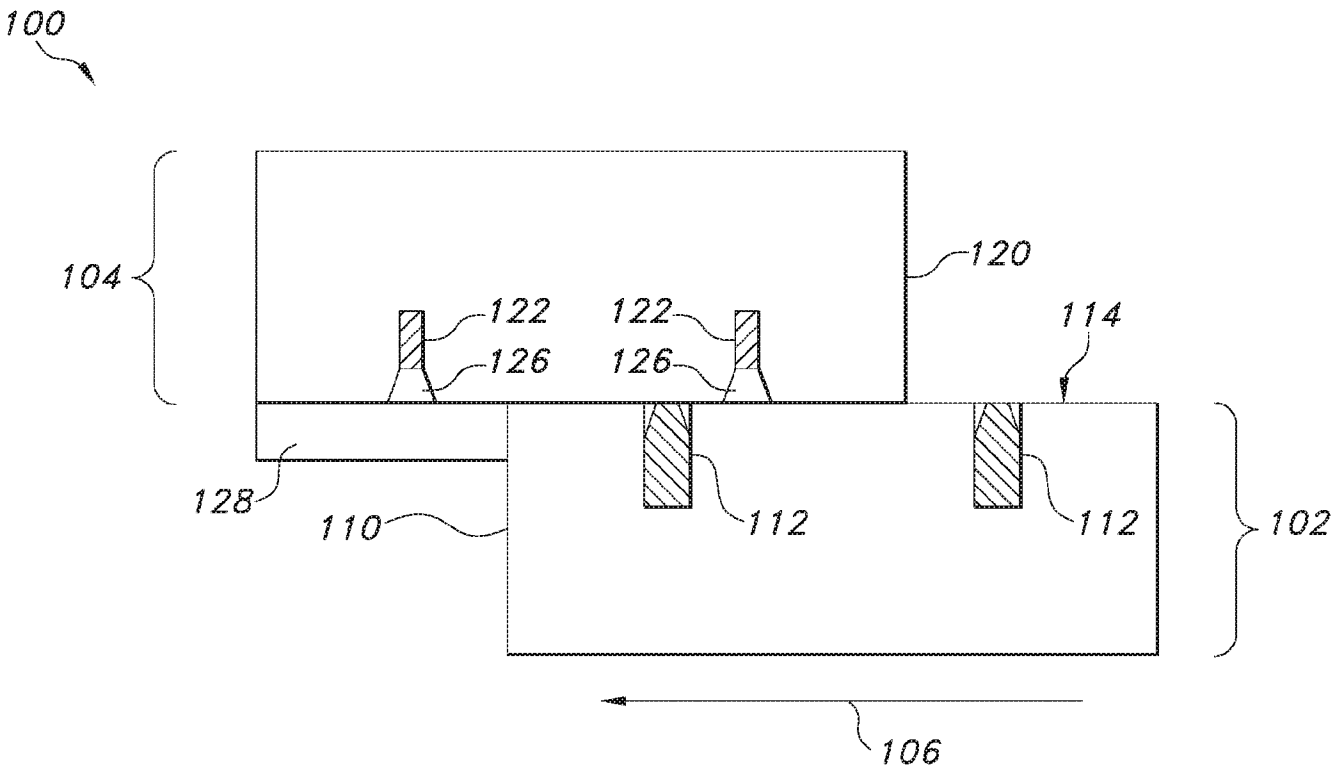
FIG. 1A shows a simplified cross-section view of a connector interface system incorporating a connector assembly according to an embodiment of the present invention.
Figure 1B:
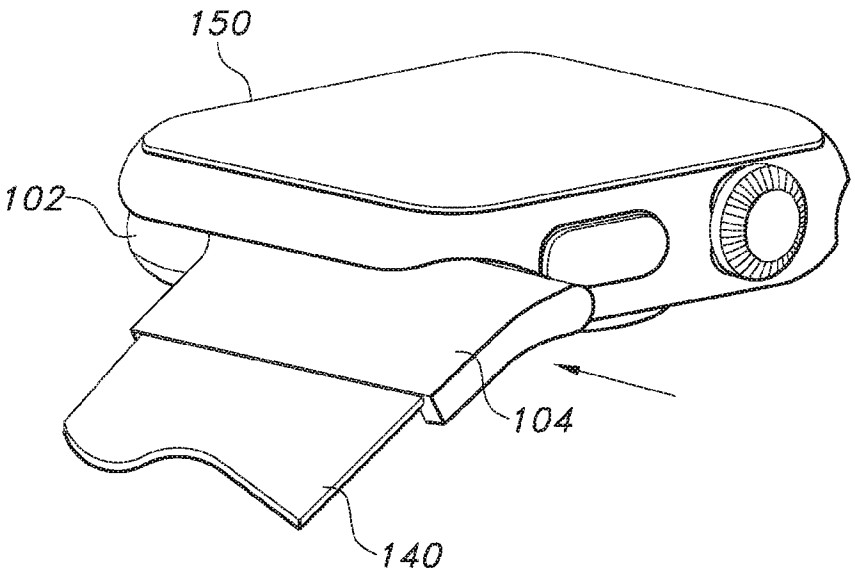
FIG. 1B shows a perspective view of example electronic devices implementing a connector interface according to an embodiment of the present invention.

FIG. 1A shows a simplified cross-section view of a connector interface system 100 incorporating a connector assembly according to an embodiment of the present invention, and FIG. 1B shows a perspective view of example electronic devices implementing connector interface 100. Connector interface system 100 includes a first connector assembly 102 and a second connector assembly 104 that slidably engages with first connector assembly 102, as indicated by arrow 106. First connector assembly 102 may include a housing 110 and one or more electrical contacts 112 arranged at a forward surface 114 of first connector assembly 102. Second connector assembly 104 may include a housing 120 and one or more electrical contacts 122 arranged near a forward surface 124 of second connector assembly 104. Electrical contacts 122 may be located within recesses 126 so that they are not flush with forward surface 124. Second connector assembly 104 may also include a slot 128 for accepting and guiding first connector assembly 102 into a connected position.

In some embodiments, first connector assembly 102 may be incorporated into a first electronic device and second connector assembly 104 may be incorporated into a second electronic device. A number of different electronic devices may be used. FIG. 1B shows an example embodiment in which the first electronic device is a watch band 140 and the second electronic device is a watch body unit 150. Watch body unit 150 may include a user interface (e.g., display, speakers, user input controls such as a touchscreen, button, dial, etc.), and supporting electronic components, such as processors, memory, battery, sensors, wireless communication circuitry, and the like. Watch band 140 may include active electronic components (e.g., sensors, battery, processor, etc.) that may interoperate with the supporting electronics of watch body unit 150 to augment or enhance functionality of watch body unit 150. Watch body unit 150 may include a second connector assembly 104 that includes a slot formed in a top or bottom edge surface of the watch body unit, and watch band 140 may include a first connector assembly 102 that may be formed, e.g., as a lug at the end of watch band 140 that may be inserted into the connector slot of watch body unit 150.

First connector assembly 102 may be inserted at one end of slot 128 and may slide laterally in the direction indicated by arrow 106 until electrical contacts 112 are aligned with electrical contacts 122.

Figure 2A:
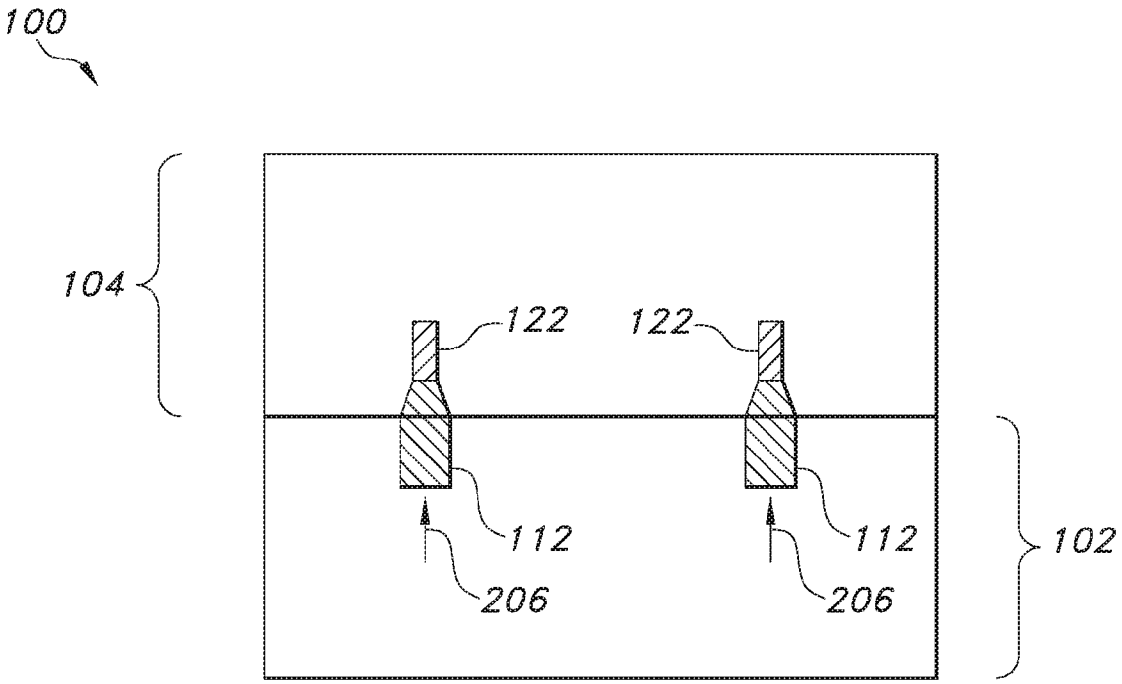
FIG. 2A shows another simplified cross-section view of a connector interface system according to an embodiment of the present invention.
Figure 2B:
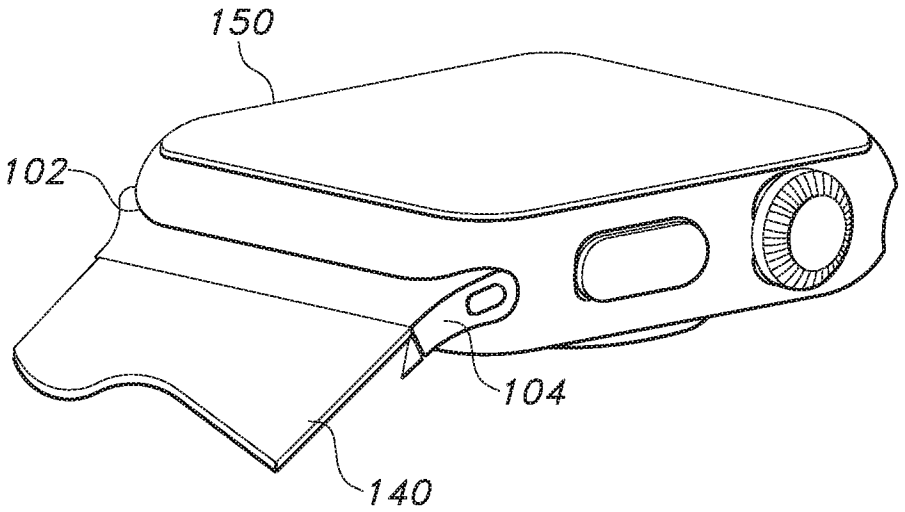
FIG. 2B shows a perspective view of example electronic devices implementing a connector interface according to an embodiment of the present invention.

FIG. 2A shows a simplified cross-section view of connector interface system 100 in a position where electrical contacts 112 are aligned with electrical contacts 122 according to an embodiment of the present invention, and FIG. 2B shows a perspective view of example electronic devices implementing connector interface 100. In this position, electrical contacts 112 may be pushed forward, as indicated by arrows 206, so that the forward ends of electrical contacts 112 extend into recesses 126 and make contact with electrical contacts 122, allowing electrical power and/or information/carrying signals to be exchanged between the connector assemblies.

Figure 3:
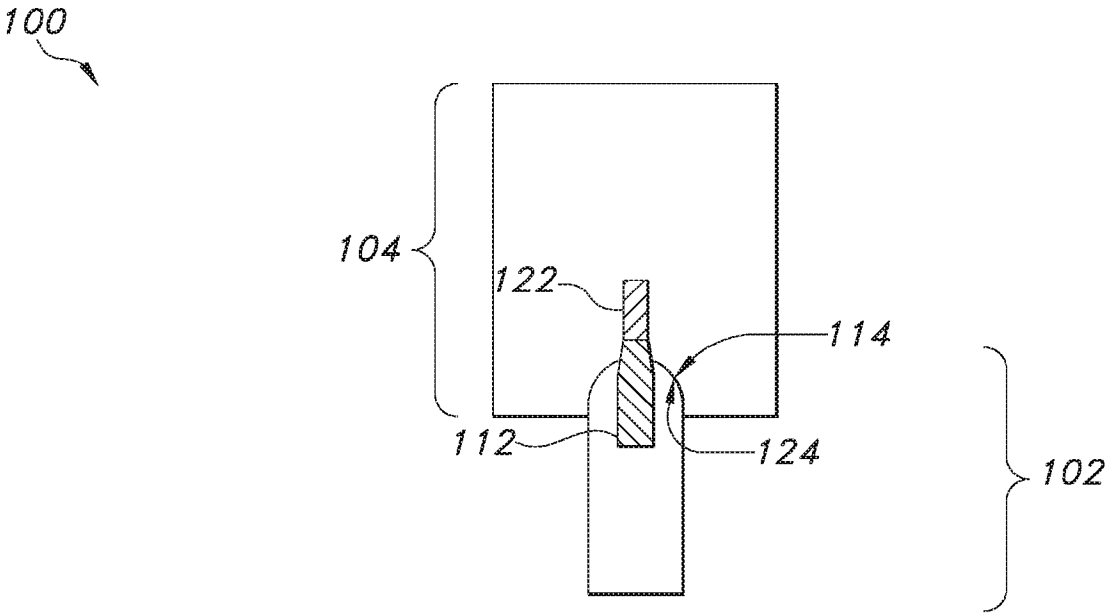
FIG. 3 shows a simplified transverse cross-section view of the connector interface system of FIG. 2A.

FIG. 3 shows a simplified transverse cross-section view of connector interface system 100 in the position of FIG. 2. In some embodiments, forward surface 114 of first connector assembly 102 may have a rounded profile as shown, and forward surface 124 of second connector assembly 102 may have a complementary concave profile. The absence of sharp corners may help to prevent damage in situations where first connector assembly 102 may be repeatedly inserted and removed; however, embodiments of the present invention are not limited to any particular shape.

In connector interface system 100, recessed electrical contacts 122 of second connector assembly 104 may be protected from damage during sliding of connector assembly 102 by virtue of being recessed. Electrical contacts 112 may be retractable to prevent damage during sliding. Many different techniques may be used to provide retractable electrical contacts 112. Examples will now be described.

In some embodiments of the present invention, a spring force applied to electrical contacts 112 may provide a forward bias that causes the front ends of electrical contacts 112 to extend beyond forward edge 114 of housing 110. The spring force may be overcome by pressure applied to electrical contacts 112, thereby retracting electrical contacts 112 and allowing lateral sliding of connector assembly 102. This pressure may be applied by forward surface 124 of second connector assembly 120, and the front ends of electrical contacts 112 and surrounding material may be shaped to minimize damage.

Figure 4:
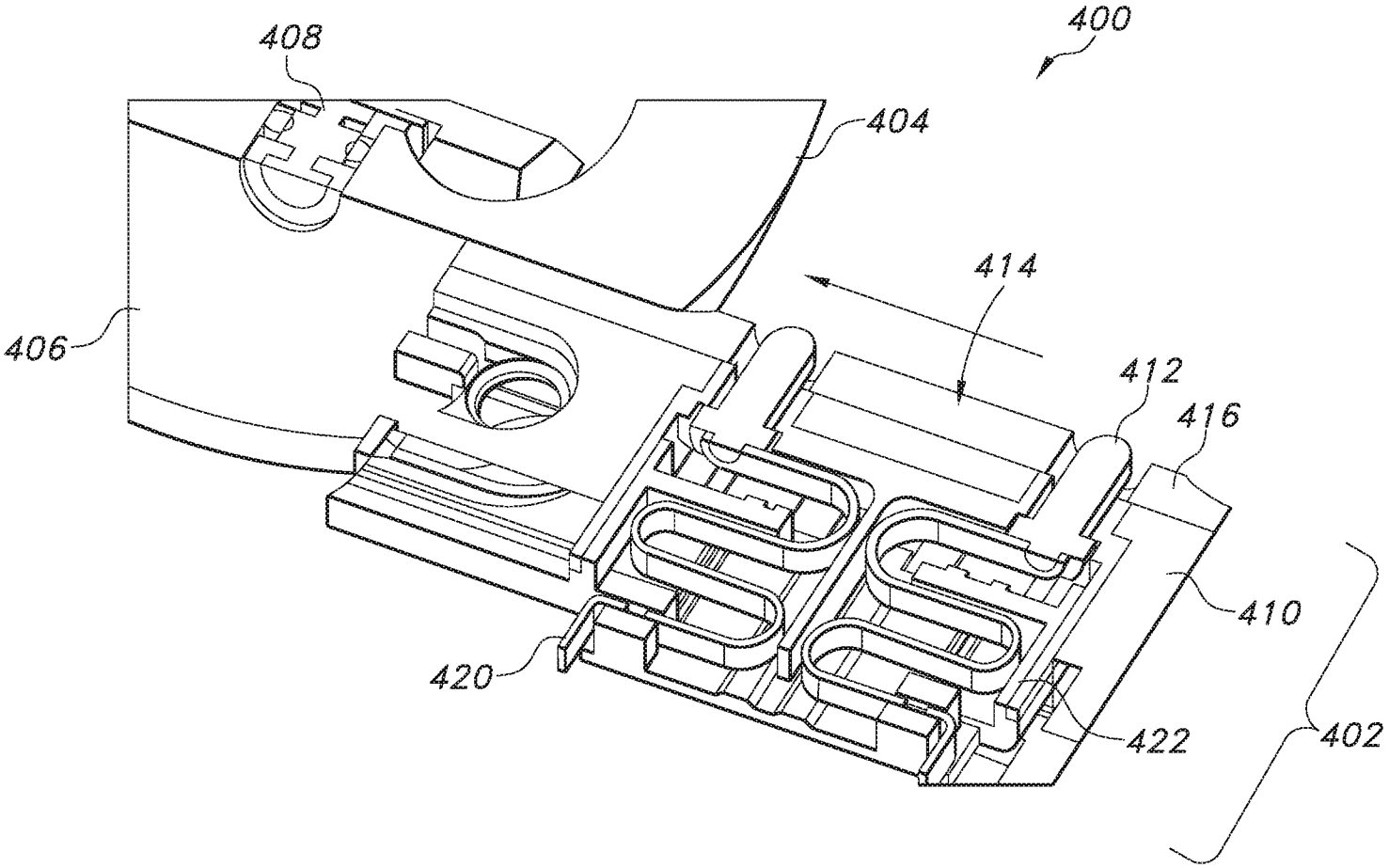
FIG. 4 shows a cross section view of a portion of a connector interface system according to an embodiment of the present invention.

FIG. 4 shows a cross section view of a portion of a connector interface system 400 according to an embodiment of the present invention. Connector interface system 400 may include a first connector assembly 402, which may be an implementation of first connector assembly 102 of FIG. 1A, and a second connector assembly 404, which may be an implementation of second connector assembly 104 of FIG. 1B. Second connector assembly 404 may include a slot 406 to accommodate first connector assembly 402 and electrical contacts 408, which may be fixedly located and slightly recessed (e.g., by 0.1 to 0.3 mm) from the surface of slot 406.

First connector assembly 402 may include housing 410 and electrical contacts 412 that extend through forward surface 414 of housing 410. In some embodiments, forward surface 414 of housing 410 (and other surfaces as desired) may be coated with a compressible elastic material 416. Compressible elastic material 416 may be, e.g., rubber, or any material that has the properties of being pliable or deformable and resilient. In some embodiments, compressible elastic material 416 may also have limited liquid permeability, e.g., to provide a water-resistant seal between connector assembly 400 and second connector assembly 404, which may help to protect electrical contacts 412 and electrical contacts 408 from corrosion if the electronic devices are exposed to moisture during operation.

Electrical contacts 412 may be connected to beams 420, which may be held within a cartridge 422 to prevent undesired movement. Beams 420 may be made of an electrically conductive and mechanically resilient material, and the S curves of beams 420 may provide a spring force that biases contacts 412 forward. The spring force of beams 420 may be overcome by applying pressure to the forward ends of electrical contacts 412, thereby retracting electrical contacts 412 into housing 410. The rear ends of beams 420 may be connected to a flexible printed circuit board (not shown) or other electrically active component of an electronic device that incorporates connector assembly 400.

Figure 5:
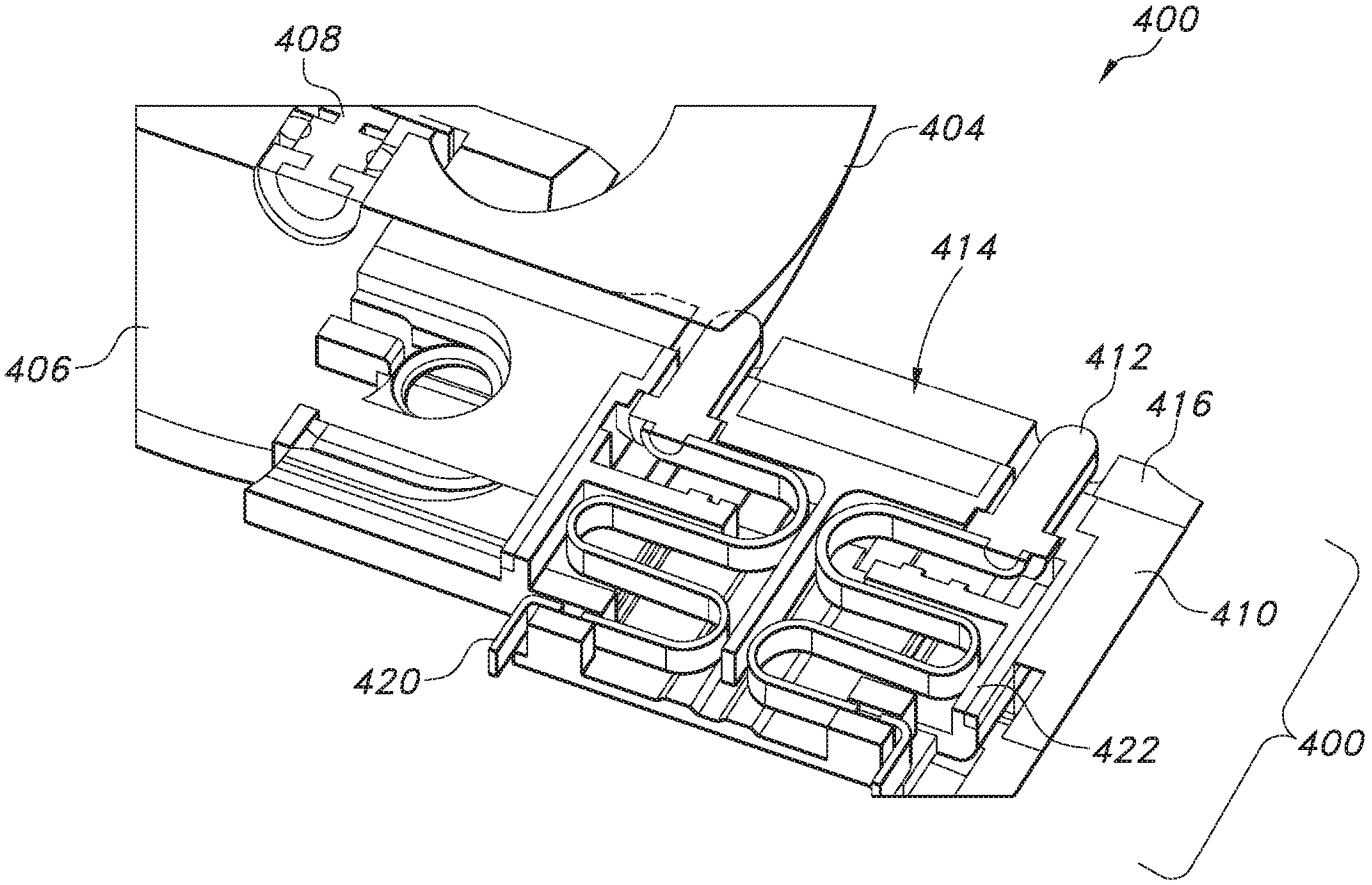
FIG. 5 shows another cross section view of the connector interface system of FIG. 4.

FIG. 5 shows first connector assembly 402 sliding into connector assembly 404. As shown. the wall of slot 406 may compress elastic material 416 and may also press on the forward portion of electrical contacts 412. In some embodiments, the front surfaces of electrical contacts 412 may be rounded or sloped (e.g., as shown) to allow the edge of connector assembly 404 to compress electrical contacts 412 as connector assembly 402 slides into slot 406. When electrical contacts 412 become aligned with electrical contacts 408, the spring force provided by beams 420 may push electrical contacts 412 forward to make contact with electrical contacts 408. In some embodiments, the recess depth for electrical contacts 408 may be less than 1 mm, and the travel range of electrical contacts 412 may be similarly small.

Figure 6:
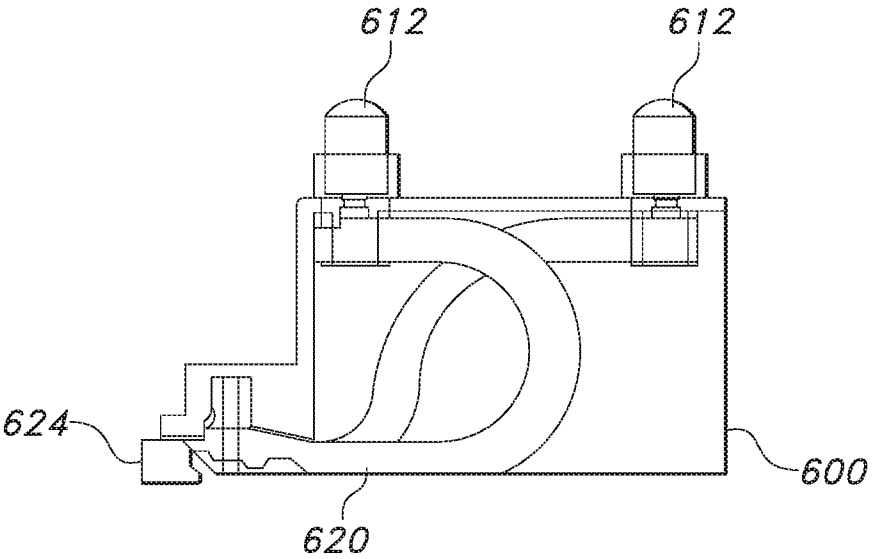
FIG. 6 shows an example of a cartridge according to another embodiment of the present invention.

The geometry of beams 420 and cartridge 422 may be modified, as long as a spring force is provided. FIG. 6 shows an example of a cartridge 600 according to another embodiment of the present invention. Cartridge 600 may be used, for example, in place of cartridge 422 of FIG. 4. Cartridge 600 may include one or more electrical contacts 612, each of which may be connected to a beam 620, which may have a C-shape or S-shape. Although only one beam is visible, it is to be understood that each contact 612 may have its own beam 620, and the beams may be in different parallel planes so they do not collide with each other, allowing for a laterally compact design. Rear end 624 of beam 620 may be directed out one side of cartridge 600 and may provide a barb to facilitate electrical connections to a flexible printed circuit board or other electrically active component of an electronic device. In some embodiments, the rear ends of all beams may be directed out the same side of cartridge 600, and this may facilitate making connections to multiple electrical contacts 612.

Figure 7:
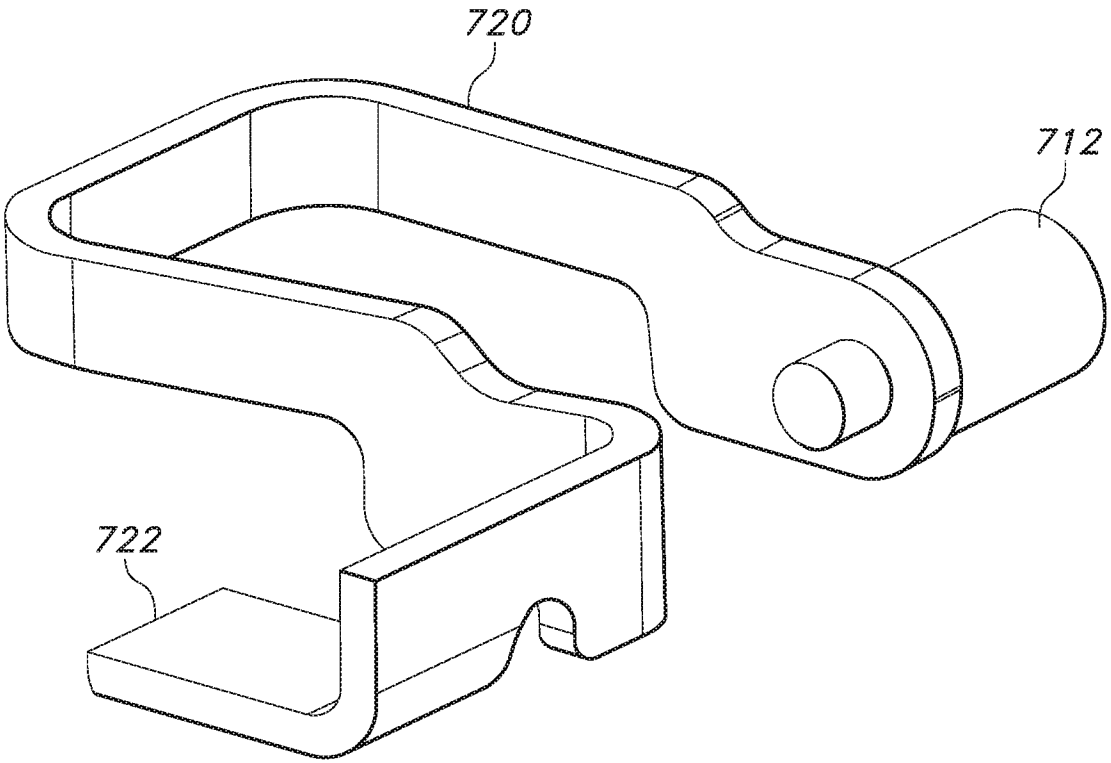
FIG. 7 shows an example of a beam geometry according to an embodiment of the present invention.

FIG. 7 shows another example of a beam geometry according to an embodiment of the present invention. An electrical contact 712 (which may be similar to electrical contact 112 or 412) is connected to a beam 720, e.g., by riveting. Like other beams described above, beam 720 may be made of an electrically conductive and mechanically resilient material and shaped to provide a spring force that creates a forward bias for electrical contact 712. Barb 722 may extend from the rear end of beam 720 to facilitate forming electrical connections to a flexible printed circuit board or other electrically active component of an electronic device.

Figure 8:
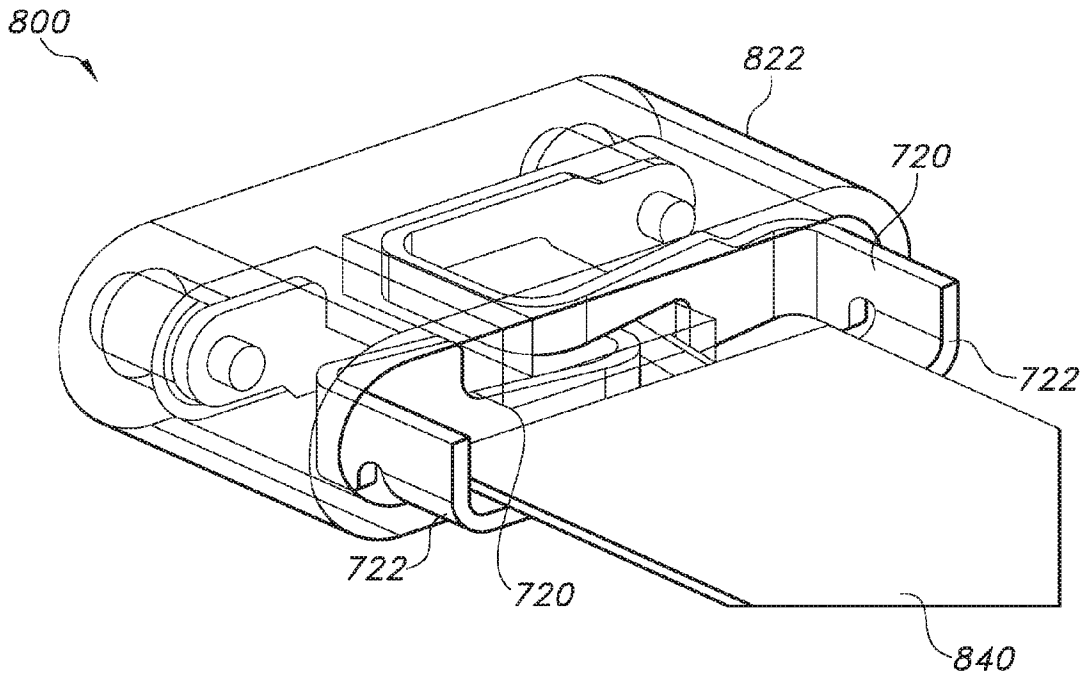
FIG. 8 shows a perspective view of a cartridge assembly according to an embodiment of the present invention.
Figure 9:
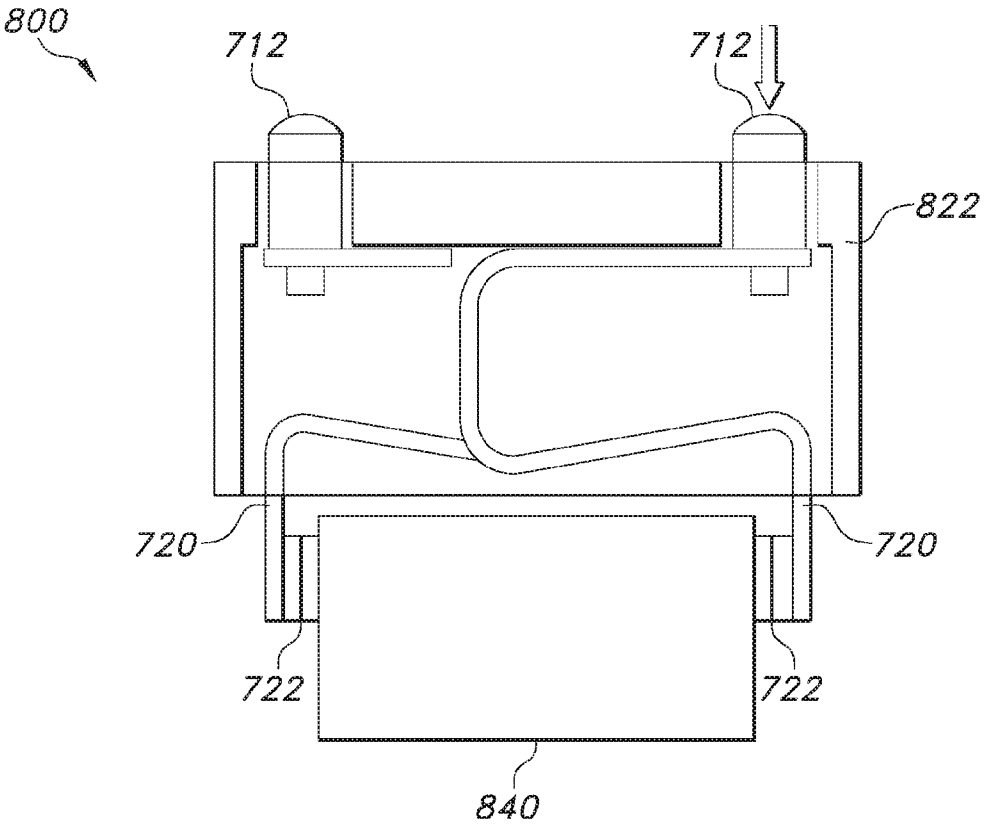
FIG. 9 shows a side view of a cartridge assembly according to an embodiment of the present invention.

FIGS. 8 and 9 show an example of a cartridge assembly 800 according to an embodiment of the present invention. FIG. 8 shows a perspective view and FIG. 9 shows a side view. Cartridge assembly 800 may incorporate, for example, two beams 720 with connected electrical contacts 712. Beams 720 may be disposed within a cartridge 822 such that the forward ends of electrical contacts 712 are exposed through the housing of cartridge 822. Barbs 722 may be connected to electrically conductive regions of printed circuit board 840, which may be, for example, a flexible printed circuit board. Printed circuit board 840, which may be, e.g., a flexible printed circuit board, may be electrically connected to other components of an electronic device. Cartridge assembly 800 may be inserted into a connector housing, similarly to cartridge 422 of FIG. 4.

Figure 10:
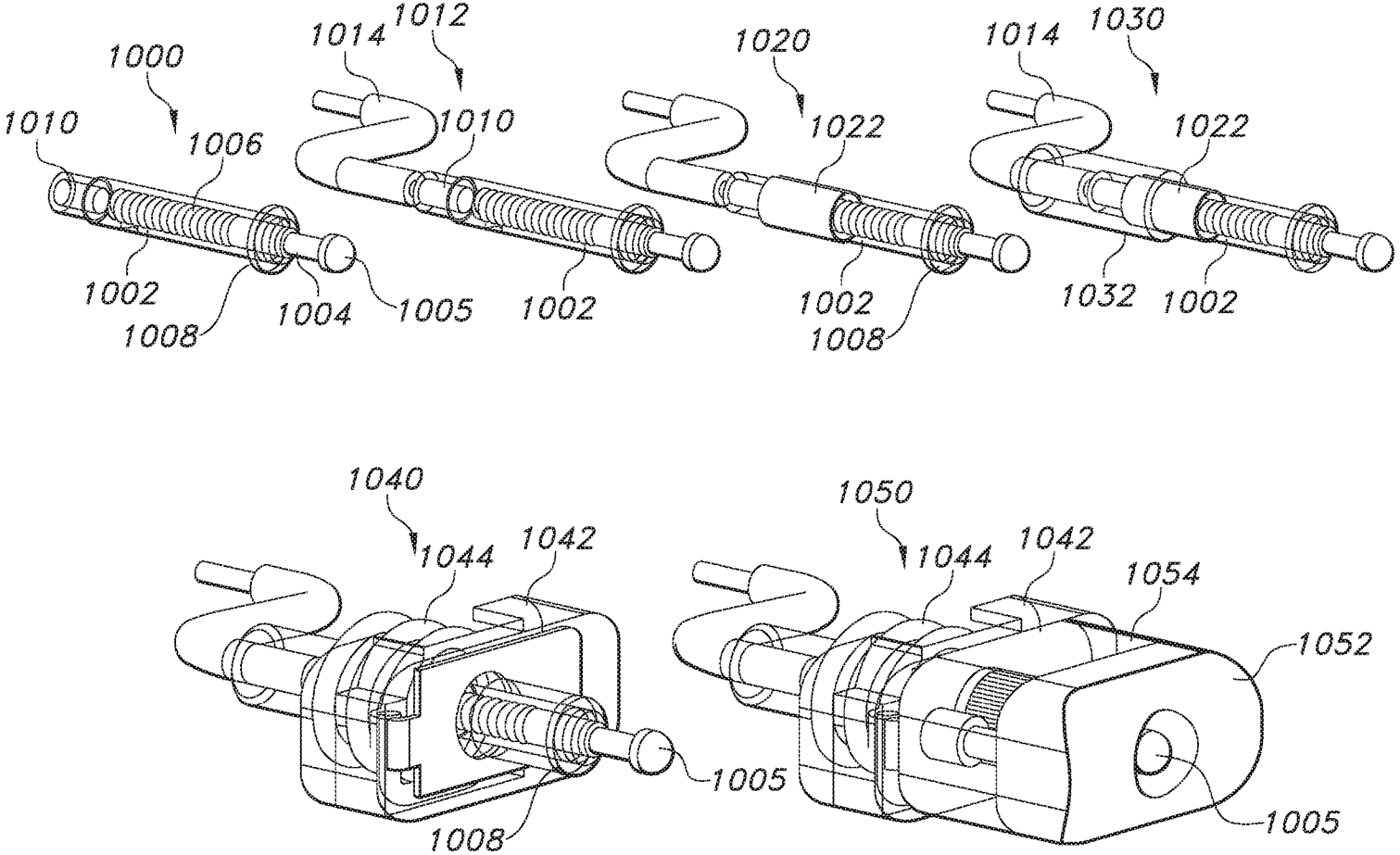
FIG. 10 shows an example of stages in forming a pogo pin assembly according to an embodiment of the present invention.

In some embodiments of the present invention, a forward bias on the electrical contacts of a connector assembly may be provided using pogo pin assemblies. FIG. 10 shows an example of stages in forming a pogo pin assembly according to an embodiment of the present invention. At stage 1000, a pogo pin 1002 is provided. Pogo pin 1002 may include a generally cylindrical conductive core 1004. The forward end 1005 of conductive core 1004 may be rounded similarly to electrical contacts described above. A spring 1006 may be disposed around conductive core 1004, and an insulating casing 1008 may be provided around spring 1006. Spring 1006 may provide a forward bias that may be overcome by pressing on forward end 1005 of conductive core 1004, which may retract conductive core 1004 into casing 1008 and create electrical contact between conductive core 1004 and rear conductor 1010, which may be fixedly mounted in casing 1008. As shown at 1012, the rear end of rear conductor 1010 may be connected to an insulated wire 1014, e.g., by soldering or sintering. The other end of insulated wire 1014 may later be connected to other electrically active components of an electronic device (e.g., to a printed circuit board). As shown at 1020, a mask plating 1022 may be wrapped around casing 1008 of pogo pin 1002. As shown at 1030, a low-pressure overmold 1032 may be formed around mask plating 1022 and the forward portion of insulated wire 1014. As shown at 1040, a mounting structure 1042 may be attached around pogo pin assembly 1030. In some embodiments, mounting structure 1042 may be an insert-molded plastic form. Mounting structure 1042 may have an attached flexure 1044 (e.g., a spring) extending from a rear portion thereof. Flexure 1044 may connect to low-pressure overmold 1032. As shown at 1050, a cosmetic cap 1052 may be applied to the front of mounting structure 1042. In some embodiments, cosmetic cap 1052 may be made of compressible elastic material (e.g., rubber) and may be water-resistant. Cosmetic cap 1052 may be shaped such that forward end 1005 of conductive core 1004 protrudes slightly through cosmetic cap 1052 when in its forward-biased position. Cosmetic cap 1052 may be secured in place using glue 1054 or other adhesive.

Figure 11:
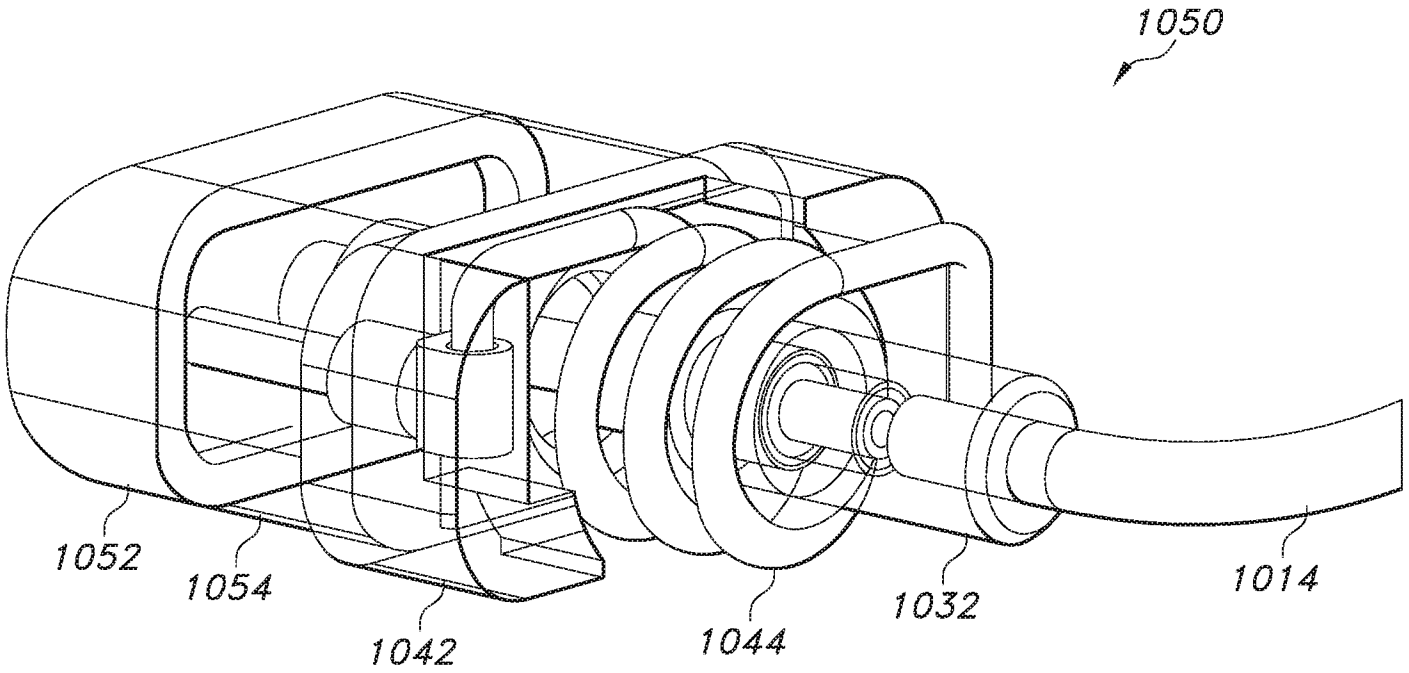
FIG. 11 shows a perspective view of a pogo pin assembly according to an embodiment of the present invention.
Figure 12:
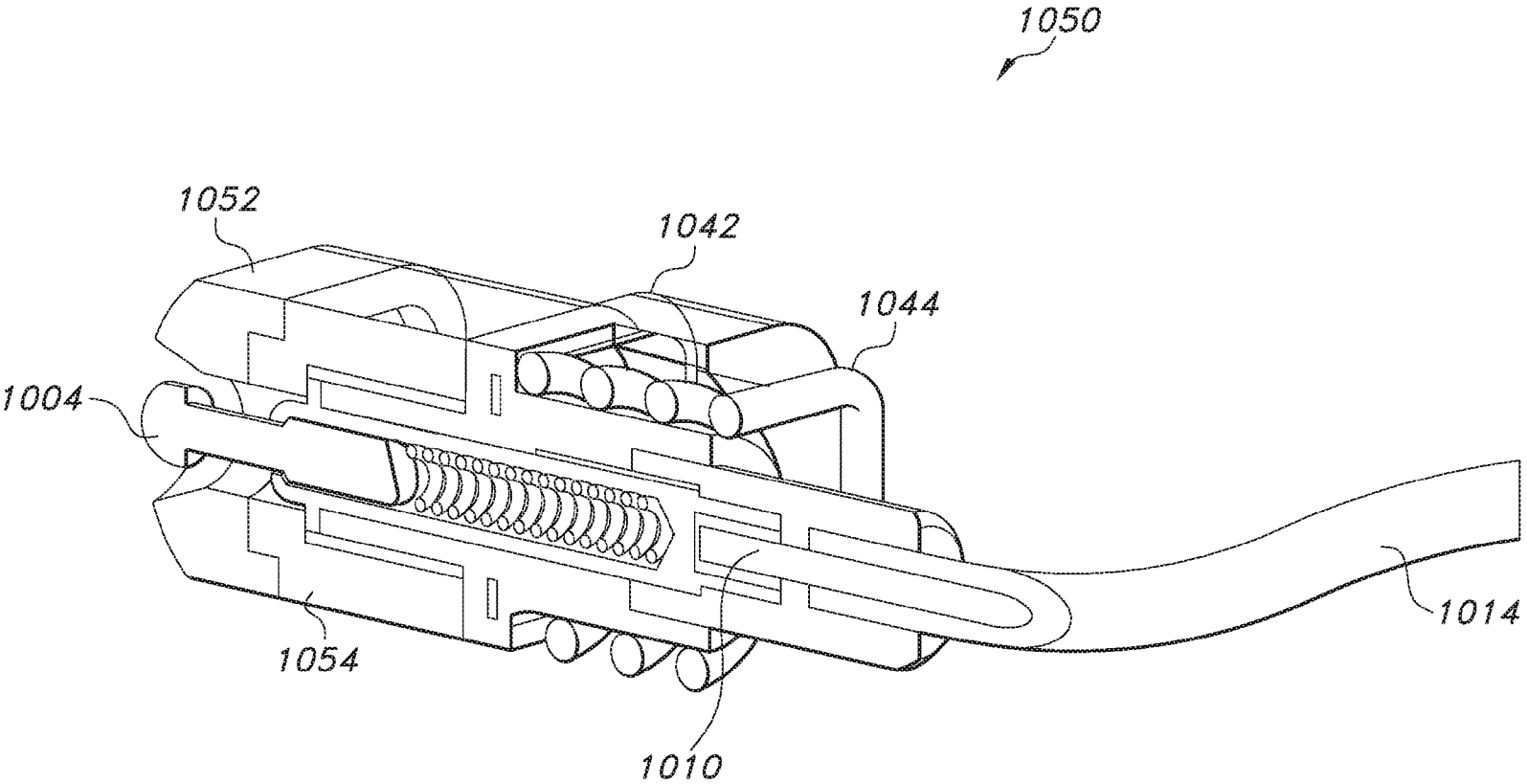
FIG. 12 shows a cutaway view of a pogo pin assembly according to an embodiment of the present invention.

FIGS. 11 and 12 show additional views of completed pogo pin assembly 1050. FIG. 11 shows a perspective view, and FIG. 12 shows a cutaway view. In some embodiments, one or more pogo pin assemblies 1050 may be used in place of cartridge 422 shown in FIG. 4.

In the embodiments described above, electrical contacts of a connector assembly may be biased proud, so that the forward ends of the electrical contacts extend outside the connector housing in the absence of other forces; when pressure is applied, the electrical contacts may retract into the housing when pressure is applied. However, with repeated attachment and detachment via lateral sliding (e.g., as shown in FIGS. 4 and 5), it is possible that damage to the electrical contacts may occur. Accordingly, some embodiments of the invention provide connector assemblies that include retraction mechanisms operable by a user to retract the electrical contacts into the housing (which may protect against damage during lateral sliding), and to extended the electrical contacts forward into an "engaged" position when alignment with a complementary connector assembly is achieved. Various retraction mechanisms may be provided. Some embodiments may also include interlock mechanisms to prevent lateral sliding of the connector assembly while the electrical contacts are in the engaged position and/or to prevent moving the electrical contacts into the engaged position during lateral sliding of the connector assembly. Examples will now be described.

Figures 13A, 13B:
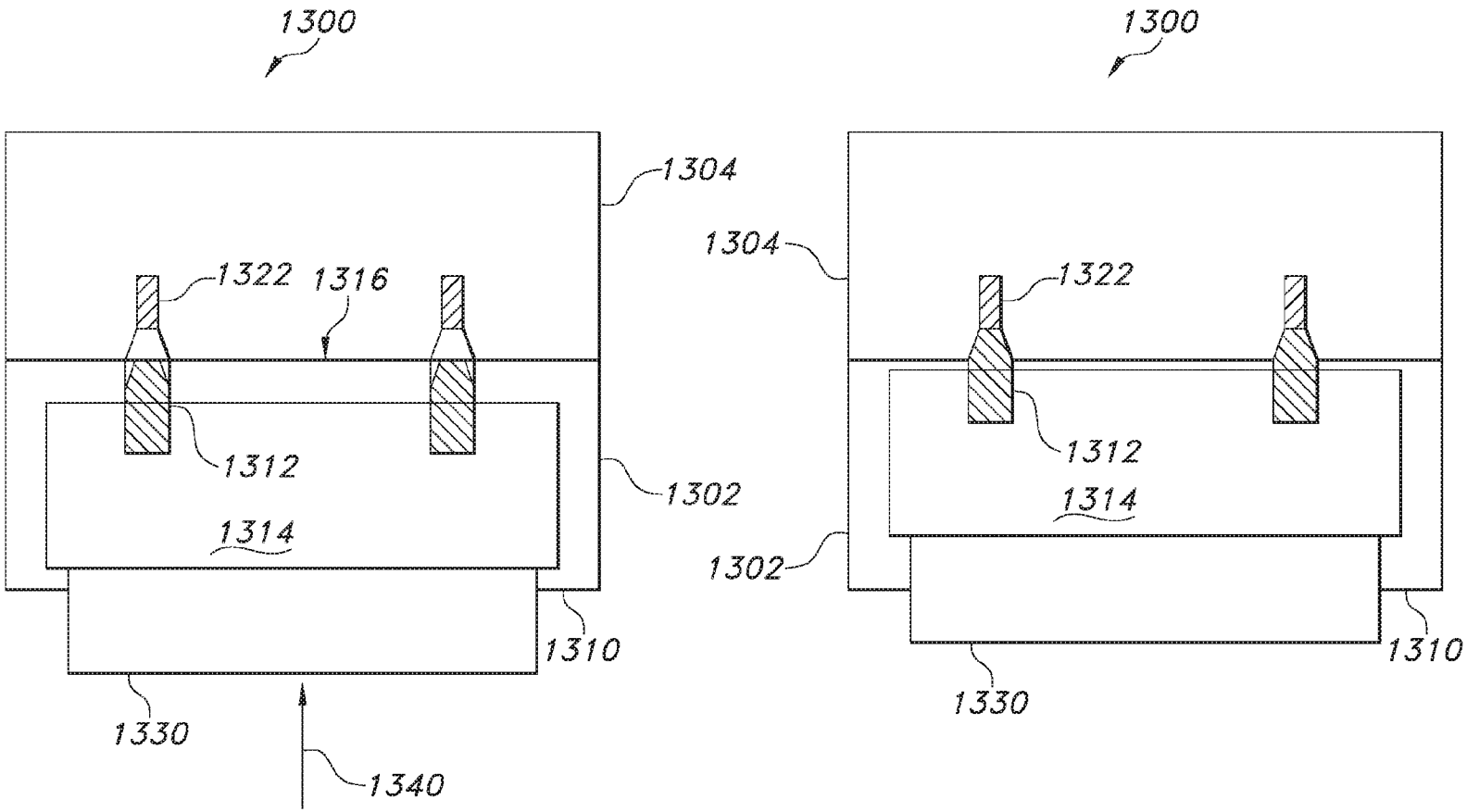
FIGS. 13A and 13B show simplified cross-section views of a connector interface system incorporating a connector assembly according to an embodiment of the present invention.
Figure 13C:
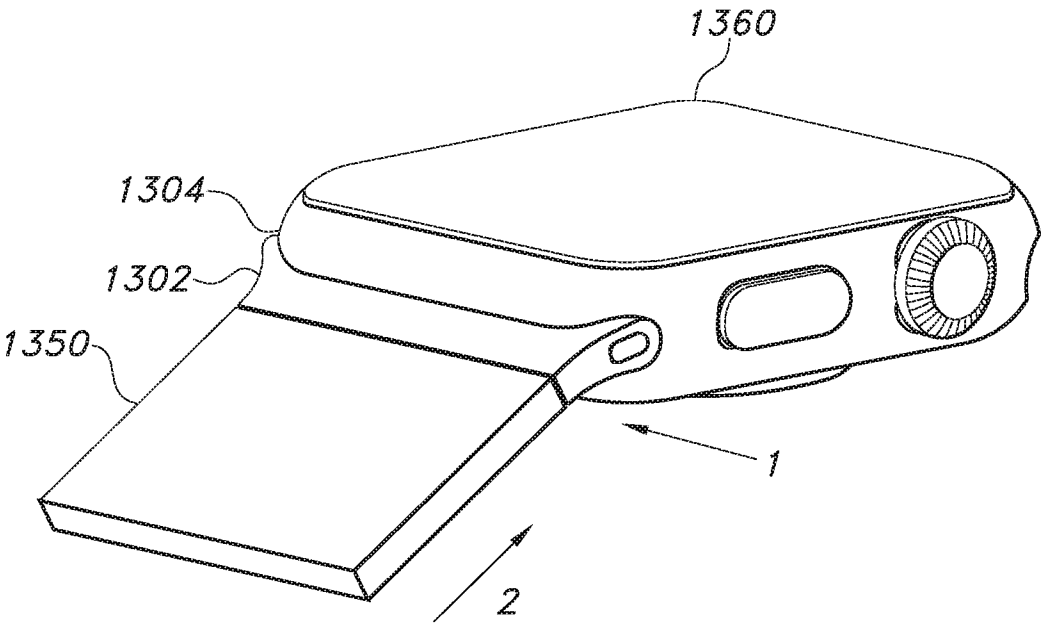
FIG. 13C shows an example application of connector interface system for connecting a watch band to a watch body unit according to an embodiment of the present invention.

In some embodiments of the present invention, a plunger may be provided to move the electrical contacts forward. FIGS. 13A and 13B show simplified cross-section views of a connector interface system 1300 incorporating a connector assembly according to an embodiment of the present invention. FIG. 13C shows an example application of connector interface system 1300 for connecting a watch band to a watch body unit according to an embodiment of the present invention. Connector interface system 1300 may be generally similar to connector interface system 100 of FIG. 1 and may include a first connector assembly 1302 (generally similar to connector assembly 102) and a second connector assembly 1304 (generally similar to connector assembly 104). First connector assembly 1302 may include a housing 1310 and one or more electrical contacts 1312 mounted on a sled 1314 that may be disposed within housing 1310. Sled 1314 may be movable in a direction perpendicular to front surface 1316 of connector assembly 1302. FIG. 13A shows sled 1314 in a retracted position, in which electrical contacts 1312 do not extend outside of housing 1310. In some embodiments, electrical contacts 1312 may be flush with surface 1316, and in other embodiments, electrical contacts 1312 may be retracted farther such that they do not extend all the way to surface 1316. When sled 1314 is in the retracted position, connector assembly 1302 may slide laterally relative to connector assembly 1304 without risk of damage to electrical contacts 1312. FIG. 13B shows sled 1314 in an engaged position. In this position, electrical contacts 1312 extend through housing 1310 and make contact with corresponding electrical contacts 1322 of second connector assembly 1304.

To allow a user to move sled 1314 between its engaged and retracted positions, sled 1314 may be attached to a rear plunger 1330, which may extend outside of housing 1310. The user may press in on rear plunger 1330 (as indicated by arrow 1340) to move sled 1314 into the engaged position and may pull out on rear plunger 1330 to move sled 1314 into the retracted position. As shown in FIG. 13C, in some embodiments where first connector assembly 1302 is implemented as a lug that connects a watch band 1350 to a watch body unit 1360, rear plunger 1330 may be incorporated into watch band 1350.

Figure 14:
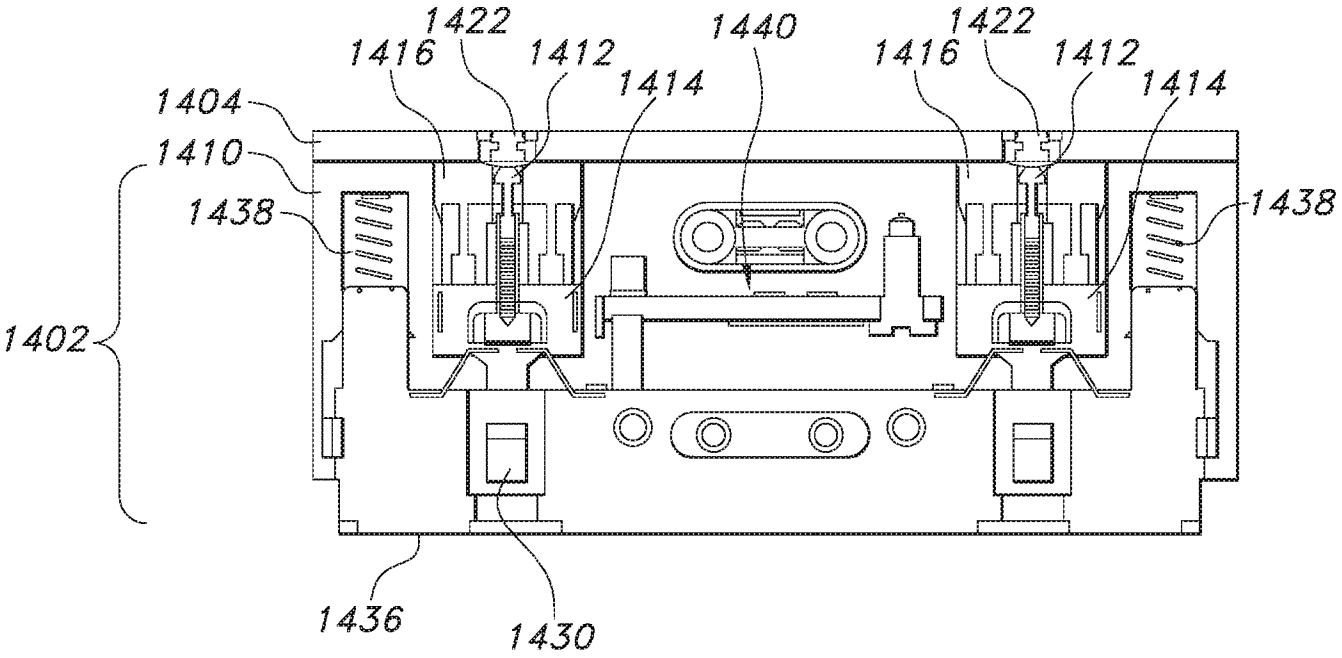
FIG. 14 shows a cross-section view of a connector interface system with electrical contacts in a retracted position according to an embodiment of the present invention.
Figure 15:
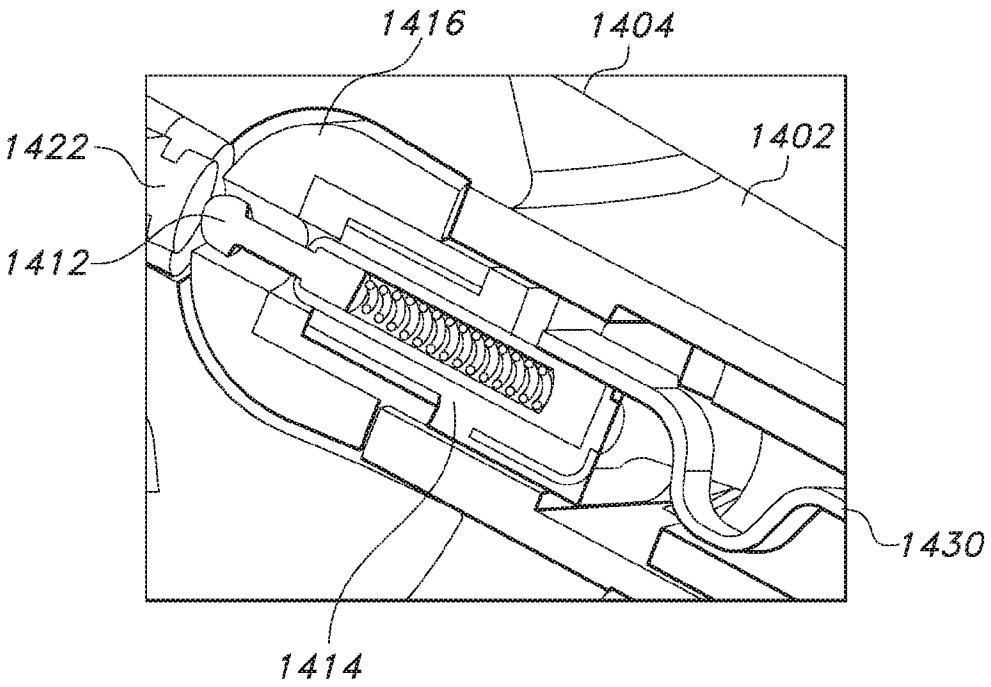
FIG. 15 shows a cutaway view of a connector interface system with electrical contacts in a retracted position according to an embodiment of the present invention.
Figure 16:
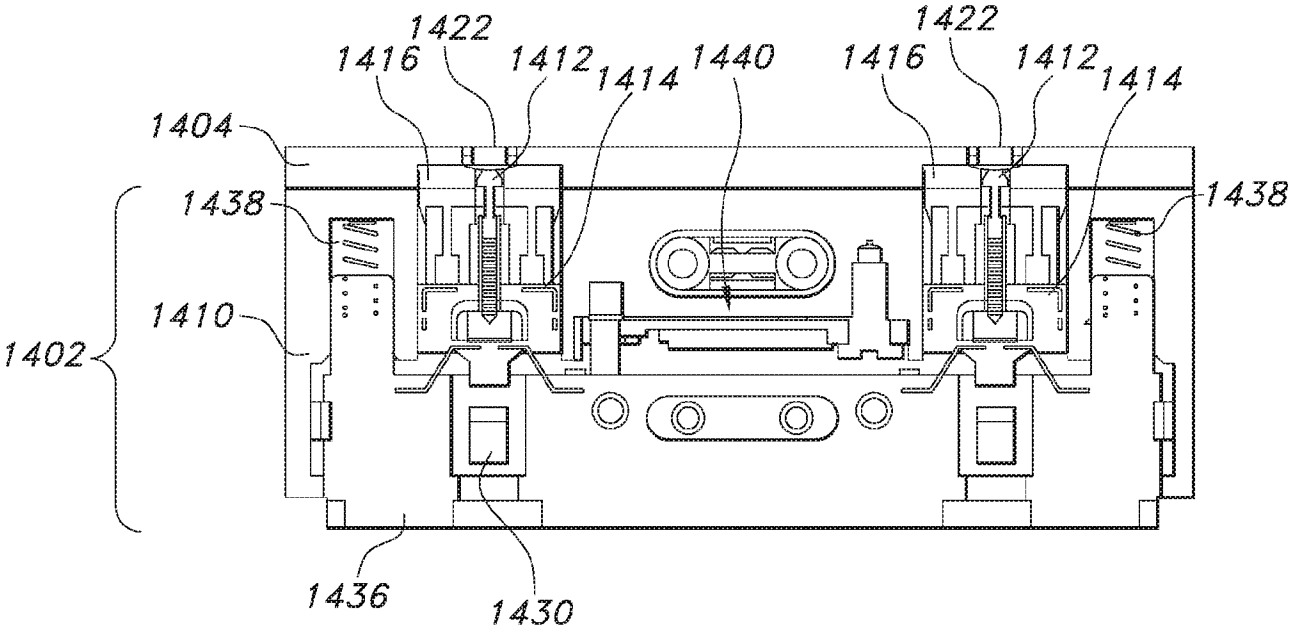
FIG. 16 shows a cross-section view of a connector interface system with electrical contacts in an engaged position according to an embodiment of the present invention.
Figure 17:
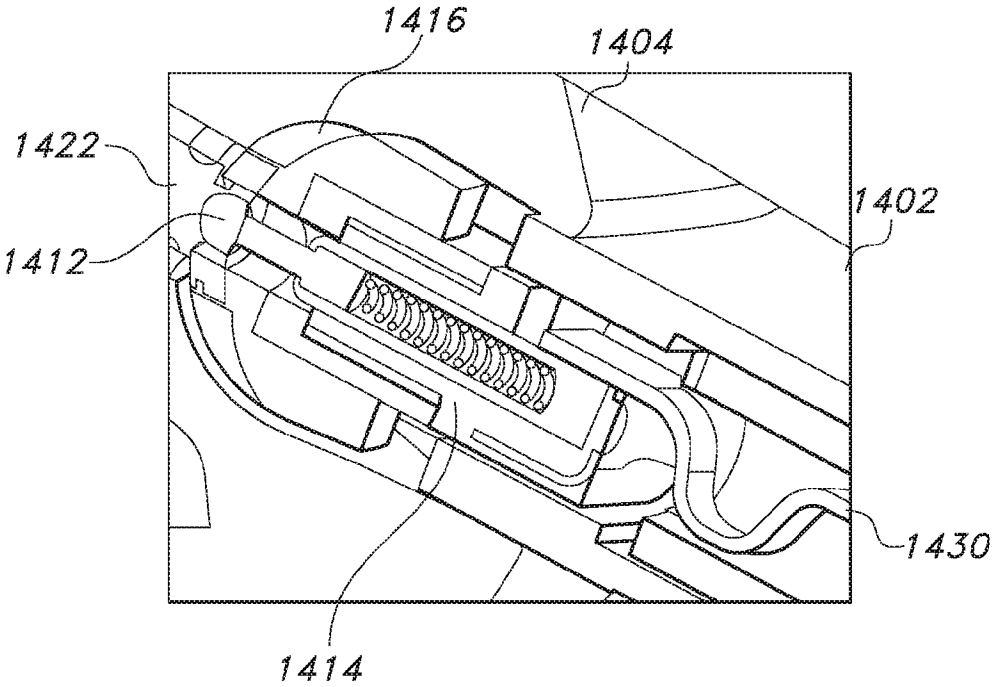
FIG. 17 shows a cutaway view of a connector interface system with electrical contacts in an engaged position according to an embodiment of the present invention.

FIGS. 14-17 show views of a specific implementation of a connector interface system 1400 according to an embodiment of the present invention. Connector interface system 1400 may be generally similar to connector interface system 1300, and may include first connector assembly 1402 (which may be similar to connector assembly 1302) and second connector assembly 1404 (which may be similar to connector assembly 1402). FIG. 14 shows a cross-section view of connector interface system 1400 with the contacts of first connector assembly 1402 in a retracted position. FIG. 15 shows a cutaway view of connector interface system 1400 with the contacts of first connector assembly 1402 in a retracted position. FIG. 16 shows a cross-section view of connector interface system 1400 with the contacts of first connector assembly 1402 in an engaged position. FIG. 17 shows a cutaway view of connector interface system 1400 with the contacts of first connector assembly 1402 in an engaged position.

Second connector assembly 1404 may include recessed electrical contacts 1422 as shown. Electrical contacts 1422 may be mounted in fixed positions, and a water-resistant seal may be applied around electrical contacts 1422 to prevent moisture from entering an electronic device in which second connector assembly 1404 is located.

First connector assembly 1402 may include electrical contacts 1412, which may be implemented using pogo pin assemblies 1414 similar to those described above with reference to FIGS. 10-12. For example, pogo pin assemblies 1414 may include a cosmetic cap 1416, which may be made of a compressible, elastic, water-resistant material to help provide a seal around electrical contacts 1412 and 1422 when the connector assemblies are engaged. A rear structure for pogo pin assembly 1414 may include an escape flexure 1430. Escape flexure 1430 may be made of a resilient material and shaped to provide strain relief. Escape flexure 1430 may include a conductive material (e.g., inside an insulating layer) to support electrical connections to pogo pin assembly 1414. In other embodiments, electrical contacts 1412 may be incorporated into a cartridge assembly, such as any of the cartridge assemblies described above with reference to FIGS. 4-9.

Pogo pin assembly 1414 and escape flexure 1430 may be mounted onto a movable sled 1436. In some embodiments, springs 1438 may be provided to bias sled 1436 toward a retracted position (shown in FIG. 14), and pressing forward on the rear of sled 1436 may overcome the spring force, allowing sled 1436 to move into the engaged position (shown in FIG. 16). An interlock mechanism, described below, may be used to hold sled 1436 in the engaged position.

As shown in FIGS. 14 and 15, in the retracted position, electrical contacts 1412 and cosmetic caps 1416 may be slightly recessed inside housing 1410. The recess depth may be small (e.g., 0.1 to 0.3 mm). This may protect electrical contacts 1412 and cosmetic caps 1416 against damage during lateral sliding of connector assembly 1402 relative to connector assembly 1404.

As shown in FIGS. 16 and 17, in the engaged position, portions of electrical contacts 1412 and cosmetic caps 1416 (colored in red) may extend outside of housing 1410. Accordingly, electrical contacts 1412 may make contact with recessed electrical contacts 1422. In some embodiments, a forward bias provided pogo pin assembly 1414 may facilitate making electrical contact. For example, pogo pin assembly 1414 may be constructed such that the natural resting position is slightly forward of where contact will occur, so that pogo pin assembly 1414 presses electrical contact 1412 against electrical contact 1422. The forward pressure may also assist in forming a tight seal between cosmetic cap 1416 and the surface of connector assembly 1404, which may prevent moisture from entering the electrical connection area and potentially corroding electrical contacts 1412 and/or 1422.

In some embodiments of the present invention, connector assembly 1402 may include an interlock mechanism 1440. Interlock mechanism 1440 may help to hold sled 1436 in the engaged position against the force of springs 1438 and may also prevent lateral sliding of connector 1402 while sled 1436 is in the engaged position. Interlock mechanism 1440 may incorporate a mechanical interlock feature that automatically engages when sled 1436 reaches the engaged position to hold sled 1436 in place and an ejection control (e.g., a user-operable button) that may be used to release the interlock feature and allow sled 1436 to return to the retracted position.

Figure 18:
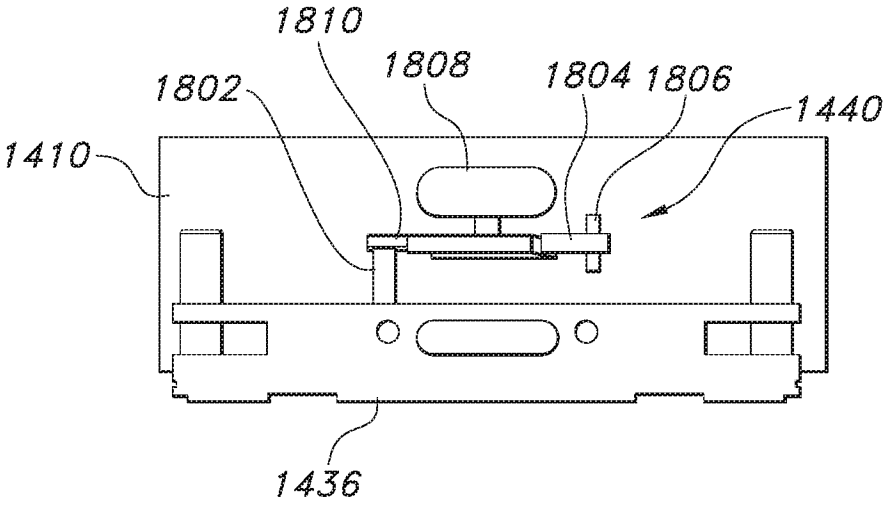
FIGS. 18-20 show features of an interlock mechanism according to an embodiment of the present invention.
Figure 19:
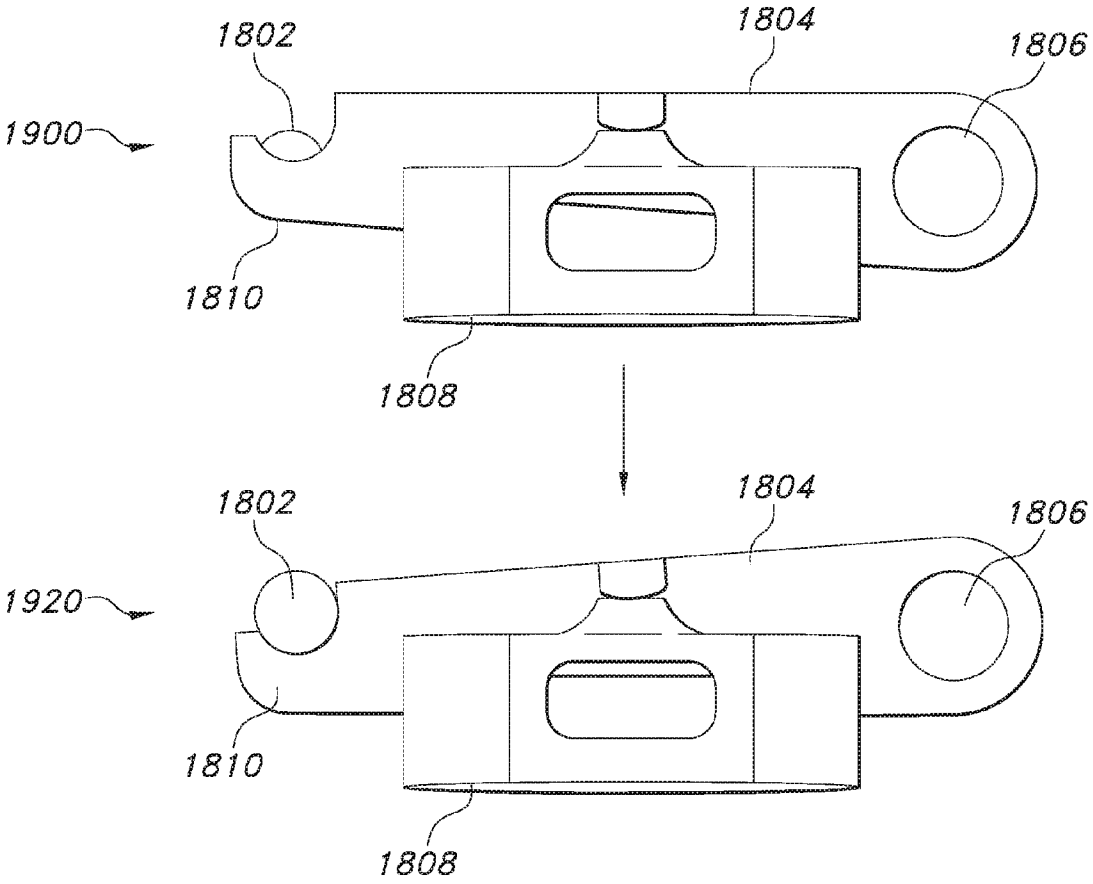
Figure 20:
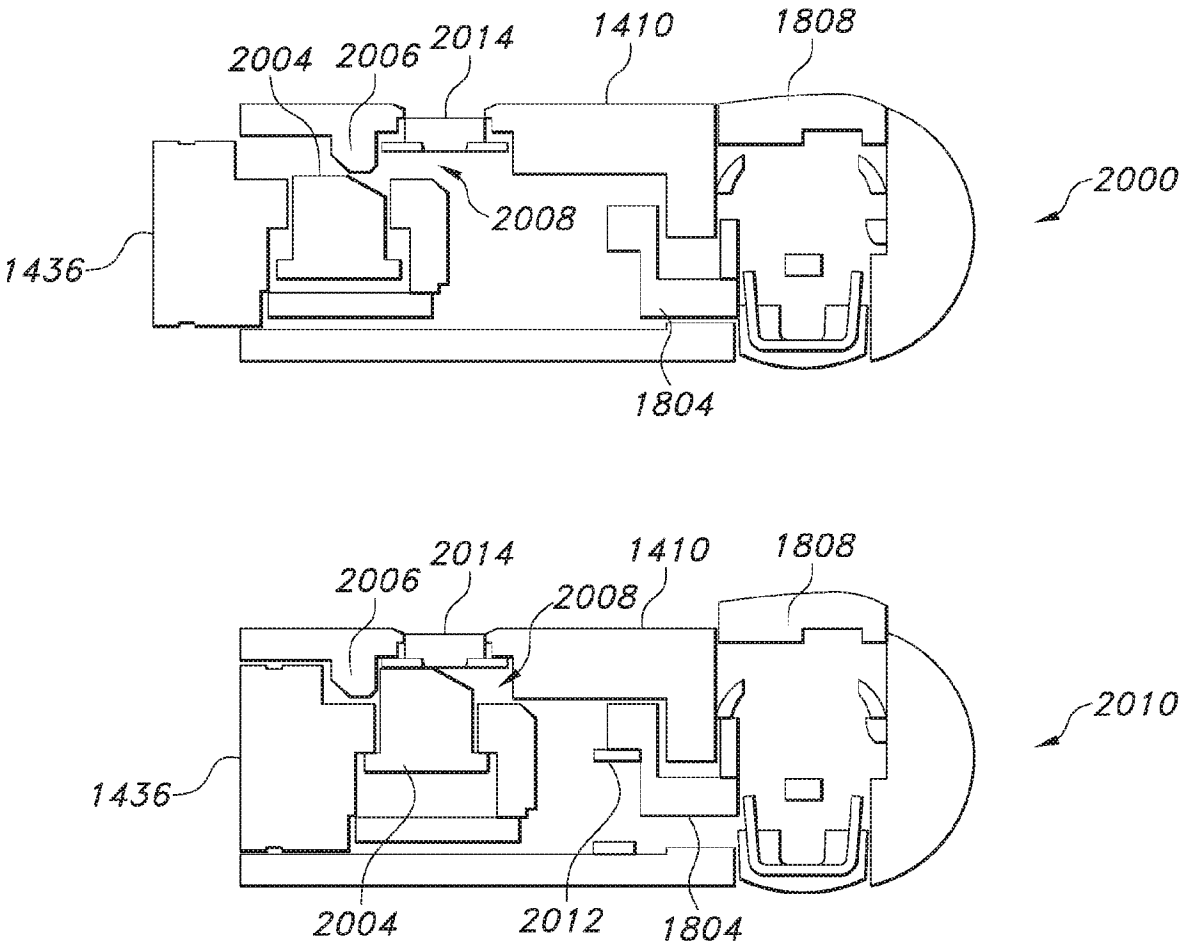

FIGS. 18-20 show additional details of interlock mechanism 1440. Shown in FIG. 18 is a simplified side view of a portion of connector assembly 1402, including sled 1436 and interlock mechanism 1440. Sled 1436 may include a lockout post 1802 that extends forward from the front surface of the sled, e.g., between the electrical contacts. Interlock mechanism 1440 may include a lockout lever 1804, one end of which may be rotatably coupled to a mounting post 1806 that is fixedly installed in housing 1410. A portion of lockout mechanism 1440 may be connected to an interlock button 1808. When interlock button 1808 is in a first position (e.g., a depressed position), free end 1810 of lockout lever 1804 may be positioned in front of the travel path of lockout post 1802, blocking forward motion of sled 1436. When interlock button 1808 is in a second position (e.g., a raised position), free end 1810 of lockout lever 1804 may move out of the way of lockout post 1802, allowing sled 1436 to move forward into the engaged position. In some embodiments, interlock button 1808 may be biased toward the raised position, e.g., using springs.

FIG. 19 is a simplified top view further illustrating operation of interlock button 1808. Shown at 1900 is interlock button 1808 in the first position, with free end 1810 of lockout lever 1804 obstructing motion of lockout tooth 1802. Shown at 1920 is interlock button 1808 in the second position, with lockout lever 1804 no longer obstructing lockout post 1802. In some embodiments, the travel distance of interlock button 1808 may be, e.g., 0.3 mm, and the travel distance of free end 1810 may be somewhat longer, e.g., 0.6 mm. Lockout lever 1804 may rotate through an angle of, e.g., 4.5 degrees.

In some embodiments, interlock button 1808 may be deployed on the forward portion of housing 1410, which may be inserted into the slot of complementary connector assembly 1404. Where this is the case, pressure from the surface of complementary connector assembly 1404 may hold interlock button 1808 in the first (depressed) position during lateral sliding, thereby keeping sled 1436 in its retracted position. In addition, if sled 1436 is in its engaged position, it may not be possible to press interlock button 1808, and this may prevent attempts to insert connector assembly 1402 into connector assembly 1404 while sled 1436 is in its engaged position. In some embodiments, connector assembly 1404 may include a surface indentation that aligns with interlock button 1808. This indentation may be placed such that when connector assembly 1404 and connector assembly 1402 are in alignment, interlock button 1808 is able to move into the second (raised) position, freeing sled 1436 to move forward.

FIG. 20 shows a simplified side cross section view of connector assembly 1402 with interlock mechanism 1440 in the retracted configuration at 2000 and the engaged configuration at 2010. In the retracted configuration, interlock button 1808 is in its depressed position and lockout lever 1804 is down, blocking advancement of sled 1436 (e.g., by blocking advancement of lockout post 1802, which is not shown in FIG. 20). In the engaged configuration, interlock button 1808 is in its raised position and lever 1804 is up, allowing sled 1436 to advance into its engaged position.

FIG. 20 also shows an ejection mechanism that may be provided to ensure that sled 1436 is in its retracted position prior to sliding connector assembly 1402 out of engagement with complementary connector assembly 1404. In some embodiments, the ejection mechanism may cooperate with the interlock mechanism. As shown, sled 1436 may include a movable tooth 2004, which may be biased to press outward through the side of sled 1436. In retracted configuration 2000, sled tooth 2004 may be pressed inward by a protrusion 2006 in the inner surface of housing 1418. In engaged configuration 2010, sled tooth 2004 may deploy past protrusion 2006 and press outward into recess 2008. The rear edge of sled tooth 2004 may be shaped to prevent sled 1436 from spontaneously moving backward from the engaged position. In some embodiments, an additional interlock feature 2012 may also engage when sled tooth 2004 is deployed. In some embodiments, additional interlock feature 2012 may prevent interlock button 1808 from being pressed inward while sled 1436 is in the engaged position. To disconnect connector assembly 1402, a user may first press eject button 2014, which may be mechanically connected such that pressing eject button 2014 retracts both sled tooth 2004 and additional interlock feature 2012. This may allow sled 1436 to return to its retracted position. In some embodiments, spring 1438 (shown in FIGS. 14 and 16) may push sled 1436 into the retracted position when eject button 2014 is pressed. Thereafter, the user may press interlock button 1808 (either directly or by pressing a release button that may be provided on connector assembly 1404 and arranged to apply pressure to interlock button 1808). Once interlock button 1808 is pressed, connector assembly 1402 may again laterally slide to allow its removal from connector assembly 1404.

Figure 21:
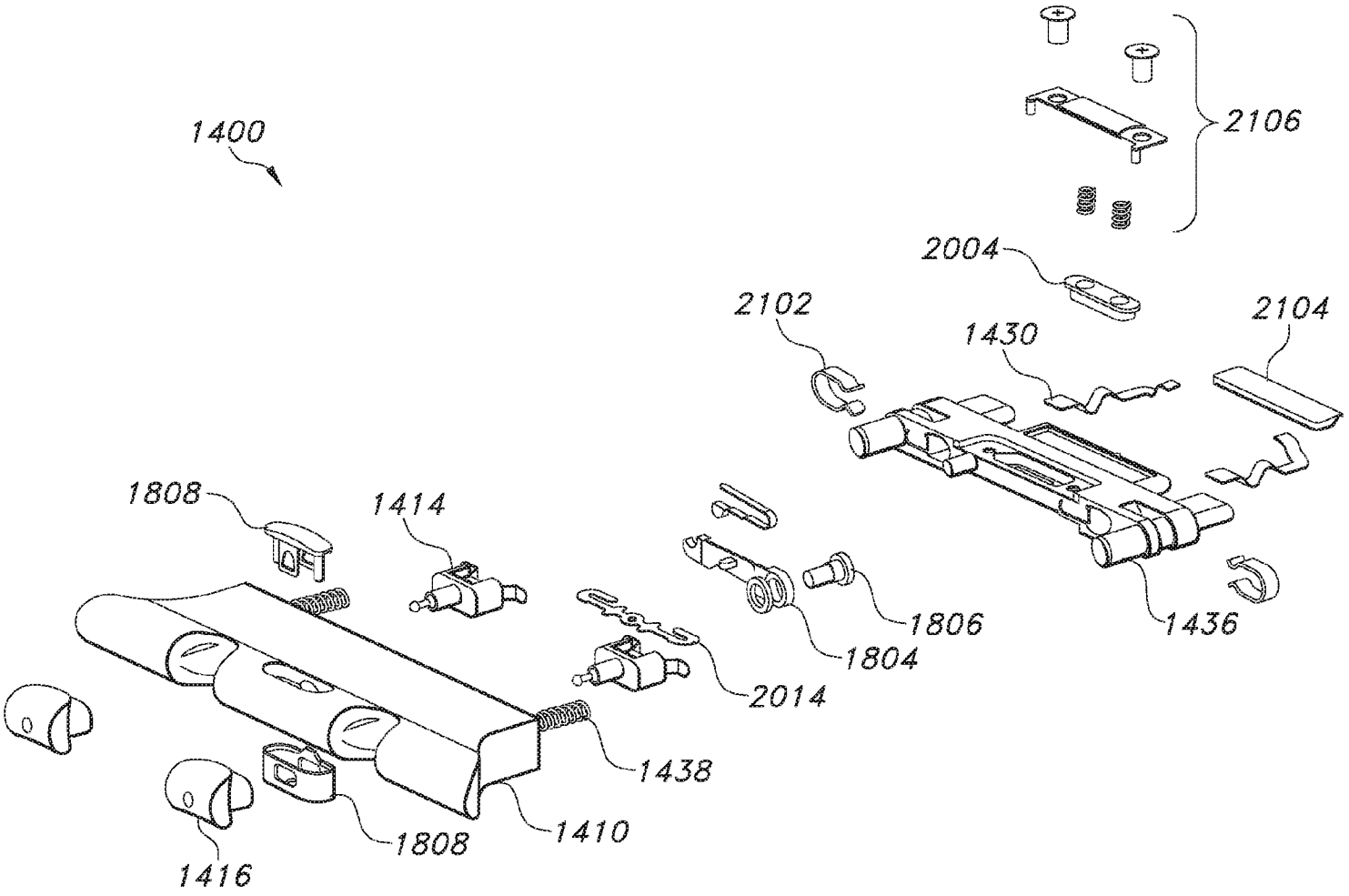
FIG. 21 shows an exploded view of a connector assembly according to an embodiment of the present invention.

FIG. 21 shows an exploded view of connector assembly 1400 according to an embodiment of the present invention. Connector assembly 1400 may include housing 1410, cosmetic caps 1416, pogo pin assemblies 1414, sled 1436 with return springs 1438 and backstop clips 2102, escape flexes 1430, and a printed circuit board 2104 (e.g., a flexible printed circuit board) to which pogo pin assemblies 1414 may be connected via escape flexes 1430. Connector assembly 1400 may also include interlock components, such as interlock button 1808 (shown in two parts), lockout lever 1804 and mounting post 1806, and sled tooth 2004 and associated mounting hardware 2016.

Figure 22B:
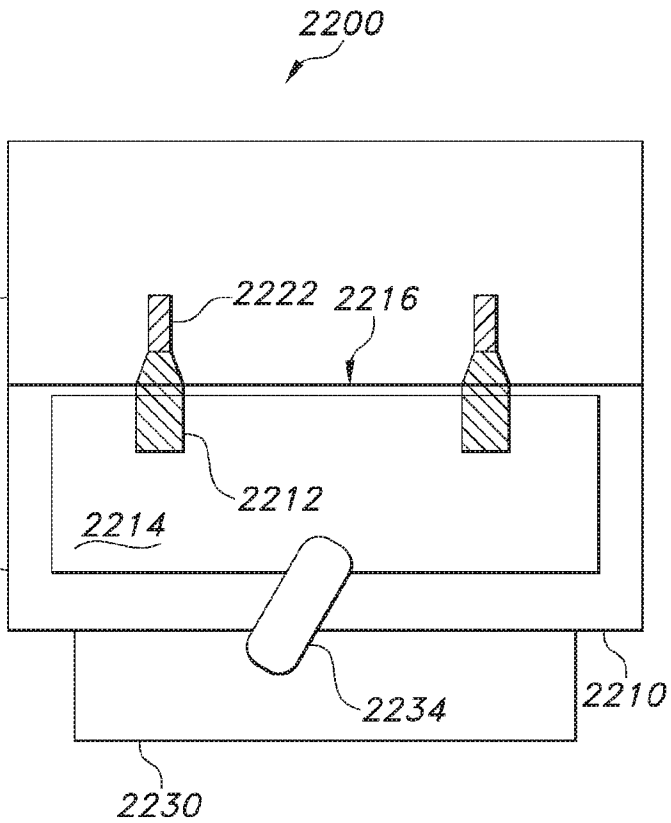
FIGS. 22A and 22B show simplified cross-section views of a connector interface system incorporating a connector assembly according to an embodiment of the present invention.
Figure 22A:
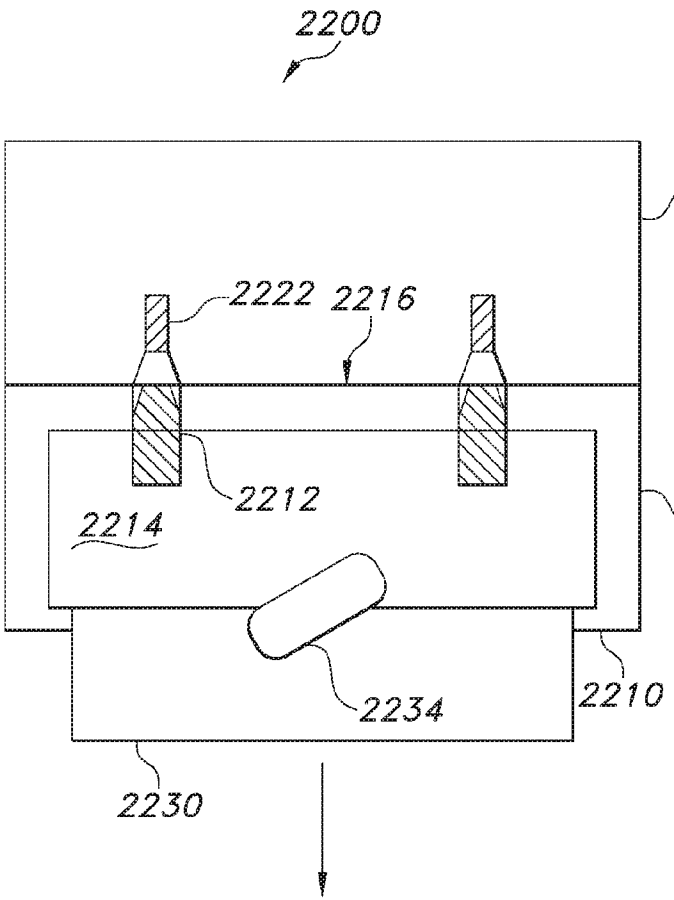

In some embodiments of the present invention, motion of a sled carrying electrical contacts may be controlled using a lever mechanism, such that when the user pulls on a tab, the sled is pushed forward. FIGS. 22A and 22B show simplified cross-section views of a connector interface system 2200 incorporating a connector assembly according to an embodiment of the present invention. Connector interface system 2200 may be generally similar to connector interface system 100 of FIG. 1 and may include a first connector assembly 2202 (which may be generally similar to connector assembly 102) and a second connector assembly 2204 (which may be generally similar to connector assembly 104). First connector assembly 2202 may include a housing 2210 and one or more electrical contacts 2212 mounted on a sled 2214 that may be disposed within housing 2210. Sled 2214 may be movable in a direction perpendicular to front surface 2216 of connector assembly 2202. FIG. 22A shows sled 2214 in a retracted position, in which electrical contacts 2212 do not extend outside of housing 2210. In some embodiments, electrical contacts 2212 may be flush with surface 2216, and in other embodiments, electrical contacts 2212 may be retracted farther such that they do not extend all the way to surface 2216. When sled 2214 is in the retracted position, connector assembly 2202 may slide laterally relative to connector assembly 2204 without risk of damage to electrical contacts 2212. FIG. 22B shows sled 2214 in an engaged position. In this position, electrical contacts 2212 extend through housing 2210 and make contact with corresponding electrical contacts 2222 of second connector assembly 2204.

Figure 22C:
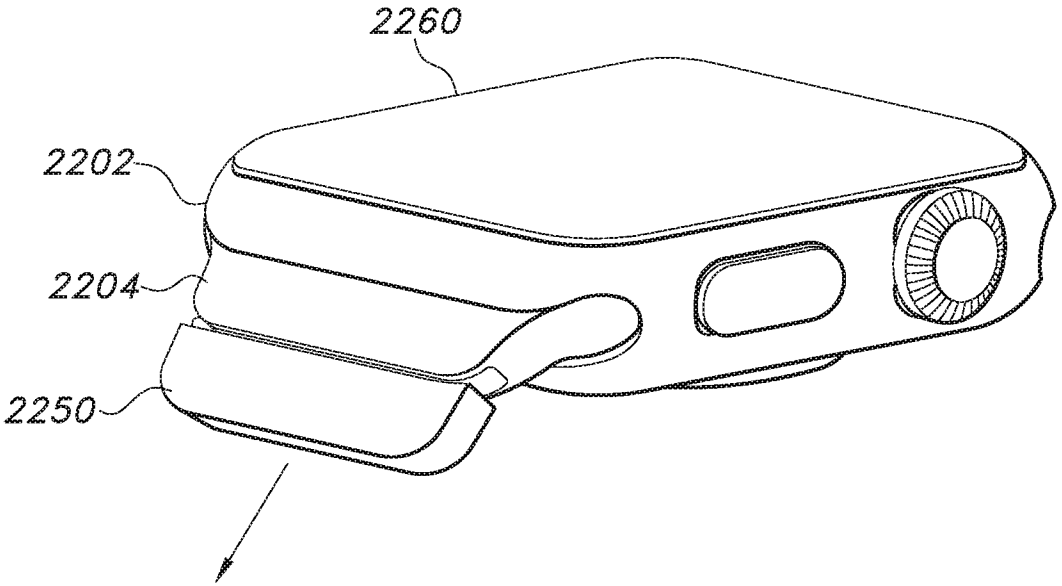
FIG. 22C shows an example application of connector interface system for connecting a watch band to a watch body unit according to an embodiment of the present invention.

To allow a user to move sled 2214 between its engaged and retracted positions, sled 2214 may be attached to a pull tab 2230 that extends outward through the rear of housing 2210. The user may pull on pull tab 2230 (as indicated by arrow 2232) to operate lever 2234, thereby moving sled 2214 into the engaged position and may push on pull tab 2230 to move sled 2214 into the retracted position. As shown in FIG. 22C, in some embodiments where first connector assembly 2202 is implemented as a lug that connects a watch band 2250 to a watch body unit 2260, pull-tab 2230 may be incorporated into watch band 2250.

Figure 23:
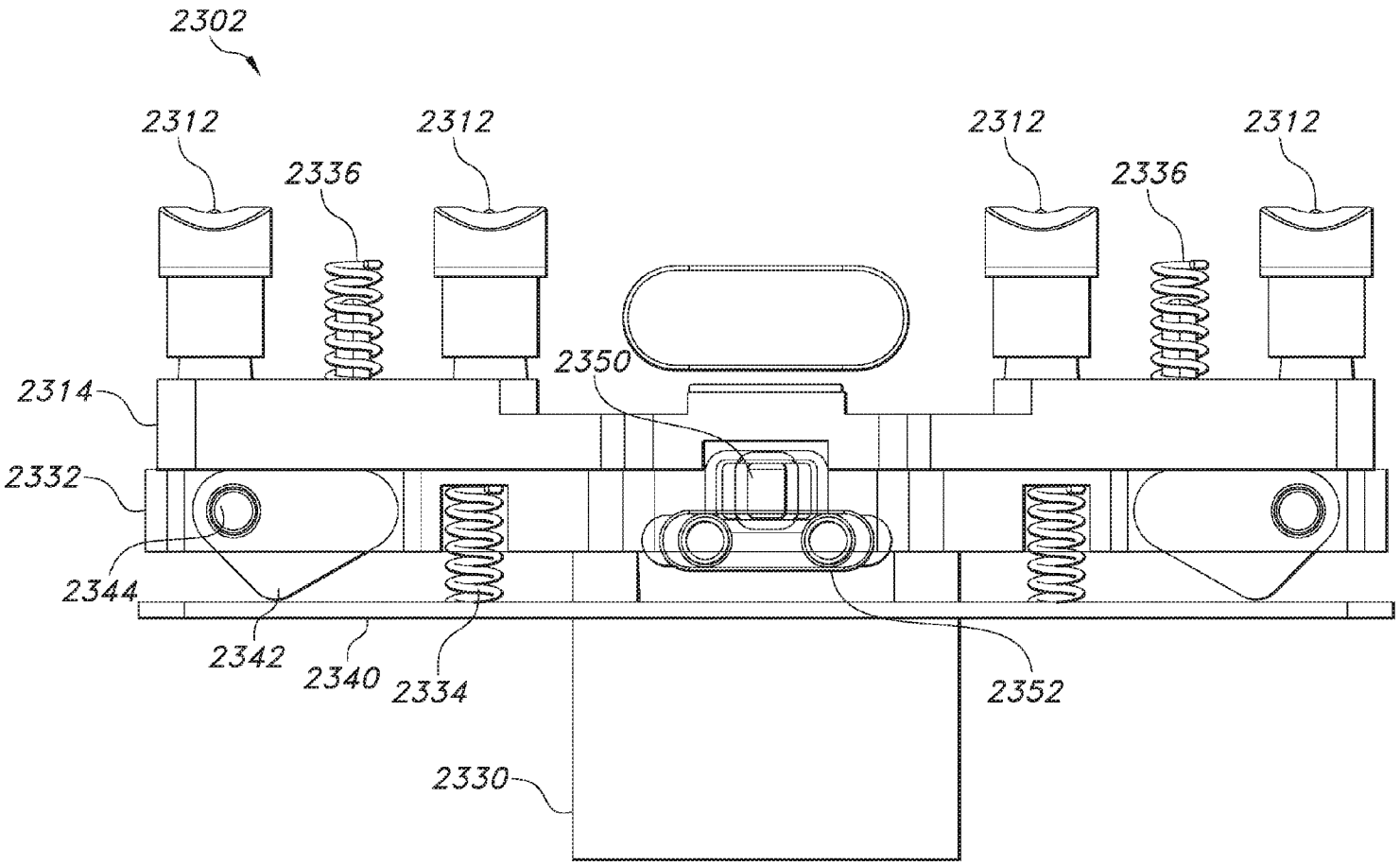
FIG. 23 shows a simplified side view of a connector assembly according to an embodiment of the present invention.

FIG. 23 shows a simplified side view of a specific implementation of a connector assembly 2302 according to an embodiment of the present invention. Connector assembly 2300 may be generally similar to connector assembly 2202, with electrical contacts 2312 mounted on a sled 2314, which may be moved by operating a pull tab 2330. Electrical contacts 2312 may be implemented using a pogo pin assembly (e.g., as shown in FIGS. 10-12). In some embodiments, a cartridge assembly (e.g., as shown in FIGS. 4-9) may be used. Sled 2314 may be movable relative to shuttle 2332. Shuttle return springs 2334 may bias shuttle 2332 toward sled 2314, and sled return springs 2336 may bias sled 2314 toward shuttle 2332. Capture plate 2340 may be fixedly connected to the housing (not shown) of connector assembly 2302, and pull tab 2330 may pass through capture plate 2340 and connect to shuttle 2332. Toggles 2342 may be generally square or triangular rigid bodies rotatably mounted to shuttle 2332, e.g., using pins 2344. One portion of the edge surface of each toggle 2342 may be in contact with capture plate 2340, and another portion of the edge surface of each toggle 2342 may be in contact with a rear-facing surface of sled 2314. A locking tooth 2350 may be mounted on shuttle 2332 and capable of engaging with locking window 2352 in the housing of connector assembly 2300. The engagement mechanism can be similar to that described above with reference to FIGS. 18-20.

In operation, when a user pulls on pull tab 2330, shuttle 2332 may be pulled toward capture plate 2340. This motion may cause toggles 2342 to rotate about pins 2344, pushing sled 2314 forward into the engaged position. Locking tooth 2350 of shuttle 2332 may engage with locking window 2352, preventing sled 2314 from moving out of the engaged position. In some embodiments, a user may be able to operate an eject button, similar to that described above, to allow sled 2314 to move back to the retracted position. Accordingly, while sled 2314 is in its retracted position, the user may laterally slide connector assembly 2302 to align with a complementary connector assembly (which can be similar to connector assembly 2204 of FIG. 22). Once the connector assemblies are aligned, the user may pull on pull tab 2330 to move sled 2314 into the engaged position. In some embodiments, lateral sliding of connector assembly 2300 can be prevented while sled 2314 is in the engaged position, e.g., using an interlock mechanism similar to examples described above.

Figure 24B:
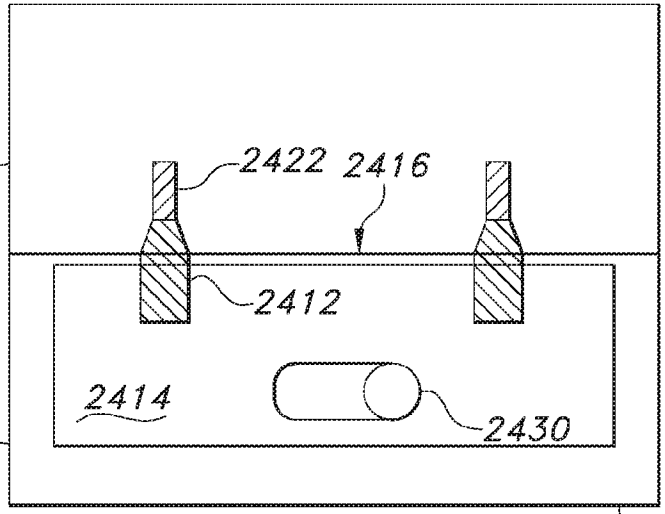
FIGS. 24A and 24B show simplified cross-section views of a connector interface system incorporating a connector assembly according to an embodiment of the present invention.
Figure 24A:
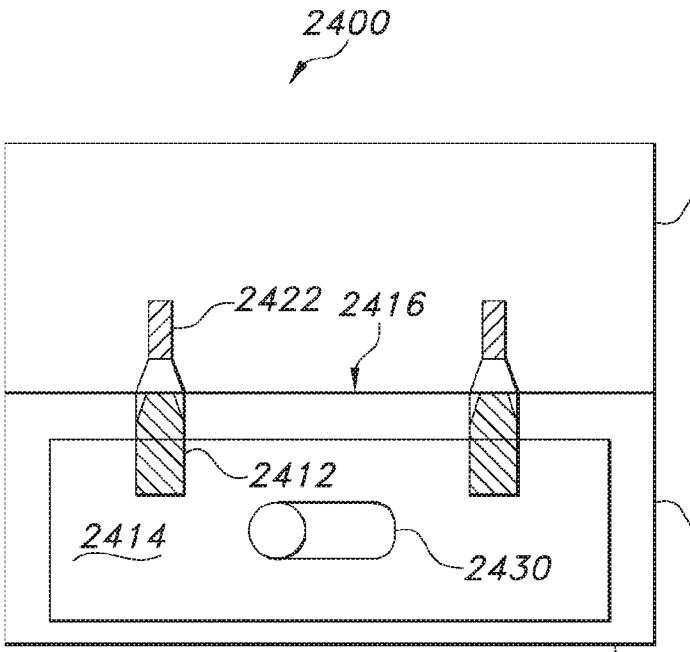

In some embodiments of the present invention, motion of a sled carrying electrical contacts may be controlled using a slider mechanism, such that when the user slides a control laterally, the sled is pushed forward. FIGS. 24A and 24B show simplified cross-section views of a connector interface system 2400 incorporating a connector assembly according to an embodiment of the present invention. Connector interface system 2400 may be generally similar to connector interface system 100 of FIG. 1 and may include a first connector assembly 2402 (generally similar to connector assembly 102) and a second connector assembly 2404 (generally similar to connector assembly 104). First connector assembly 2402 may include a housing 2410 and one or more electrical contacts 2412 mounted on a sled 2414 that may be disposed within housing 2410. Sled 2414 may be movable in a direction perpendicular to front surface 2416 of connector assembly 2402. In FIG. 24A, sled 2414 is shown in a retracted position, in which electrical contacts 2412 do not extend outside of housing 2410. In some embodiments, electrical contacts 2412 may be flush with surface 2416, and in other embodiments, electrical contacts 2412 may be retracted farther such that they do not extend all the way to surface 2416. When sled 2414 is in the retracted position, connector assembly 2402 may slide laterally relative to connector assembly 2404 without risk of damage to electrical contacts 2412. In FIG. 24B, sled 2414 is shown in an engaged position. In this position, electrical contacts 2412 extend through housing 2410 and make contact with corresponding electrical contacts 2422 of second connector assembly 2404.

Figure 24C:
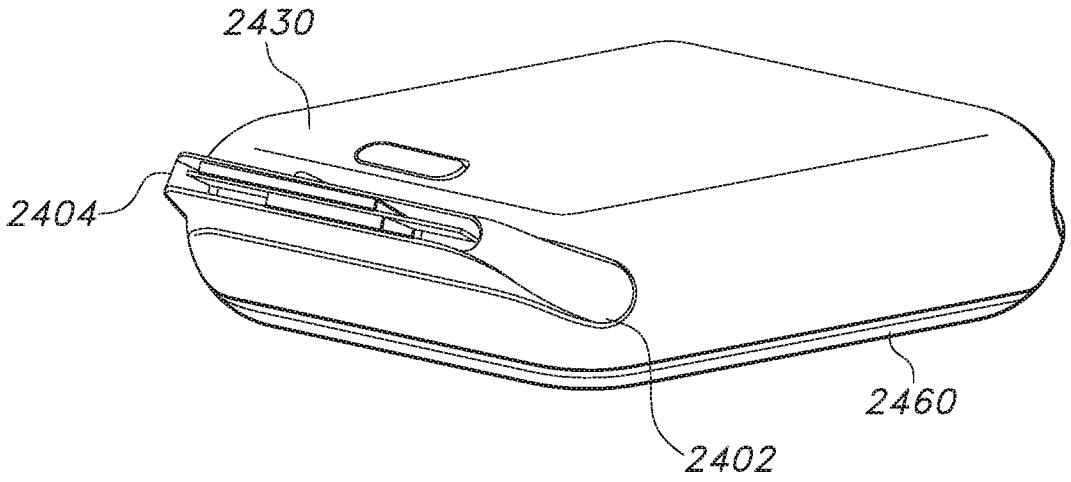
FIG. 24C shows an example application of connector interface system for connecting a watch band to a watch body unit according to an embodiment of the present invention.

To allow a user to move sled 2414 between its engaged and retracted positions, sled 2414 may be controlled using a slider control 2430 that may be exposed through housing 2410. The user may slide control 2430 in one direction to move sled 2414 forward into the engaged position and in the other direction to move sled 2414 back into the retracted position. As with embodiments described above, lockout mechanisms may be incorporated to prevent accidental movement of sled 2414 and/or to prevent lateral sliding of connector assembly 2402 while sled 2414 is in the engaged position. As shown in FIG. 24C, in some embodiments where first connector assembly 2402 is implemented as a lug that connects a watch band (not shown) to a watch body unit 2460, slider control 2430 may be exposed through an inside surface of the lug or through a side surface of the lug (as shown below).

Figure 25:
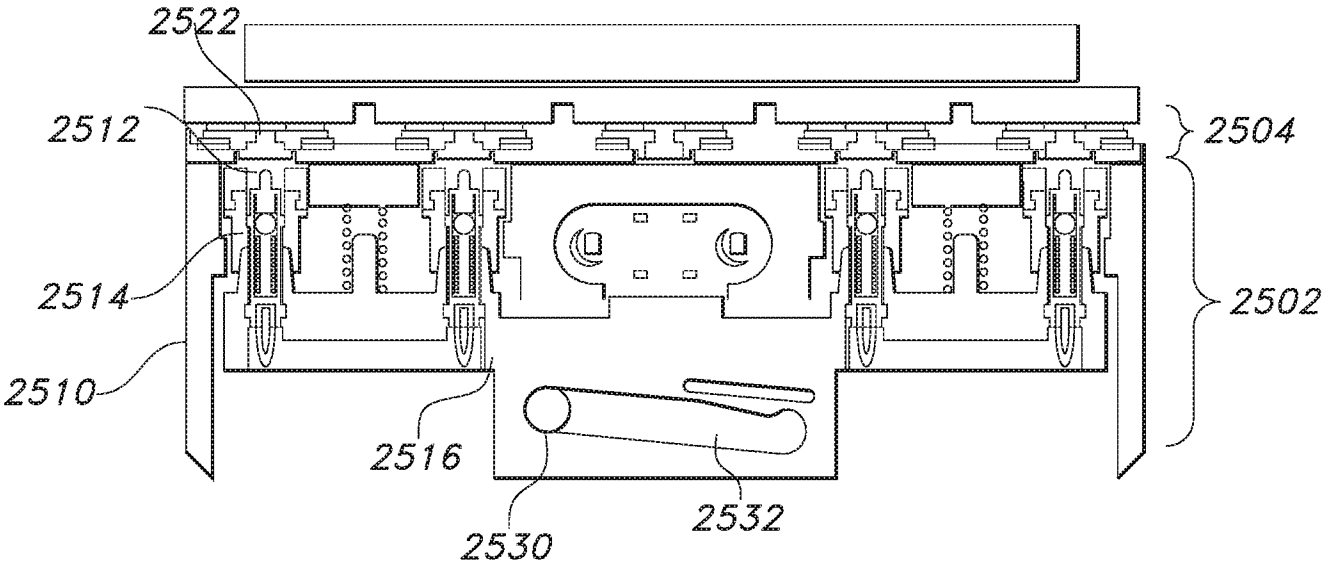
FIG. 25 shows a simplified cross-section view of a connector interface system in a retracted position according to an embodiment of the present invention.
Figure 26:
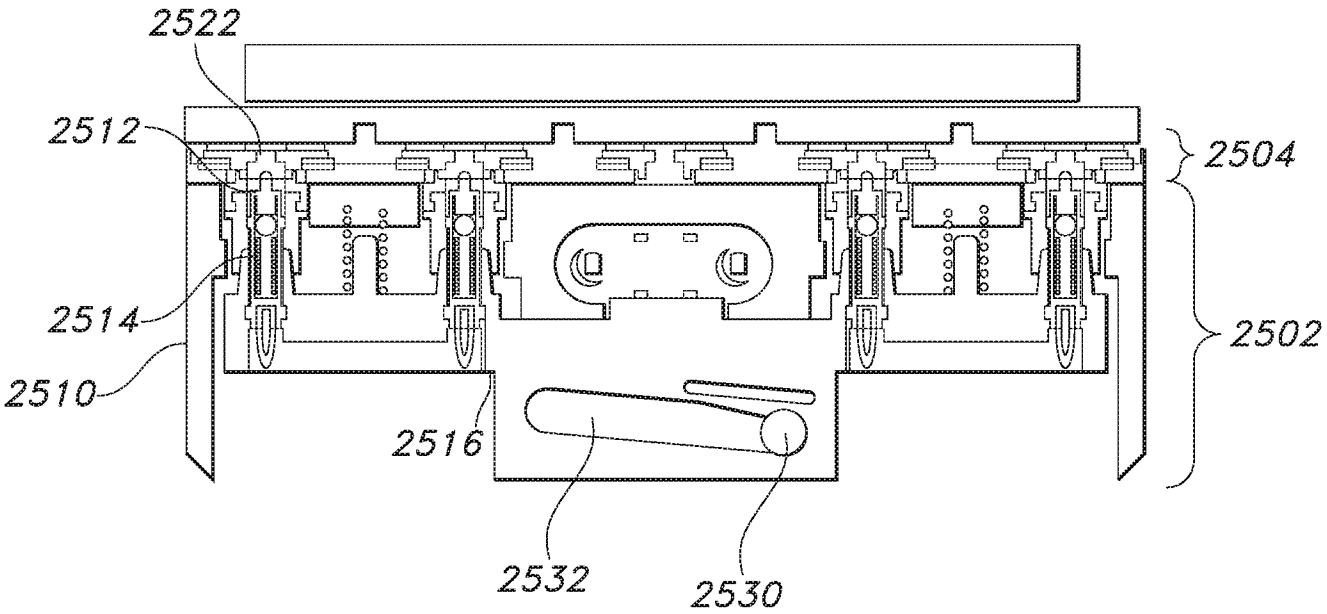
FIG. 26 shows a simplified cross-section view of a connector interface system in an engaged position according to an embodiment of the present invention.

FIGS. 25 and 26 show a first slider configuration for a connector assembly according to an embodiment of the present invention. FIG. 25 shows a simplified cross-section view of a connector interface system 2500 in a retracted position, and FIG. 26 shows a simplified cross-section view of connector interface system 2500 in an engaged position. Connector interface system 2500 may be similar to connector interface system 2400 and may include a first connector assembly 2502 (which may be similar to connector assembly 2402) and a second connector assembly 2504 (which may be similar to connector assembly 2404).

Second connector assembly 2504 may include recessed electrical contacts 2522 as shown. Electrical contacts 2522 may be mounted in fixed positions, and a water-resistant seal may be applied around electrical contacts 2522 to prevent moisture from entering the electronic device in which second connector assembly 2504 is located.

First connector assembly 2502 may include electrical contacts 2512, which may be implemented using pogo pin assemblies 2514 similar to those described above with reference to FIGS. 10-12. In some embodiments, one or more cartridge assemblies (e.g., as described above with reference to FIGS. 4-9) may be used. Pogo pin assemblies 2514 may be mounted on a shuttle 2516 that is movable within housing 2510. Movement of shuttle 2516 may be controlled by operating a slider connected to slider element 2530, which be disposed in an angled track 2532. Lateral movement of slider element 2530 may push shuttle 2516 forward into the engaged position or backward into the retracted position. In some embodiments, slider element 2530 may be connected to a user-operable slider control outside of housing 2510.

Figure 27:
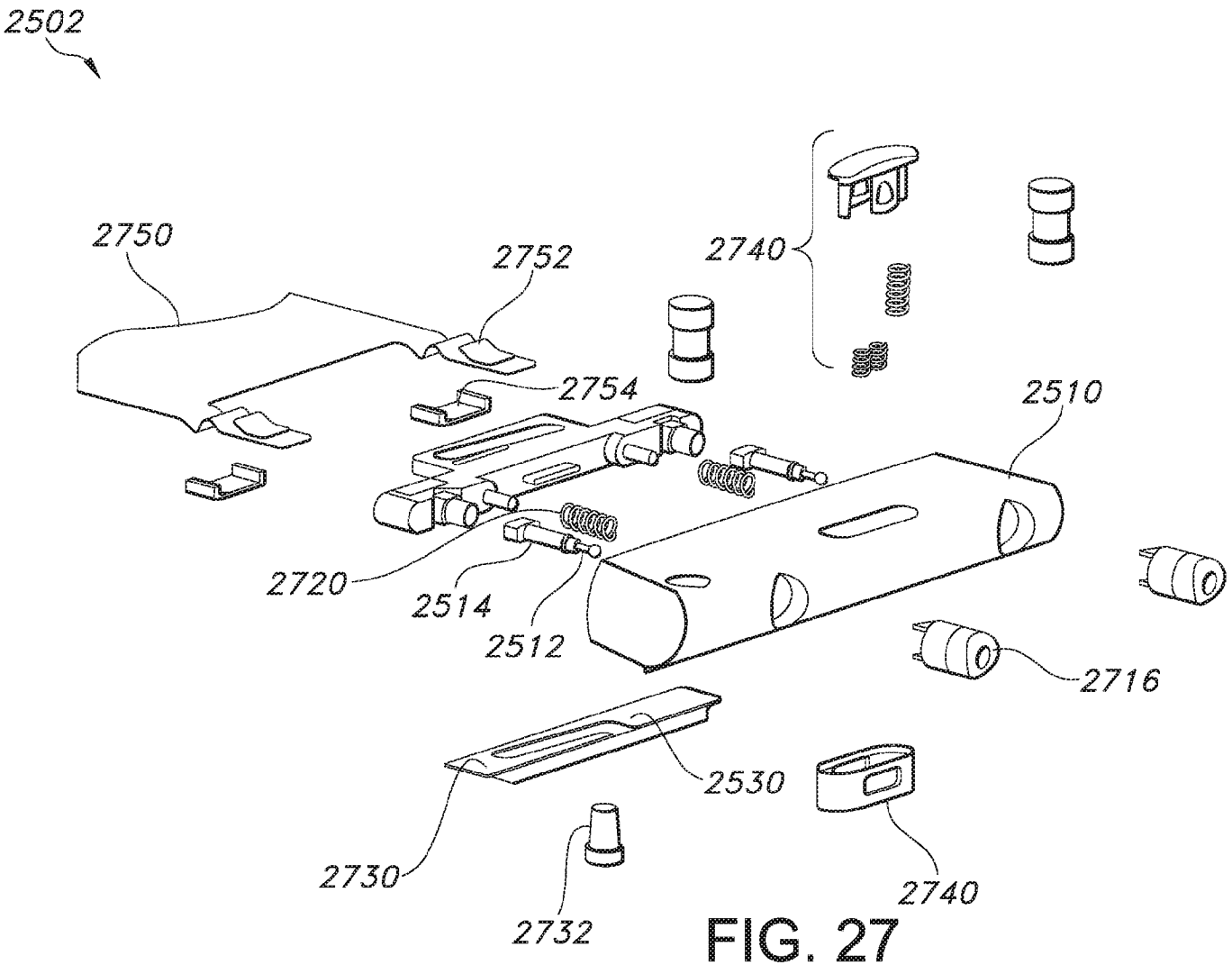
FIG. 27 shows an exploded view of a connector assembly according to an embodiment of the present invention.

FIG. 27 shows an exploded view of connector assembly 2502 according to an embodiment of the present invention. Connector assembly 2502 may include housing 2510, pogo pin assemblies 2514 with cosmetic caps 2716, sled 2516, sled return springs 2720, a slider plate 2730 providing slider element 2530, external slider control 2732 (attached to the reverse side of slider plate 2730), and connector release assembly 2740 (which may be similar to the user-operable ejection button described above). Electrical connections to pogo pin assemblies 2514 may be provided using a flexible printed circuit board 2750 with spring clips 2752 and trays 2754. Although not shown, an interlock mechanism similar to mechanisms described above may be provided to prevent lateral sliding of connector assembly 2502 while sled 2516 is in the engaged position.

Figure 28:
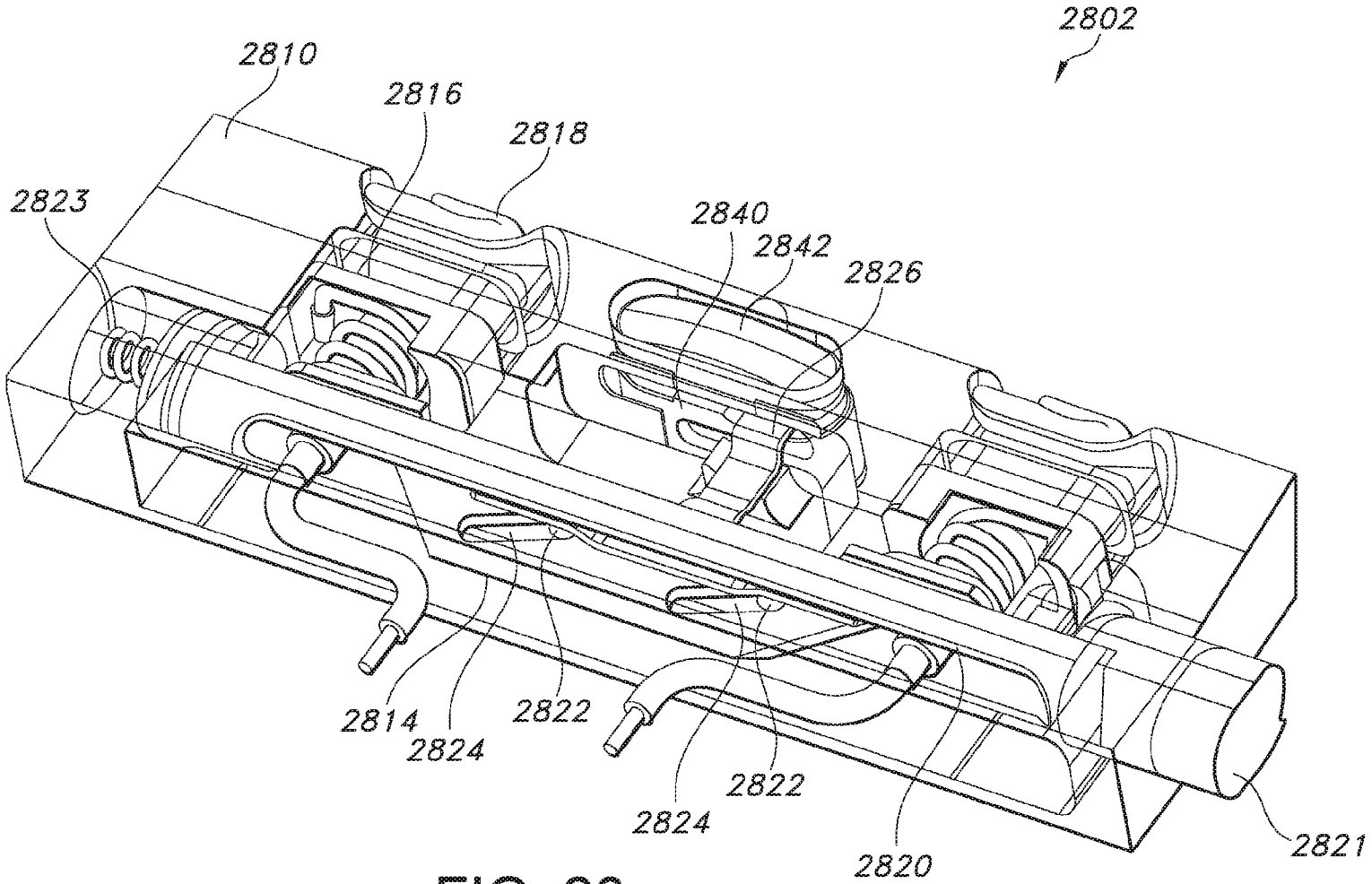
FIG. 28 shows a simplified cutaway view of a connector assembly according to an embodiment of the present invention.

In some embodiments, a user-operable slider control may be located at a side surface of the connector assembly. FIG. 28 shows a simplified cutaway view of another specific implementation of a connector assembly 2802 according to an embodiment of the present invention. Connector assembly 2802 may be generally similar to connector assembly 2402 of FIG. 24. Connector assembly 2802 may include a housing 2810. A sled 2814 may be movably disposed inside housing 2810, and sled 2814 may carry electrical contacts, such as pogo pin assemblies 2816, which may include cosmetic caps 2818 similar to cosmetic caps described above. A cartridge assembly (e.g., as described above with reference to FIGS. 4-9) may also be used.

A movable slider bar 2820 may be arranged within housing 2810 such that one end 2821 of slider bar 2820 extends outside of housing 2810. A return spring 2823 may be disposed within housing 2810 at the end opposite exposed end 2821. Slider bar 2820 may include projections 2822 that fit within channels 2824 of sled 2814. Slider bar 2820 may also have a tongue 2826 that may extend forward and engage with an interlocker 2840 that can be moved by pressing or releasing an interlock button 2842.

FIG. 28 shows sled 2814 in the retracted position. In operation, when the user presses inward on exposed end 2821 of slider bar 2820, projections 2822 move laterally within channels 2824 of sled 2814. Sled 2814 may be constrained from lateral movement, and consequently, the movement of projections 2822 may result in pushing sled 2814 forward into the engaged position. The same movement may also result in lateral movement of tongue 2826. This can result in tongue 2826 interlocking with interlocker 2840, thereby preventing unwanted movement of slider bar 2820.

Figure 29:
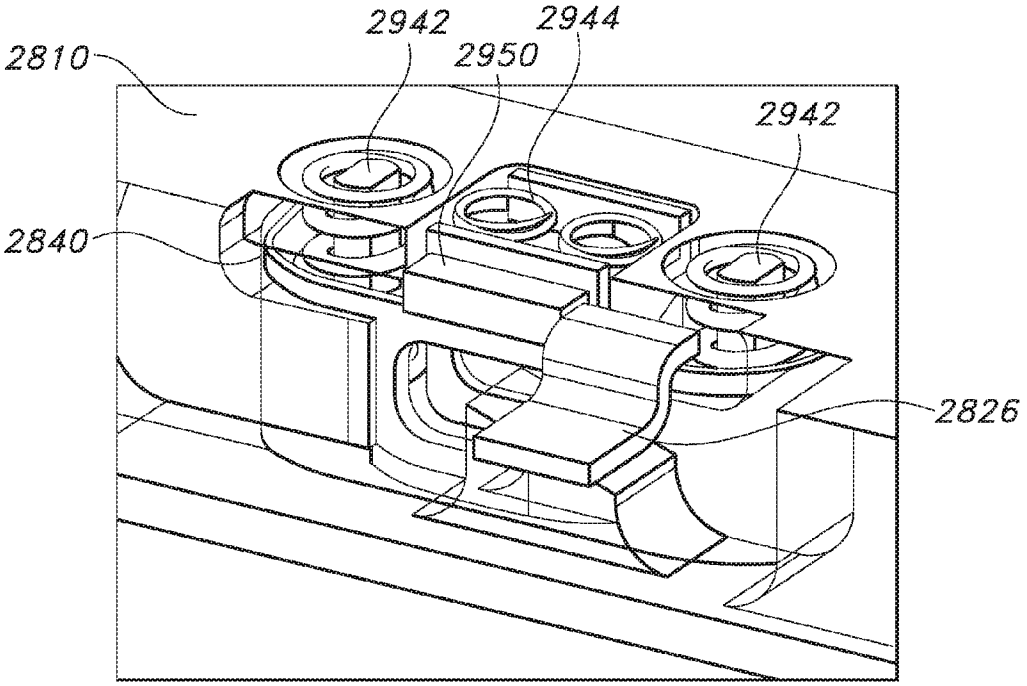
FIGS. 29-32 illustrate operation of an interlock mechanism according to an embodiment of the present invention.

FIGS. 29-32 illustrate operation of an interlock mechanism according to an embodiment of the present invention. FIG. 29 shows a simplified cutaway view including tongue 2826 and interlocker 2840. Interlocker 2840 may be moved vertically by pressing on interlock button 2842 (not shown in FIG. 29), which may attach to legs 2942. Springs 2944 may provide a force that biases interlock button 2842 into its "up" position.

FIG. 29 shows a configuration where sled 2814 is in the retracted position and interlock button 2842 is in its "up" position. Interlocker 2840 may include a projection 2950 that prevents tongue 2826 from moving to the left. In some embodiments, this may prevent a user from pressing exposed end 2821 of slider bar 2820 inward, which may prevent forward movement of sled 2814.

Figure 30:
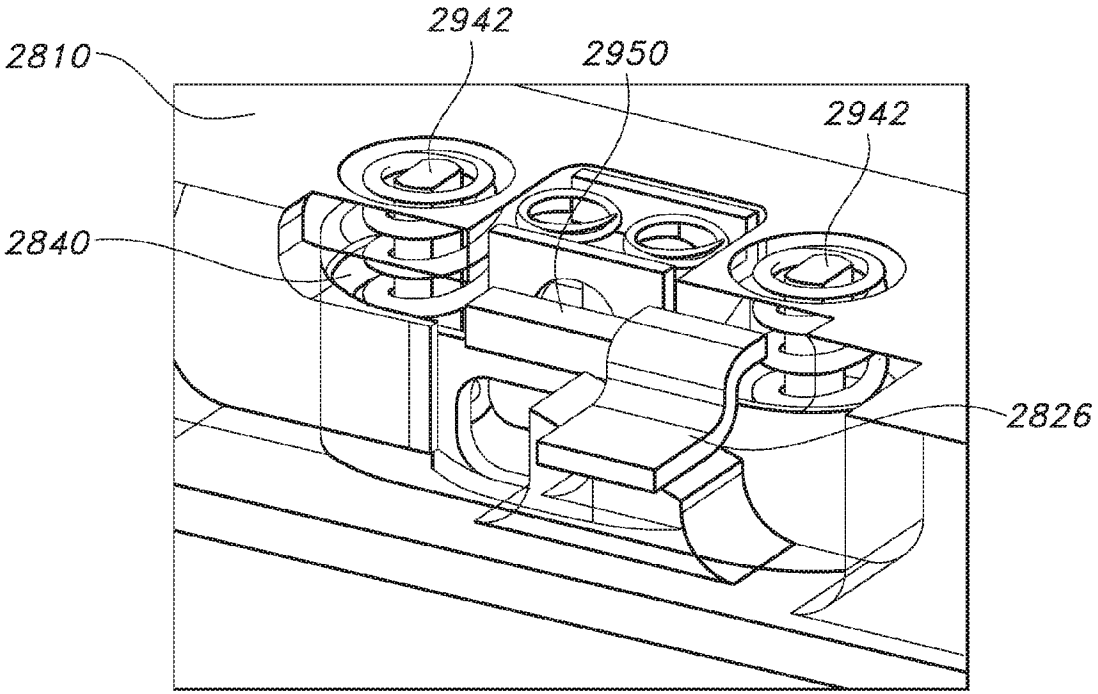

FIG. 30 shows an effect of pressing interlock button 2842 (or legs 2942) into its "down" position. Interlocker 2840, including projection 2950, is displaced downward within housing 2810, and tongue 2826 is now able to move to the left. Thus, while interlock button 2842 is depressed, a user may press exposed end 2821 of sled 2814 inward, thereby moving sled 2814 forward into its engaged position.

Figure 31:
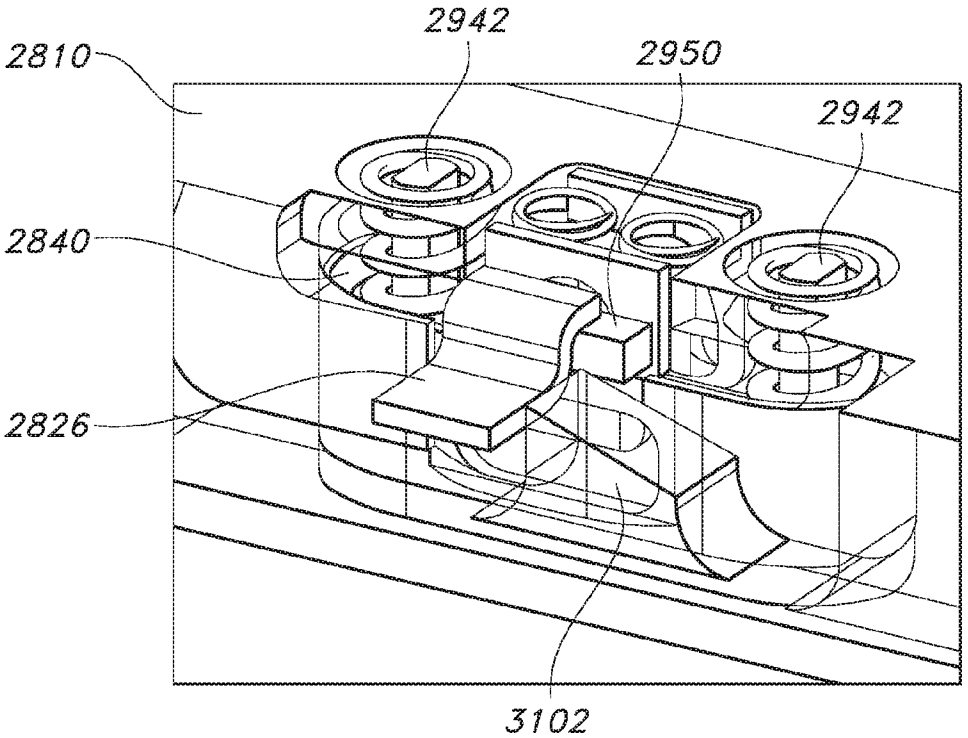

FIG. 31 shows a configuration with sled 2814 in the engaged position. Tongue 2826 extends over the top of projection 2950. In some embodiments, the end of tongue 2826 may be biased downward, and movement to the right of tongue 2826 may be blocked by locking tooth 3102. This may provide a two-way interlock. First, the blocking of rightward movement of tongue 2826 may serve to hold sled 2814 in its engaged position. Second, the downward pressure of tongue 2826 on interlocker 2840 may push the bottom end of interlocker 2840 outward through an opening in housing 2810. The bottom end of interlocker 2840 may interlock with a recess in a complementary connector assembly, thereby preventing lateral sliding of connector assembly 2802.

Figure 32:
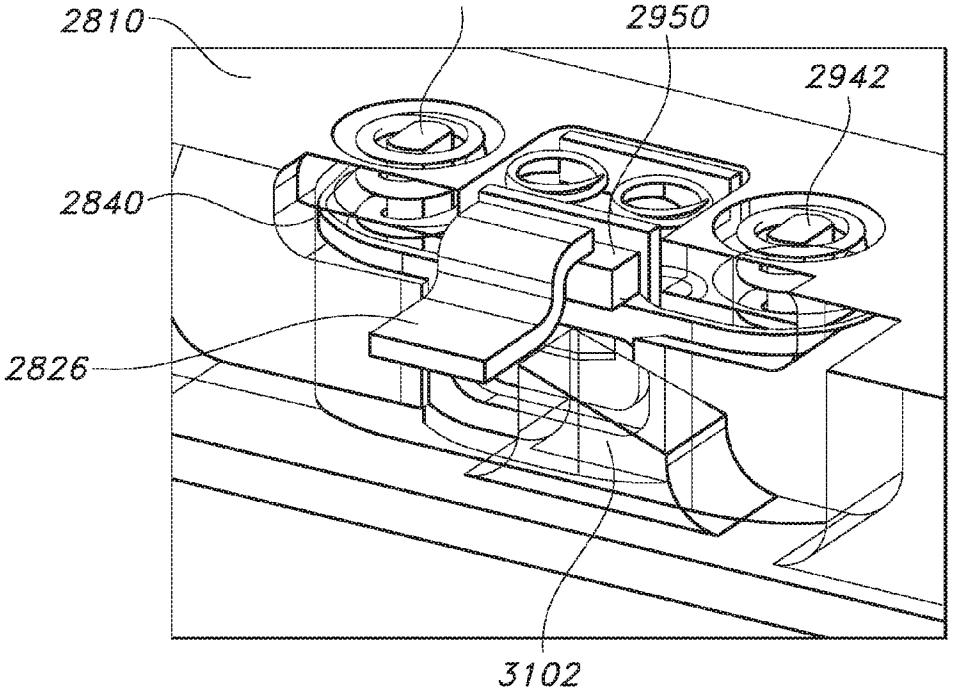

To release the interlocked connectors, a user may be able to press upward on the bottom end of interlocker 2840, either directly or using a button fitted into the device that includes the complementary connector assembly. FIG. 32 shows a configuration similar to that of FIG. 31, except that interlocker 2840 is now pressed upward, raising tongue 2826 so that it can slide to the right over the surface of locking tooth 3102. In some embodiments, when in the configuration of FIG. 32, the force of return spring 2823 (shown in FIG. 28) may move slider bar 2820 to the right, thereby moving sled 2814 into the retracted position (shown in FIGS. 28 and 29). Lateral sliding of connector assembly 2802 may then be permitted.

Figure 33:
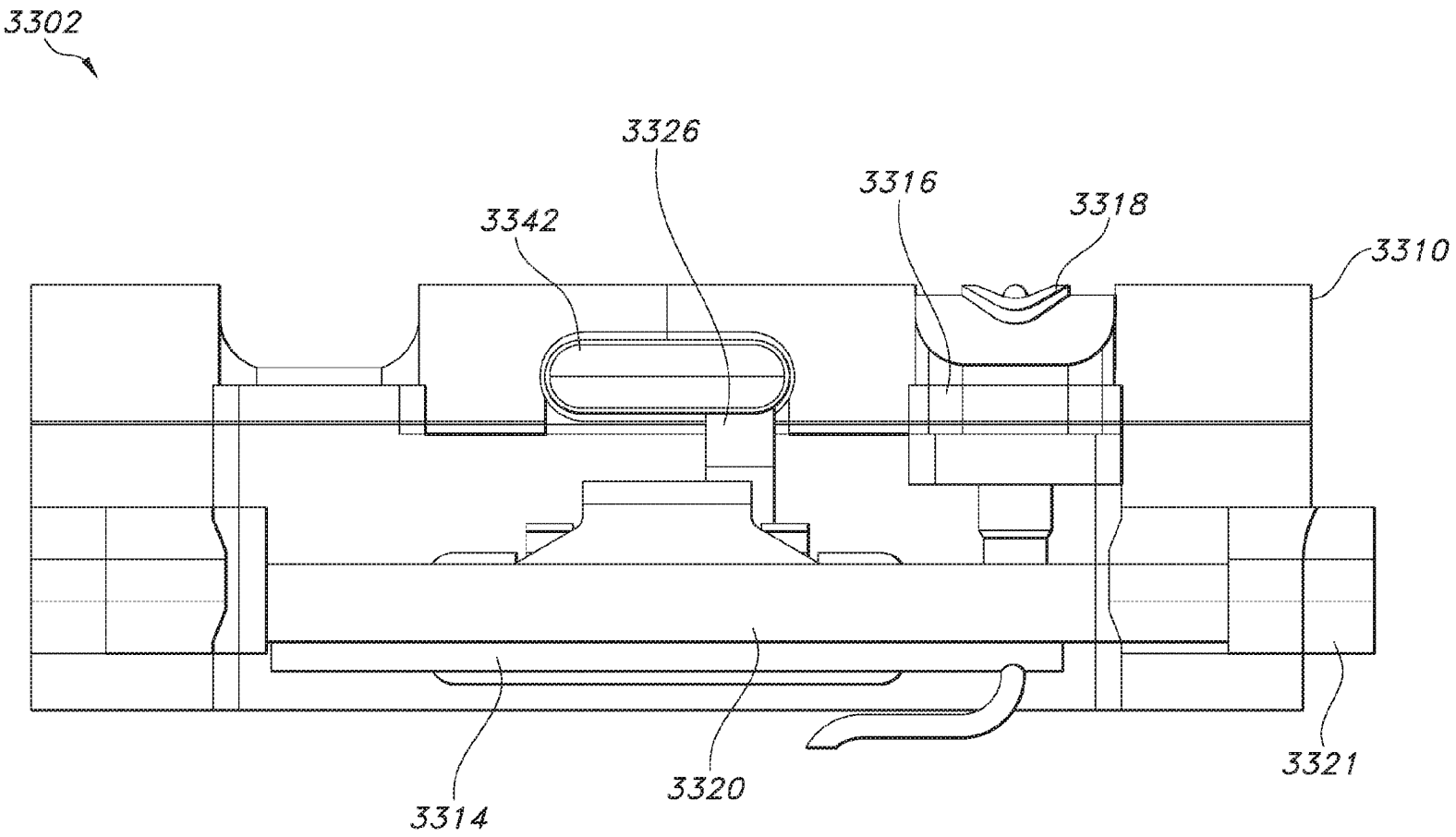
FIG. 33 shows a simplified cutaway views of a connector assembly in a retracted position according to an embodiment of the present invention.
Figure 34:
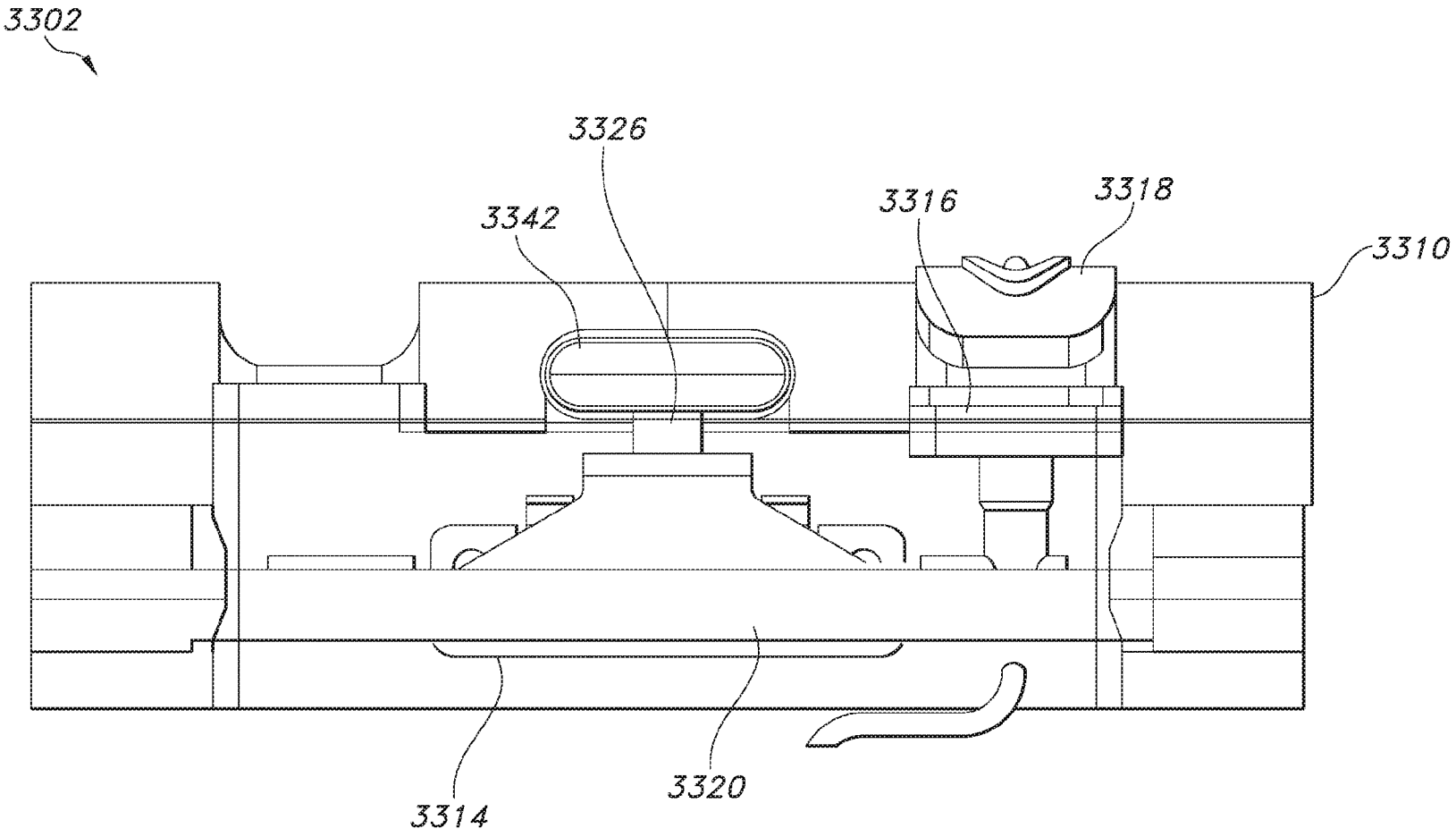
FIG. 34 shows a simplified cutaway views of a connector assembly in an engaged position according to an embodiment of the present invention.

The particular sled and slider configuration may be modified. For example, FIGS. 33 and 34 show simplified cutaway views of another specific implementation of a connector assembly 3302 according to an embodiment of the present invention. FIG. 33 shows connector assembly 3302 in its retracted position, and FIG. 34 shows connector assembly 3302 in its engaged position. Connector assembly 3302 may be generally similar to connector assembly 2402 of FIG. 24, and may be similar to connector assembly 2802 in a number of respects. Connector assembly 3302 may include a housing 3310. A sled 3314 may be movably disposed inside housing 3310, and sled 3314 may carry electrical contacts, such as one or more pogo pin assemblies 3316, which may include cosmetic caps 3318 similar to cosmetic caps described above. A cartridge assembly (e.g., as described above with reference to FIGS. 4-9) may also be used.

A movable slider bar 3320 may be arranged within housing 3310 such that one end 3321 of slider bar 3320 extends outside of housing 3310. A return spring (not shown) may be disposed within housing 3310 at the end opposite exposed end 3321. When end 3321 is pressed inward, the lateral movement of slider bar 3320 may result in forward movement of sled 3314 and of pogo pin assemblies 3316. Slider bar 3320 may be connected to a tongue 3326 that may extend forward and engage with an interlocker that can be moved by pressing or releasing an interlock button 3342. An example interlock mechanism is described below.

Figure 35:
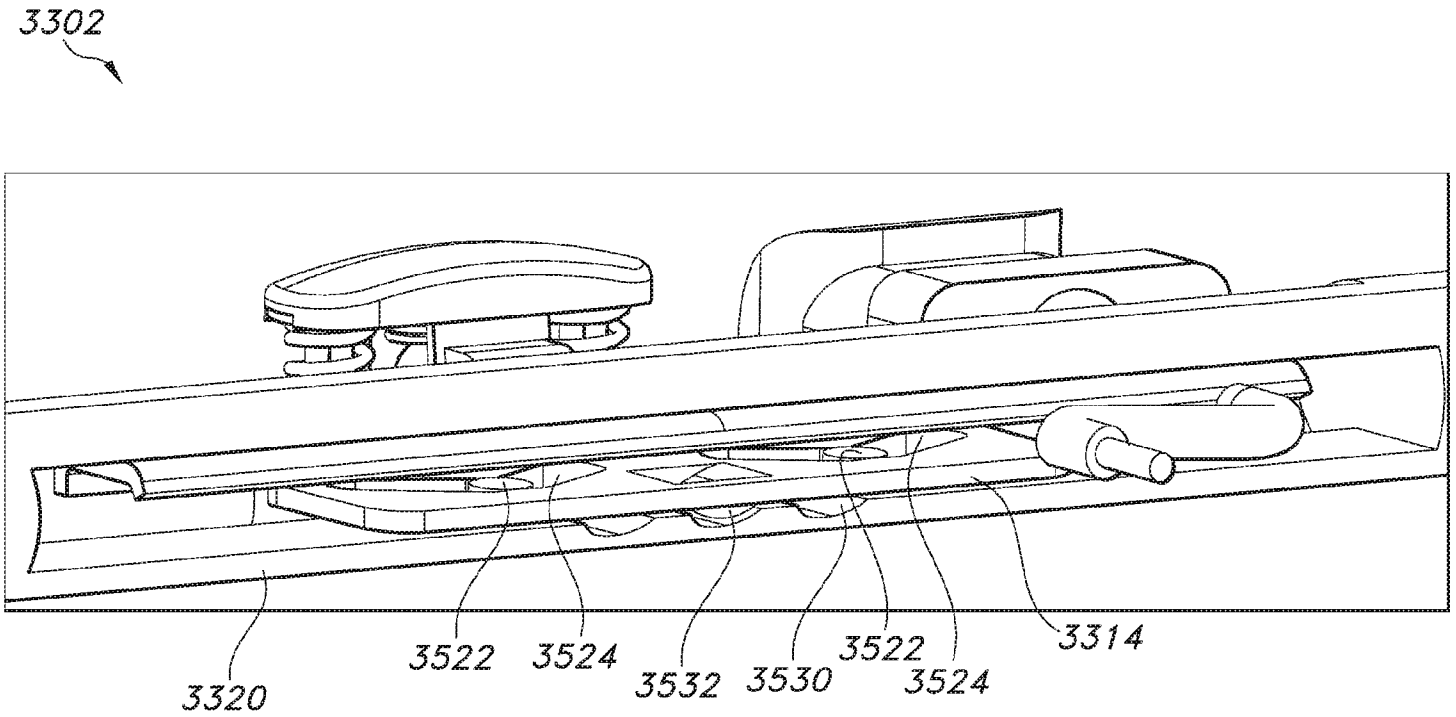
FIG. 35 shows another simplified cutaway view of the connector assembly of FIGS. 33 and 34.

FIG. 35 is a simplified cutaway view showing additional details of connector assembly 3302. Slider bar 3320 may include projections 3522 that fit within V-shaped channels 3524 of sled 3314. Slider bar 3320 may also include detent dimples 3530 that correspond to a detent projection 3532 of sled 3314. In some embodiments, three detent dimples 3530 may be used to provide a tri-stable action for sled 3314.

Figure 36:
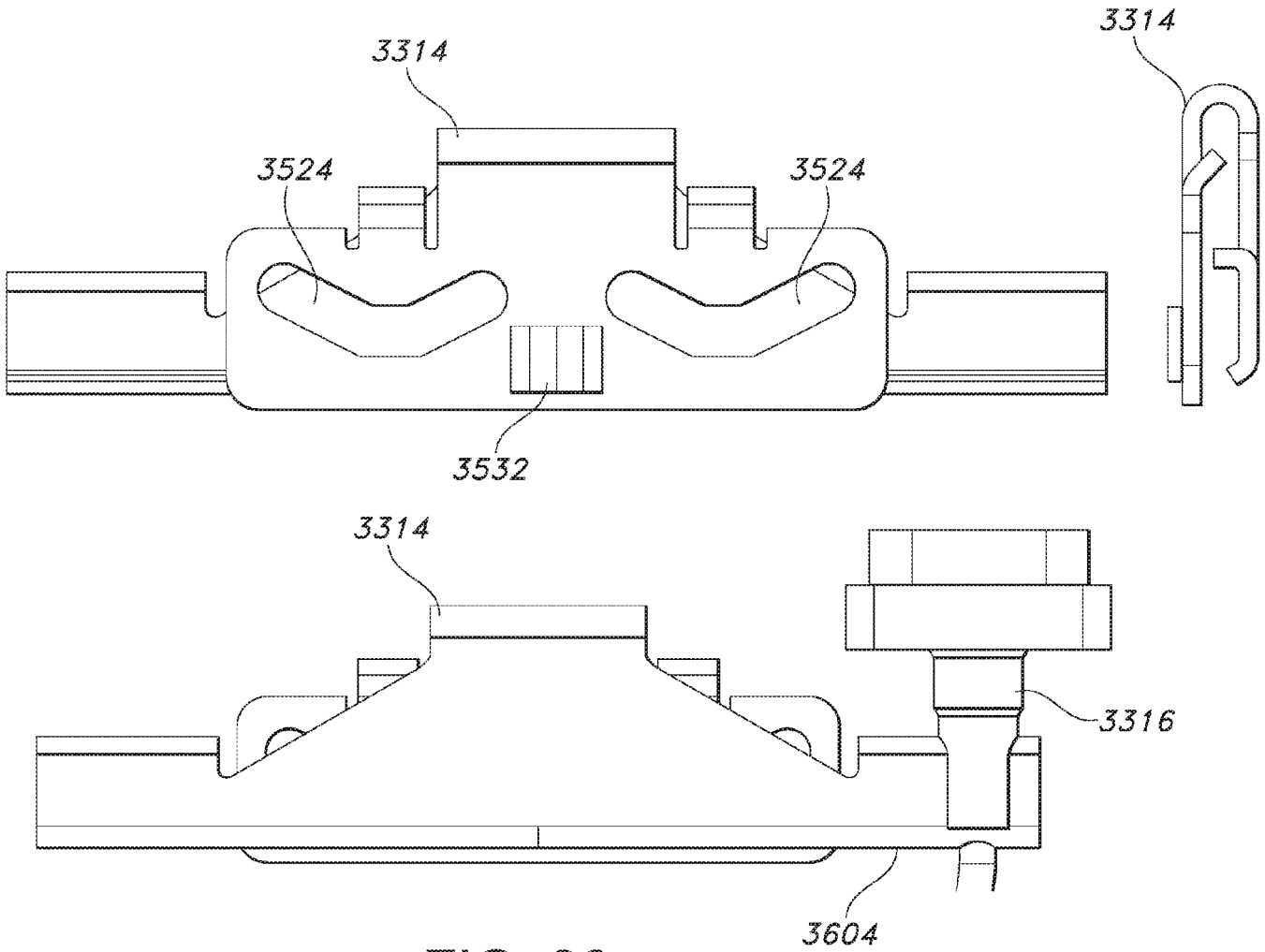
FIGS. 36 and 37 show additional views of a sled for a connector assembly according to an embodiment of the present invention.
Figure 37:
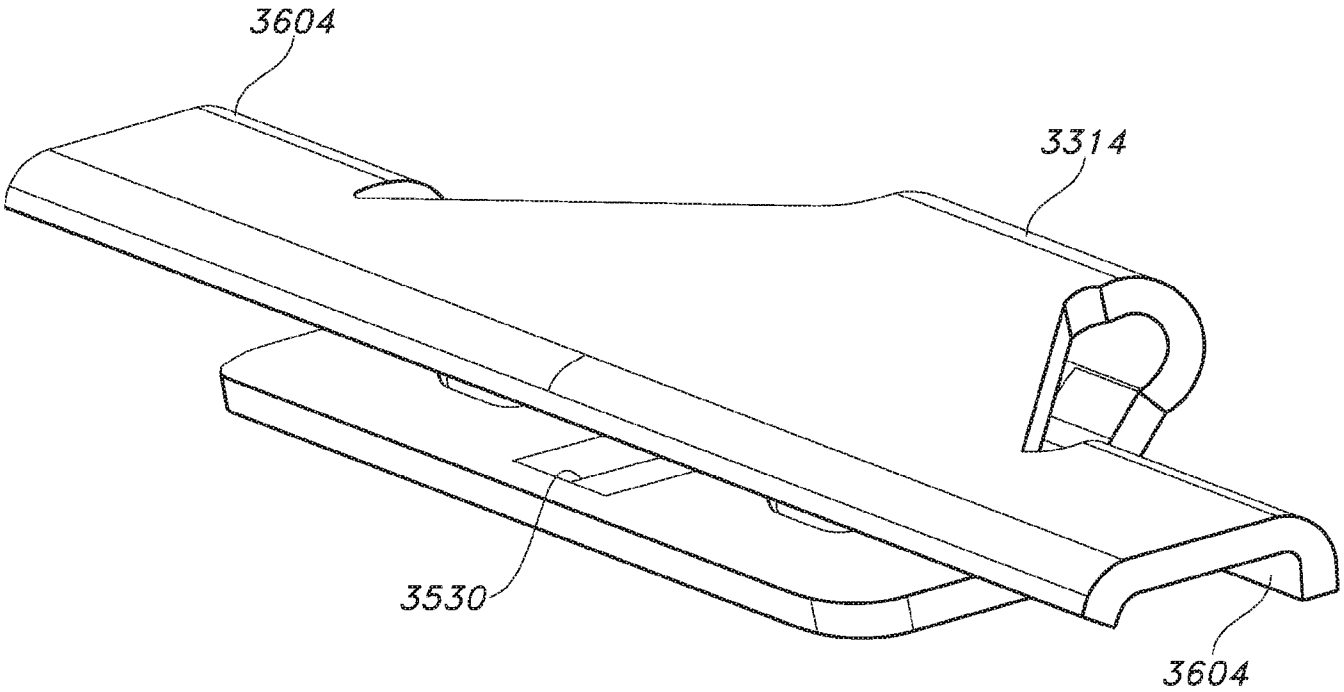

FIGS. 36 and 37 show additional views of sled 3314, showing channels 3524, detent projection 3532, and connection of pogo pin assembly 3316. In some embodiments, sled 3314 may include flexible arm sections 3604 to provide strain relief for pogo pin assembly 3316. In some embodiments, arm sections 3604 may be rigid, and coupling springs may be used.

Figure 38:
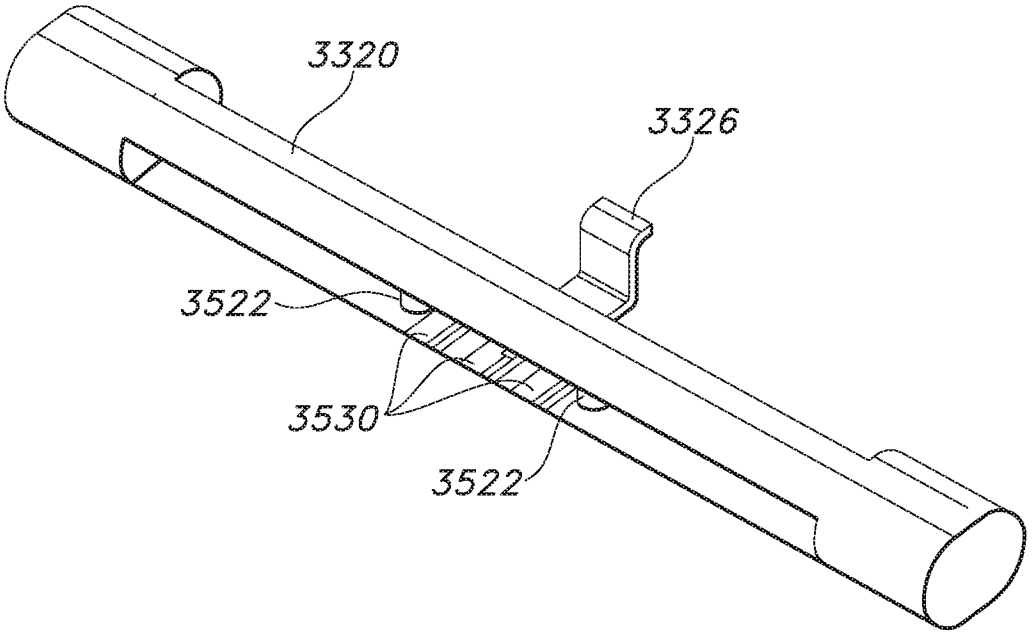
FIG. 38 shows an additional view of a slider bar for a connector assembly according to an embodiment of the present invention.

FIG. 38 shows an additional view of slider bar 3320, including tongue 3326, projections 3522, and detent dimples 3530.

Figure 39:
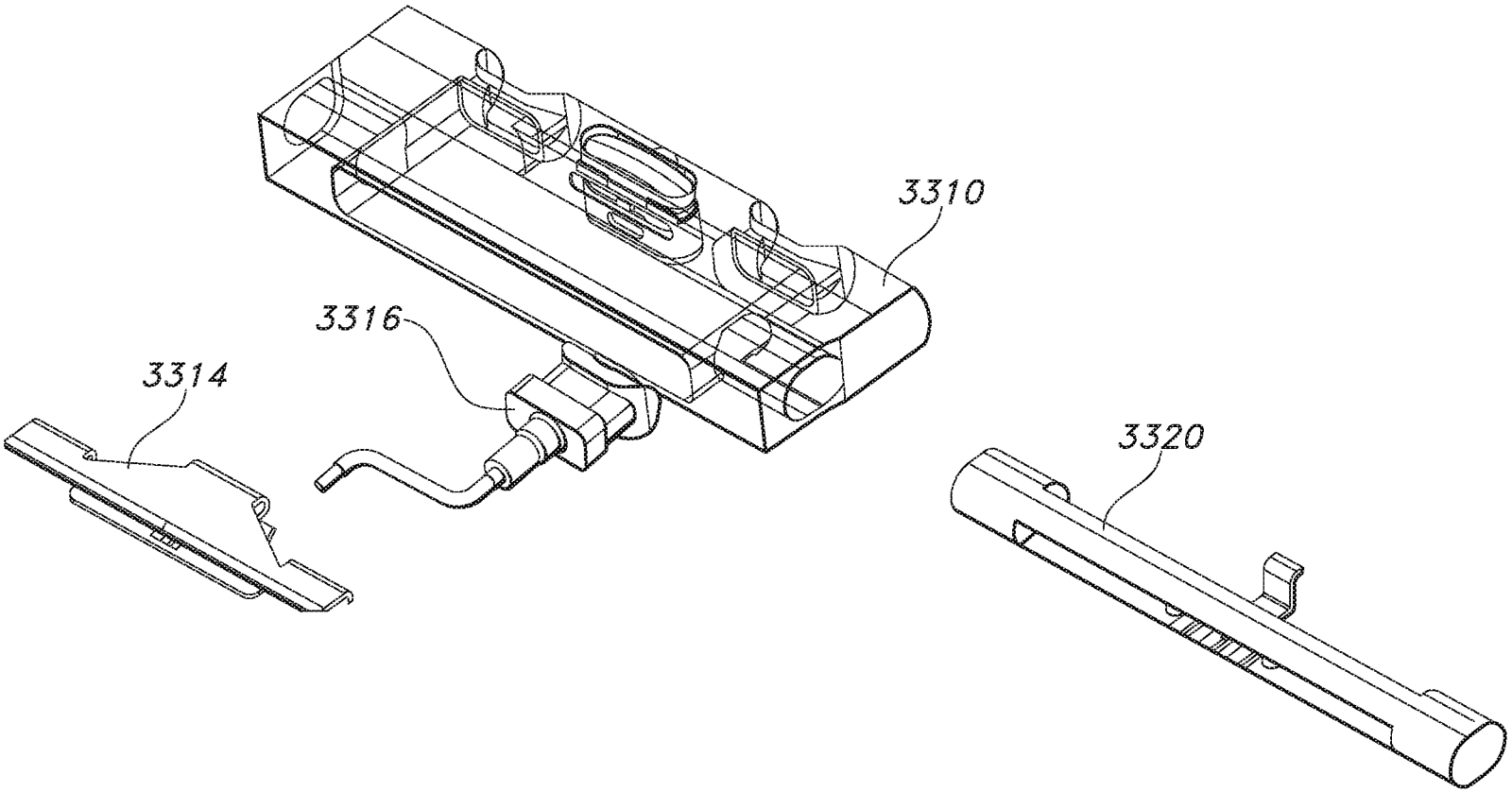
FIG. 39 shows an assembly process that may be used to assemble a connector assembly according to an embodiment of the present invention.

FIG. 39 shows an assembly process that may be used to assemble connector assembly 3302. First, pogo pin subassembly 3316 may be inserted into housing 3310 from the rear. Next, slider bar 3320 may be inserted through an opening in the side of housing 3310. Thereafter, sled 3314 may be inserted through slider bar 3320.

Figure 40:
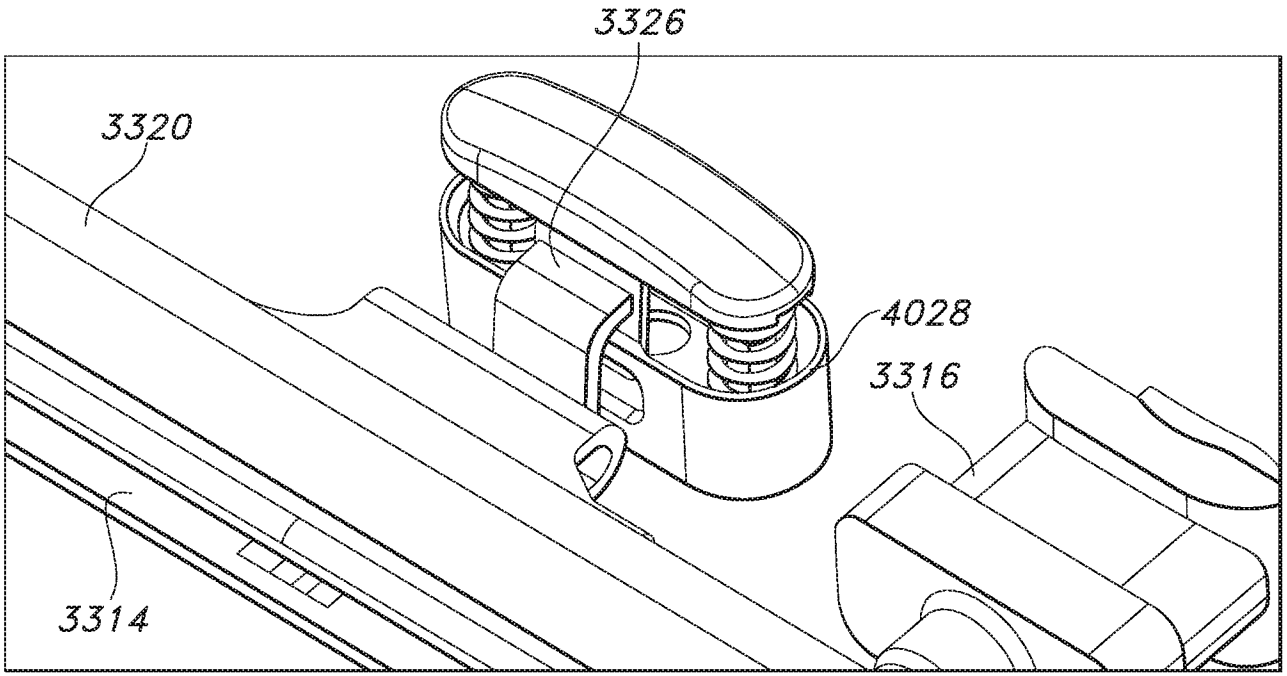
FIGS. 40 and 41 show additional details of an interlock mechanism that may be included in a connector assembly according to an embodiment of the present invention.
Figure 41:
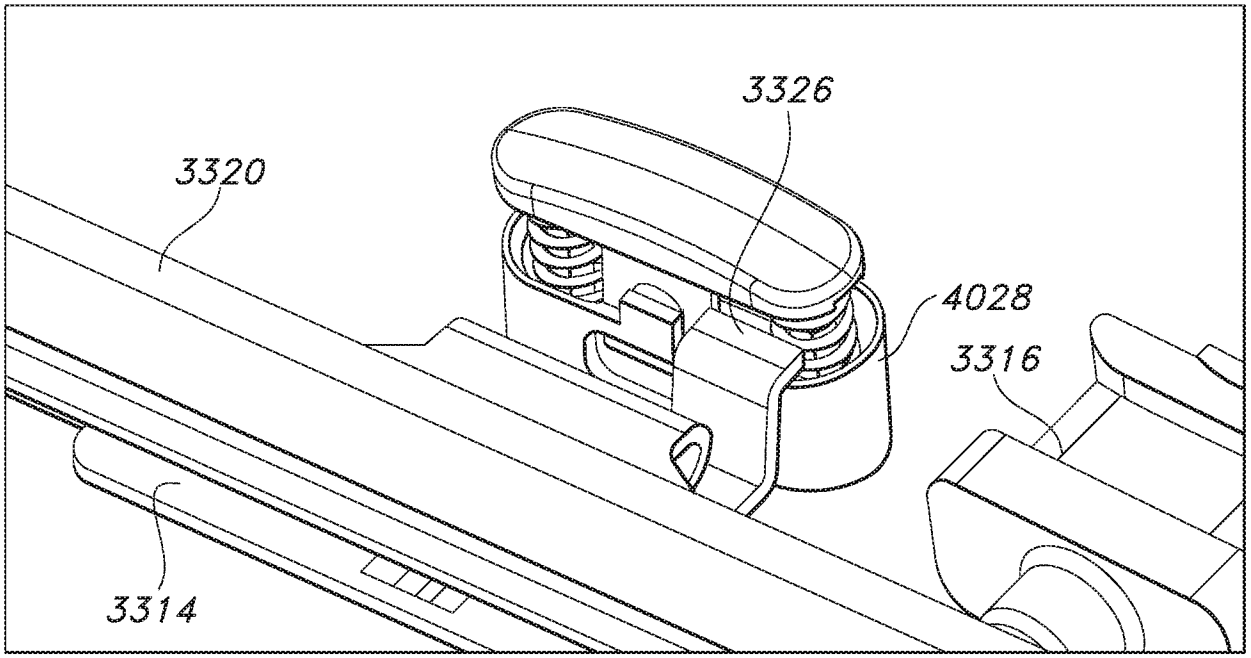

FIGS. 40 and 41 show additional details of an interlock mechanism that may be included in connector assembly 3302. FIG. 40 shows an engaged position, in which tongue 3326 of slider bar 3320 may press downward on an interlocker 4028. FIG. 41 shows a retracted position, in which tongue 3326 is blocked from movement to the left by projection 4030 on interlocker 4028. The interlock mechanism and its operation may be generally similar to that described above with reference to FIGS. 29-32.

In still other embodiments of the present invention, a connector assembly may include a rotational mechanism to move a sled carrying electrical contacts between an engaged position and a retracted position. The rotational mechanism may include, for example, a screw that may be operated using a screwdriver or other tool.

Figure 42:
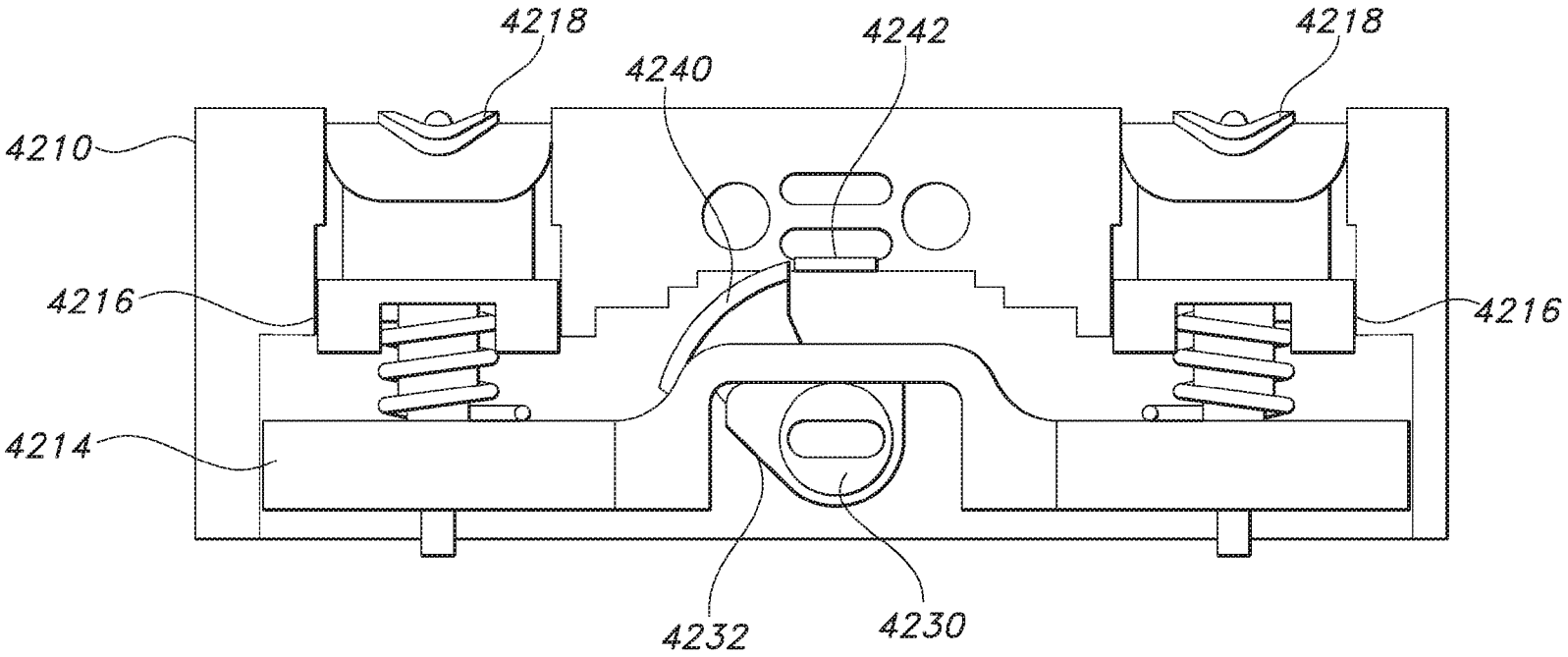
FIG. 42 shows a simplified cutaway view of a connector assembly in a retracted position according to an embodiment of the present invention.
Figure 43:
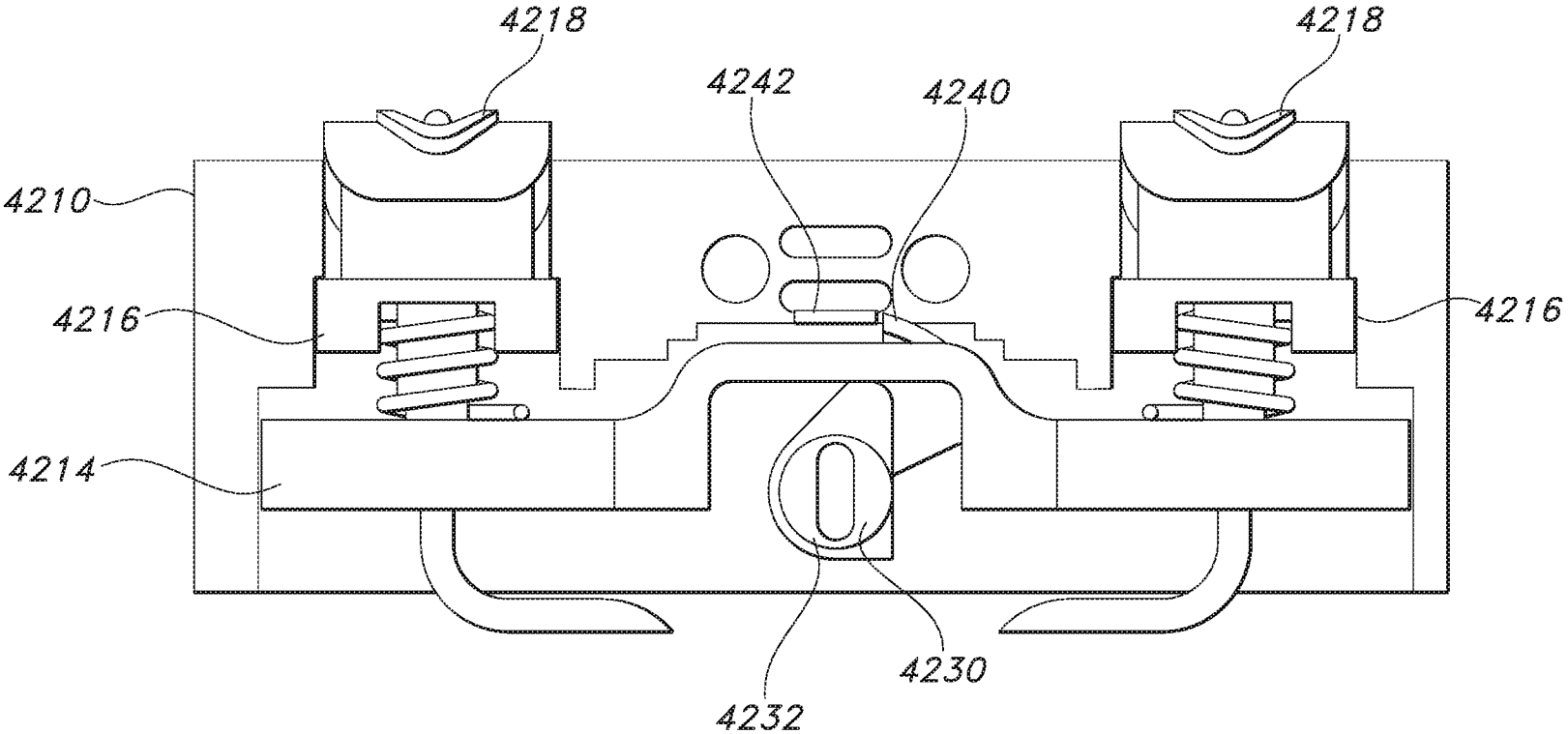
FIG. 43 shows a simplified cutaway view of a connector assembly in an engaged position according to an embodiment of the present invention.

FIGS. 42 and 43 show simplified cutaway views of a connector assembly 4202 according to an embodiment of the present invention that includes a rotational mechanism. Connector assembly 4202 may be generally similar to first connector assembly 102 of FIG. 1. Connector assembly 4202 may include a housing 4210 and a movable sled 4214 disposed within housing 4210. Movable sled 4214 may be moved between a retracted position (shown in FIG. 42) and an engaged position (shown in FIG. 43) by rotation of screw 4230, which rotates triangular plate 4232. In this example, a rotation through 90 degrees suffices to move sled 4214 between the retracted and engaged positions. The head of screw 4230 may be exposed outside housing 4210, making screw 4230 accessible to a user.

Electrical contacts may be attached to movable sled 4214. For example, the electrical contacts may be implemented using pogo pin assemblies 4216, which may be similar to the pogo pin assembly described above with reference to FIGS. 10-12. Cosmetic caps 4218, similar to those described above, may be provided on front surfaces of pogo pin assemblies 4216. In the retracted position, cosmetic caps 4218 may be flush with or retracted within the front surface of housing 4210, and in the extended position, cosmetic caps 4218 may extend slightly beyond the front surface of housing 4210. A cartridge assembly (e.g., as described above with reference to FIGS. 4-9) may also be used.

As with other embodiments of the invention, it may be desirable to prevent lateral movement of connector assembly 4202 while sled 4214 is in its engaged position, and it may also be desirable to lock sled 4214 into the engaged position when connector assembly 4202 is connected to a complementary connector assembly. Accordingly, in some embodiments, an interlock mechanism may include an interlock plate 4240. Interlock plate 4240 may be attached to (or formed integrally with) triangular plate 4232, so that interlock plate 4240 rotates together with triangular plate 4232 when screw 4230 is turned. An interlocker 4242 may be movable into and out of the path of interlock plate 4240 to restrict or allow rotation of triangular plate 4232 and thereby to restrict or allow movement of sled 4214.

Figure 44:
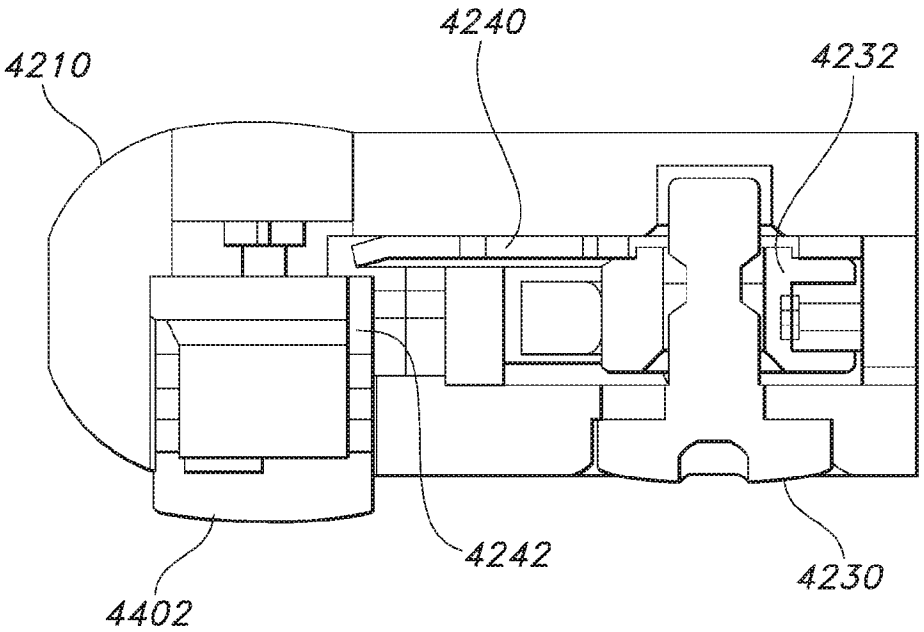
FIG. 44 is a cross section view showing additional details of the interlock mechanism.

FIG. 44 is a cross section view showing additional details of the interlock mechanism. As shown, interlocker 4242 may be connected to an interlock button 4402 that extends through housing 4210. Interlock button 4402 may be biased into a raised position (e.g., using a spring, not shown) that moves interlocker 4242 out of the path of interlock plate 4240. When interlocker 4242 is out of the path of interlock plate 4240, as shown, it is possible to rotate screw 4230, thereby moving sled 4214 between the retracted and engaged positions. Accordingly, interlock plate 4240 may be rotated out of the path of interlocker 4242 (e.g., into the retracted position). Once interlock plate 4240 is out of the path of interlocker 4242, it may become possible to press interlock button 4402 into a position flush with the surface of housing 4210, thereby allowing lateral sliding of housing 4210 against a housing of a complementary connector assembly.

Figure 45:
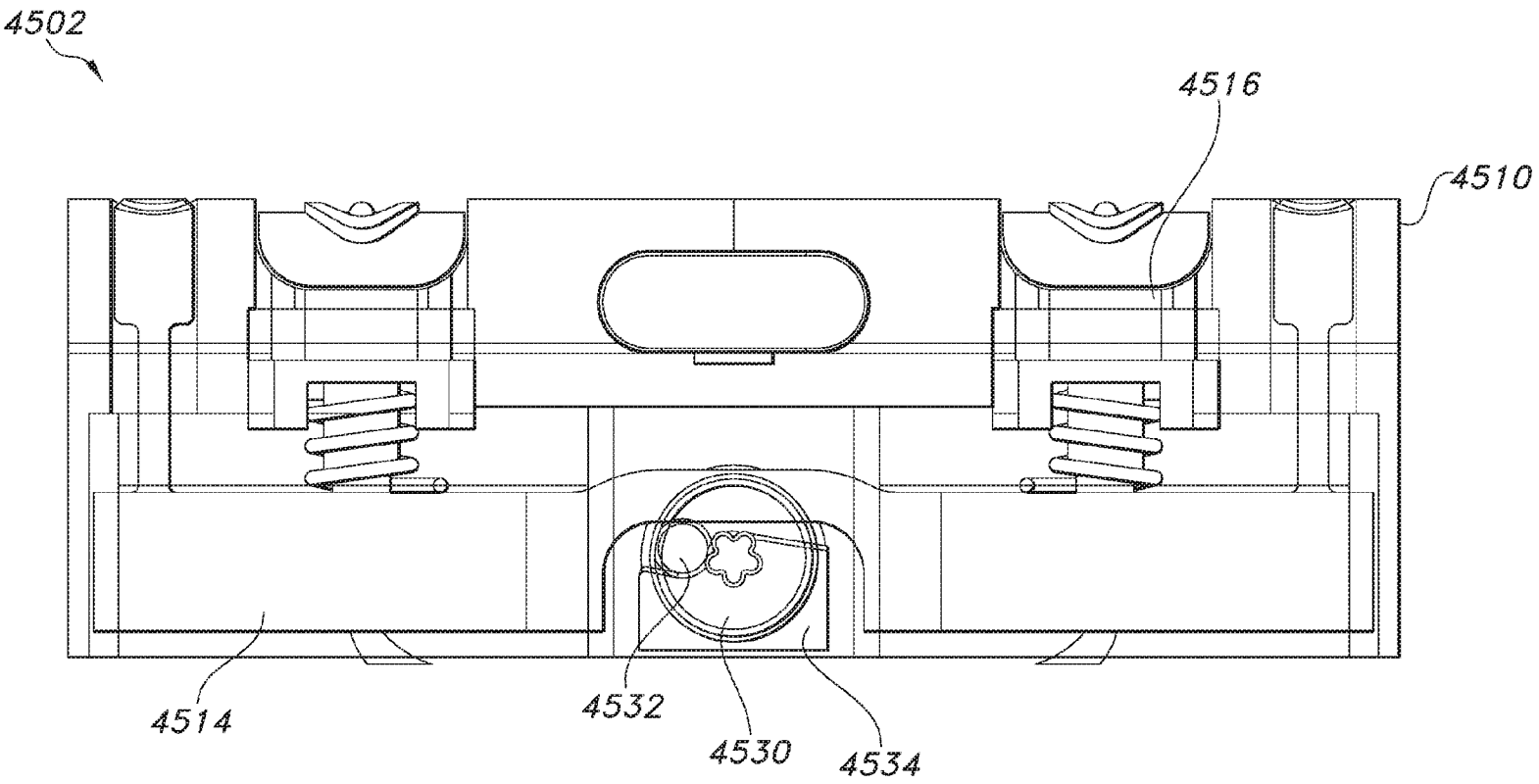
FIG. 45 shows a simplified cutaway view of a connector assembly according to an embodiment of the present invention
Figure 46:
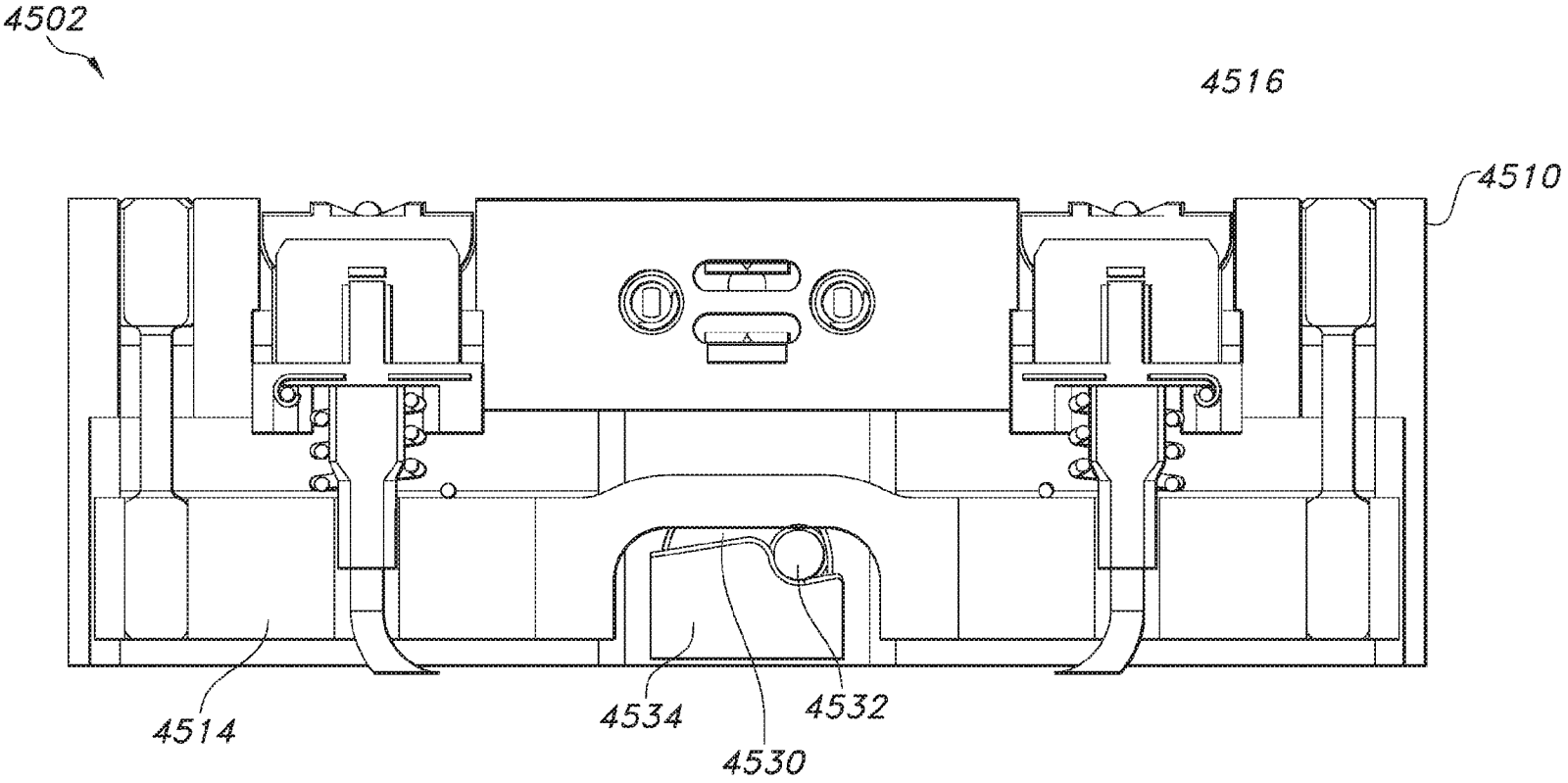
FIG. 46 shows a simplified cross section view of the connector assembly of FIG. 45.

In some embodiments of the present invention, other rotational mechanisms may be substituted for screw 4230 and triangular plate 4232. FIG. 45 shows a simplified cutaway view of a connector assembly 4502 according to an embodiment of the present invention, and FIG. 46 shows a simplified cross section view of connector assembly 4502. (The views in FIGS. 45 and 46 are from opposite sides.) Connector assembly 4502 may be generally similar to first connector assembly 4202 of FIG. 42. Connector assembly 4502 may include a housing 4510 and a movable sled 4514 disposed within housing 4510. As with other embodiments described above, electrical contacts, e.g., pogo pin assemblies 4516, may be mounted on movable sled 4514. Movable sled 4514 may be moved between a retracted position (shown in FIGS. 45 and 46) and an engaged position (not shown) by rotation of screw 4530, which rotates a projecting pin 4532. The arc of travel of projecting pin 4532 may be limited by a plate 4534, which may be fixed to or formed integrally with housing 4510. The forward edge of plate 4534 may be shaped such that projecting pin 4532 may rotate to a lower position on one side (the left side in FIG. 45) than on the other side; the total arc of travel may be more than 90 degrees but less than 180 degrees Accordingly, when screw 4530 is rotated such that projecting pin 4532 is at the left end of its arc of travel, sled 4514 is in its retracted position, and when screw 4530 is rotated such that projecting pin 4532 is at the right end of its arc of travel, sled 4514 is in its engaged position. Although not explicitly shown, an interlock mechanism similar to the mechanisms described above may be provided to prevent unwanted movement of sled 4512.

Figure 47B:
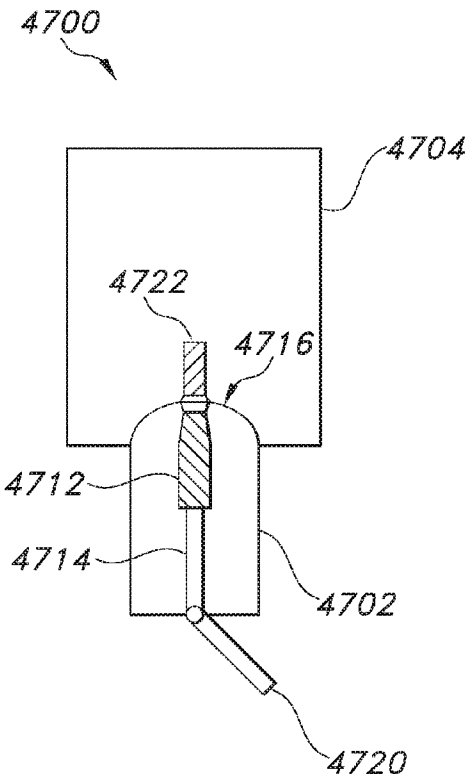
FIGS. 47A and 47B show simplified side cross-section views of a connector interface system incorporating a connector assembly according to an embodiment of the present invention.
Figure 47A:
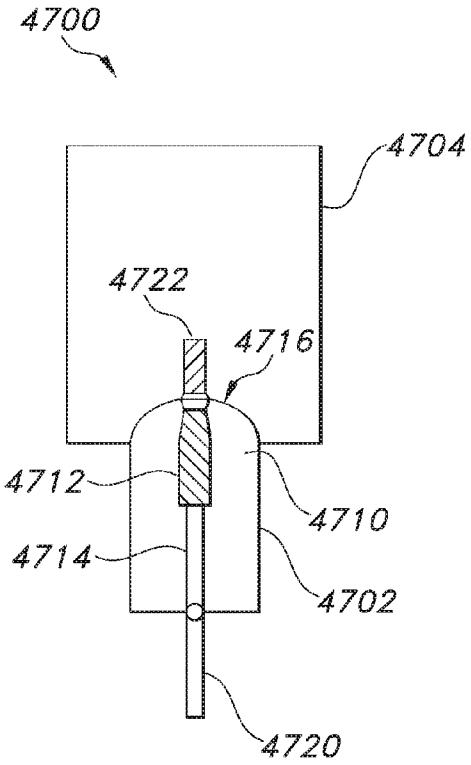

In still other embodiments of the present invention, a lever mechanism may be used to move a sled carrying electrical contacts between retracted and engaged positions. FIGS. 47A and 47B show simplified side cross-section views of a connector interface system 4700 incorporating a connector assembly according to an embodiment of the present invention. Connector interface system 4700 may be generally similar to connector interface system 100 of FIG. 1 and may include a first connector assembly 4702 (generally similar to connector assembly 102) and a second connector assembly 4704 (generally similar to connector assembly 104). First connector assembly 4702 may include a housing 4710 and one or more electrical contacts 4712 mounted on a sled (or shuttle) 4714 that may be disposed within housing 4710. Sled 4714 may be movable in a direction perpendicular to front surface 4716 of connector assembly 4702. FIG. 47A shows sled 4714 in a retracted position, in which electrical contacts 4712 do not extend outside of housing 4710. In some embodiments, electrical contacts 4712 may be flush with surface 4716, and in other embodiments, electrical contacts 4712 may be retracted farther such that they do not extend all the way to surface 4716. When sled 4714 is in the retracted position, connector assembly 4702 may slide laterally relative to connector assembly 4704 without risk of damage to electrical contacts 4712. FIG. 47B shows sled 4714 in an engaged position. In this position, electrical contacts 4712 extend through housing 4710 and make contact with corresponding electrical contacts 4722 of second connector assembly 4704.

Figure 47C:
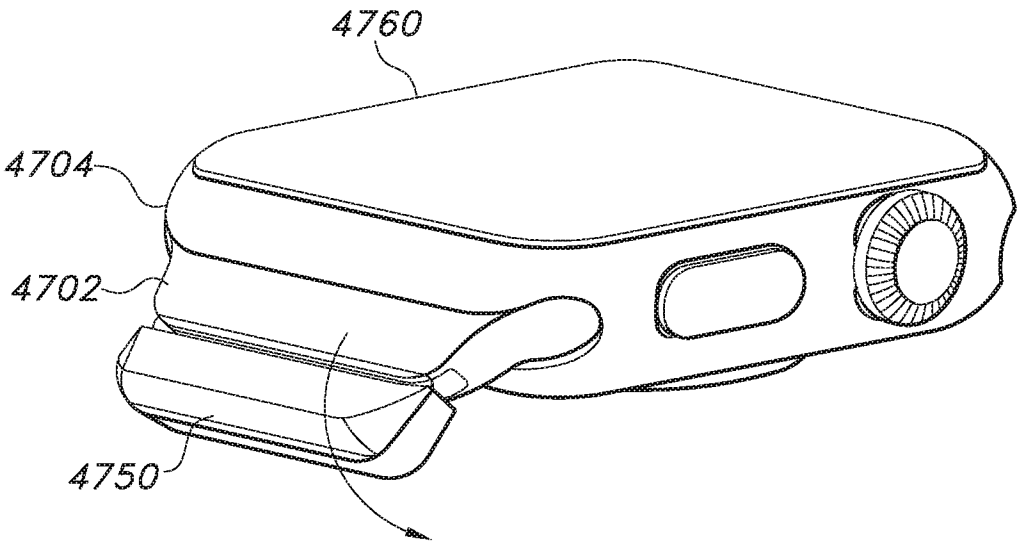
FIG. 47C shows an example application of connector interface system for connecting a watch band to a watch body unit according to an embodiment of the present invention.

In the embodiment shown in FIGS. 47A-47B, a lever mechanism 4720 may be operated to move sled 4714 between its retracted and engaged positions. Lever mechanism 4720 may operate in a direction transverse to the plane in which connector assembly 4702 slides laterally relative to connector assembly 4704. As shown in FIG. 47C, in some embodiments where first connector assembly 4702 is implemented as a lug that connects a watch band 4750 to a watch body unit 4760, lever 4720 may be operated by deflecting watch band 4750 inward.

Figure 48:
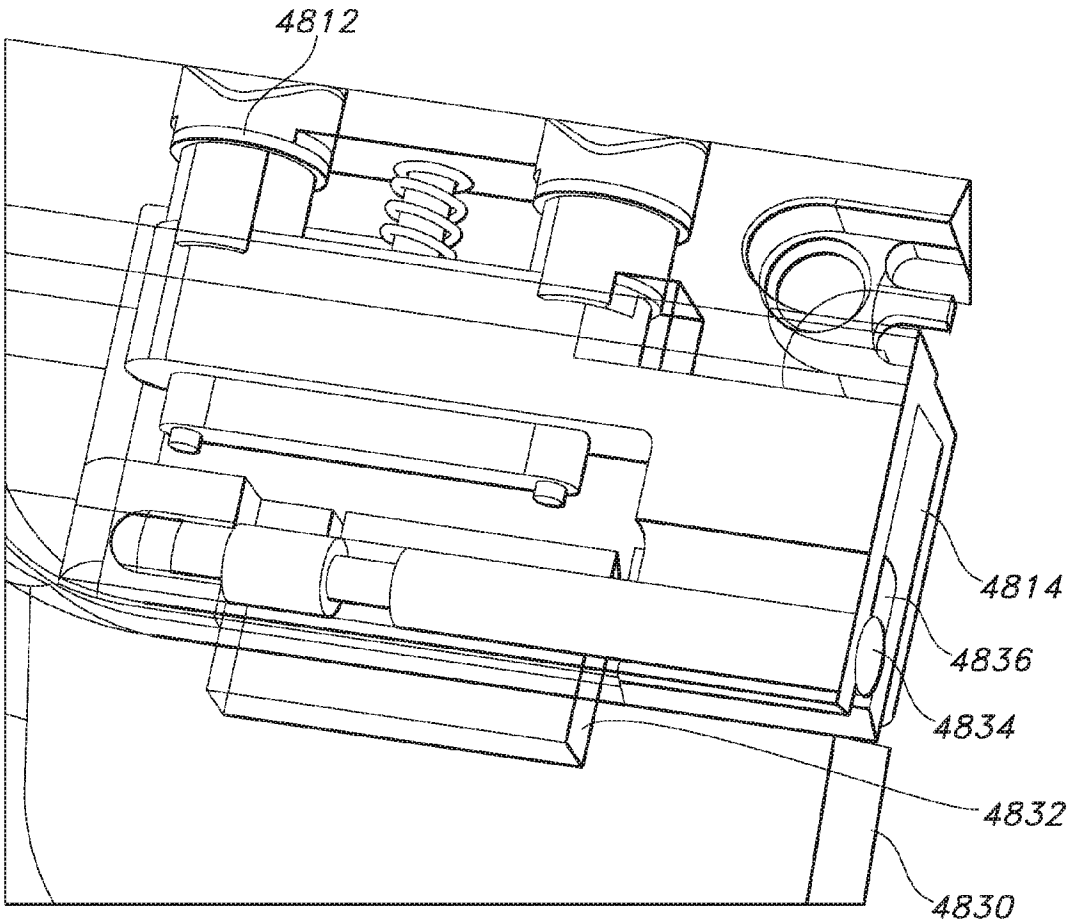
FIG. 48 shows a simplified cutaway view of a connector assembly according to an embodiment of the present invention.

FIG. 48 shows a simplified cutaway view of a specific implementation of a connector assembly 4802 according to an embodiment of the present invention. Connector assembly 4802 may be generally similar to connector assembly 4700. Electrical contacts may be implemented using pogo pin assemblies 4812, which may be generally similar to pogo pin assemblies described above with reference to FIGS. 10-12. In some embodiments, a cartridge assembly (e.g., as described above with reference to FIGS. 4-9) may be used. Pogo pin assemblies 4812 may be mounted on a sled 4814 that is movable between retracted and engaged positions. (The engaged position is shown.) Deflection of lever section 4830 may operate lever 4832 to rotate pin 4834. Pin 4834 may have teeth (not shown) that interlock with teeth in a recess region 4836 of sled 4814, so that rotation of pin 4834 may move sled 4814 between the engaged and retracted positions. Other retraction mechanisms may be substituted. Interlock mechanisms similar to those described above may be used to prevent unwanted movement of sled 4814.

In various embodiments described above, it is assumed that coupling of connector assemblies may be a two-step process. In a first step, complementary connector assemblies may slide laterally relative to each other into an aligned position while electrical contacts of a first one of the connector assemblies are held in a retracted position (in which the contacts are protected by the housing of the first connector assembly). In a second step, once the connector assemblies are aligned, the electrical contacts of the first connector may be moved from the retracted position to an engaged position, in which the electrical contacts may extend through the housing of the first connector assembly to make contact with corresponding electrical contacts of the second connector assembly. In the examples described above, the electrical contacts of the second connector assembly need not be movable, and this may decrease the overall cost of the connector interface system, as one of the assemblies need not have moving parts. However, in other embodiments, contacts of both connector assemblies may be movable.

Figure 49:
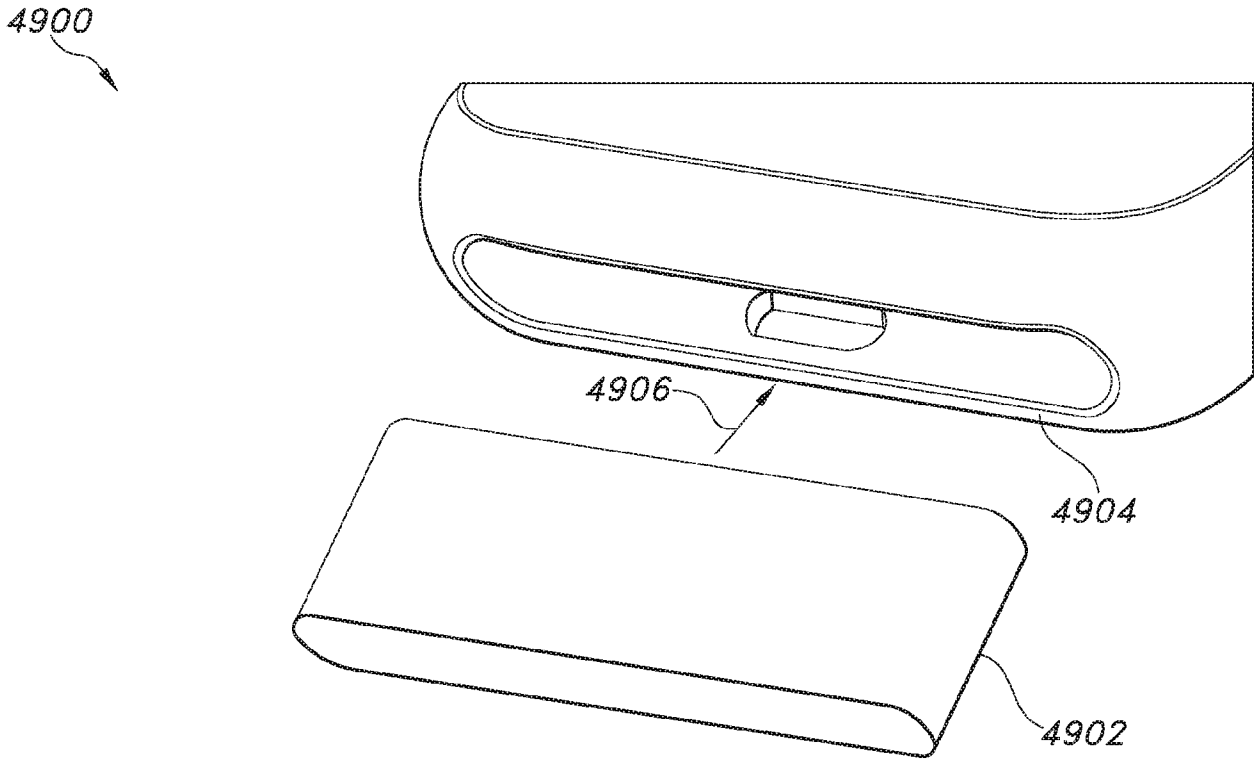
FIG. 49 shows an example of a connector interface system using a plug-type connection according to an embodiment of the present invention.

In still other embodiments of the present invention, a connector interface system may provide a plug-type connection, in which a first connector assembly is inserted into a second connector assembly. FIG. 49 shows an example of a connector interface system 4900 using a plug-type connection according to an embodiment of the present invention. A first connector assembly 4902 may be a connector insert, and a second connector assembly 4904 may be a connector receptacle. Connector assembly 4902 may be inserted into connector assembly 4904 along the direction indicated by arrow 4906. In some embodiments, connector assembly 4904 may be formed in a watch body unit, and connector assembly 4902 may be formed as a lug that connects a watch band to the watch body unit.

Where a plug-type connection is used instead of a lateral sliding connection, mechanical design of the connector assembly may be simplified, as the potential for damage to electrical contacts during lateral sliding is reduced or eliminated. For example, the electrical contacts of first connector assembly 4902 may be fixedly disposed in the engaged position, extending slightly forward from the front end of the connector housing.

Figure 50:
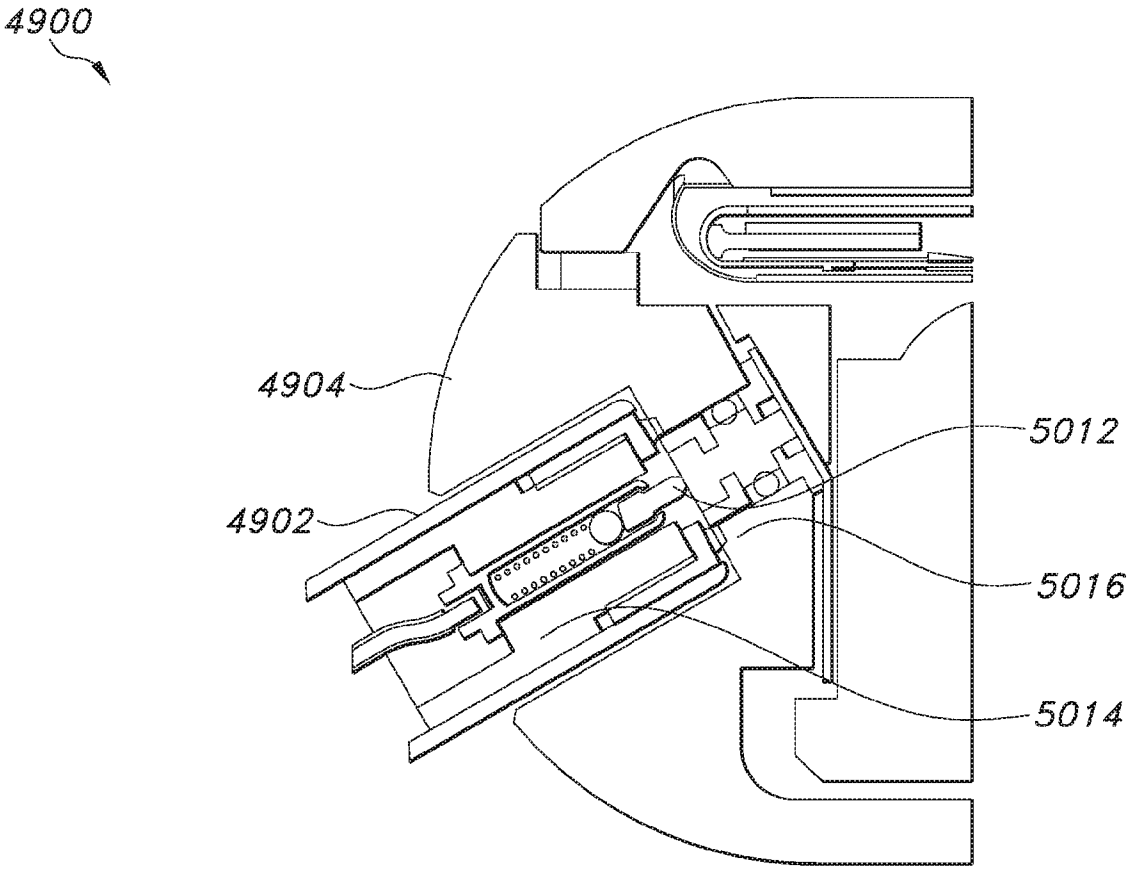
FIG. 50 shows a side cross-section view of a connector interface system according to an embodiment of the present invention.

FIG. 50 shows a side cross-section view of an implementation of connector interface system 4900 according to an embodiment of the present invention. First connector assembly 4902 is inserted into second connector assembly 4904. As shown, first connector assembly 4902 may incorporate one or more electrical contacts 5012, which may be implemented using pogo pin assemblies 5014. Pogo pin assemblies 5014 may be similar to pogo pin assemblies described above with reference to FIGS. 10-12. In some embodiments, a cartridge assembly (e.g., as described above with reference to FIGS. 4-9) may be used. Cosmetic caps 5016, which may be made of a compressible, elastic, water-resistant material (e.g., rubber) may extend beyond the housing of connector assembly 4902. Cosmetic caps 5016 may provide a water-resistant seal when first connector assembly 4902 is plugged into second connector assembly 4904.

Figure 51:
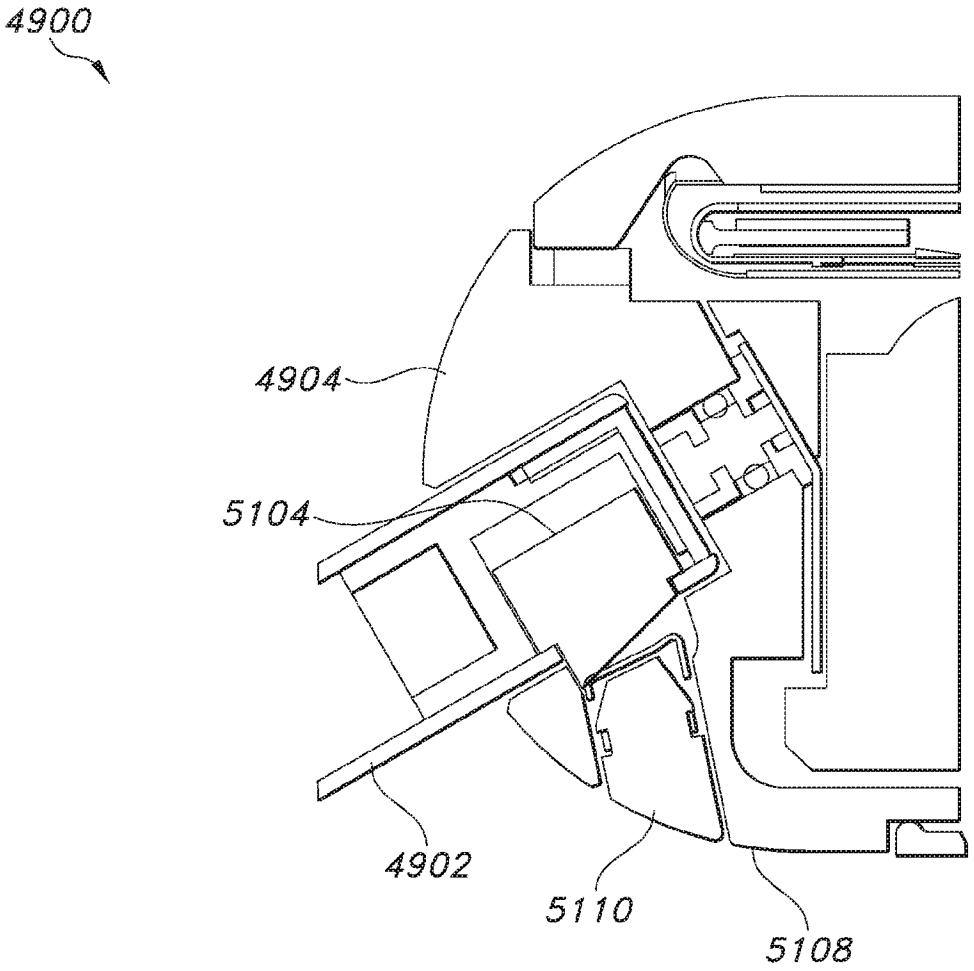
FIG. 51 shows another side cross-section view of a connector interface system according to an embodiment of the present invention.

FIG. 51 shows another side cross-section view of an implementation of connector interface system 4900 according to an embodiment of the present invention, showing an interlock mechanism. First connector assembly 4902 may have a movable locking tooth 5104 that is biased outward through an opening in the side of housing 5106. Housing 5108 of second connector assembly 4904 may incorporate an eject button 5110 that is biased away from locking tooth 5104.

In operation, as connector assembly 4902 slides into housing 5108 of second connector assembly 4904, housing 5108 may press locking tooth 5104 inward, allowing connector assembly 4902 to advance toward the connected position. The outer surface of locking tooth 5104 may be shaped as shown to facilitate forward movement. Once connector assembly 4902 is fully forward, locking tooth 5104 may extend into the opening in housing 5108, thereby holding connector assembly 4902 in place. To remove connector assembly 4902, a user may press inward on eject button 5110, thereby pushing locking tooth 5104 into housing 5106 of connector assembly 4902 and allowing connector assembly 4902 to be pulled out from connector assembly 4904. Other interlock mechanisms (e.g., bayonet latches on the sides of connector assembly 4902) may be substituted.

The various connector assemblies shown and described above may be modified as desired. Sizes and form factors may be adapted to a particular use case. For example, the connector assemblies may be small, with a length of about 25 mm and a thickness of about 4 mm. The travel distance of the electrical contacts may be 1 mm or less (e.g., 0.3 mm or 0.6 mm). Other dimensions may be used. The number and spacing of electrical contacts may be modified as desired. In some embodiments, one or more electrical contacts may be provided using a cartridge assembly as described above, and one or more cartridge assemblies may be disposed within the housing of the connector assembly. In some embodiments, one or more cartridge assemblies holding multiple contacts may be mounted on a sled (or shuttle) in the manner described above instead of mounting each contact individually.

Further, in some embodiments described above, the connector assembly that includes movable electrical contacts slides laterally into a slot in a complementary connector assembly that includes electrical contacts having a fixed position. It is to be understood that this configuration may be varied. For example, movable electrical contacts may be provided in a receptacle connector assembly (e.g., the connector assembly with a slot) while the insert connector assembly (e.g., the connector assembly that slides into the slot) has fixed electrical contacts. In the case of a watch, the movable contacts may be located in the watch body unit while the fixed contacts are located in the band. In still other embodiments, both connector assemblies may have movable electrical contacts. Movable electrical contacts using any of the techniques described above may also be implemented in connector assemblies where the interconnection does not involve lateral sliding; for instance, retractable electrical contacts with any of the retraction mechanisms described above may be implemented in either or both connector assemblies of a plug-in connector interface of the type shown in FIG. 49.

In various embodiments of the present invention, the components of the connector assemblies may be formed in various ways of various materials. For example, conductive portions may be formed by stamping, metal-injection molding, machining, micro-machining, 3-D printing, or other manufacturing process. The conductive portions may be formed of stainless steel, steel, copper, copper titanium, phosphor bronze, palladium, palladium silver, or other material or combination of materials. They may be plated or coated with nickel, gold, or other material. The nonconductive portions, such as the housings and other portions, may be formed using injection or other molding, 3-D printing, machining, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials. The transformer cores may be formed of ferrite material, such as a soft ferrite. The transformer cores may be sintered or subjected to other manufacturing steps. The flexible circuit boards may be replaced with printed circuit boards (PCBs) or other appropriate substrates.

Embodiments of the present invention may provide connector assemblies that may be located in, or may connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These connector assemblies may provide interconnect paths for signals that are compliant with various standards such as Universal Serial Bus (USB), High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector assembly for a first electronic device, the connector assembly comprising:

a housing having a forward surface portion adapted to engage with a complementary connector assembly of a second electronic device, the forward surface portion of the housing having an opening therein;

an electrical contact;

a spring mechanism to apply a forward bias to the electrical contact;

a sled movably disposed within the housing, the sled being movable between a retracted position and an engaged position; and a user-operable control to move the sled between the retracted position and the engaged position, at least a portion of the user-operable control extending outside the housing, wherein the electrical contact is mounted on the sled such that when the sled is in the engaged position, a front portion of the electrical contact extends through the opening in the housing and when the sled is in the retracted position, the front portion of the electrical contact does not extend through the opening in the housing.

2. The connector assembly of claim 1 wherein the user-operable control includes a slider that moves laterally relative to the housing.

3. The connector assembly of claim 1 wherein the user-operable control includes a lever located at a rear end of the housing, the lever being movable in a plane transverse to a lateral plane.

4. The connector assembly of claim 1 wherein the forward surface portion of the housing engages with the complementary connector assembly by sliding laterally into a slot of the complementary connector assembly.

5. The connector assembly of claim 1 wherein the forward surface portion of the housing engages with the complementary connector assembly by plugging into a slot of the complementary connector assembly.

6. The connector assembly of claim 1 wherein the forward surface portion of the housing forms a slot capable of receiving the complementary connector assembly using a lateral sliding engagement.

7. The connector assembly of claim 1 wherein the first electronic device is an electronic watch band and the second electronic device is a watch body unit.

8. A connector assembly for a first electronic device, the connector assembly comprising:

a housing having a forward surface portion adapted to slide laterally into a slot of a complementary connector assembly of a second electronic device, the forward surface portion of the housing having a plurality of openings therein;

a plurality of electrical contacts;

a spring mechanism to apply a forward bias to each of the electrical contacts;

a sled movably disposed within the housing, the sled being movable between a retracted position and an engaged position; and a user-operable control to move the sled between the retracted position and the engaged position, at least a portion of the user-operable control extending outside the housing, wherein the electrical contacts are mounted on the sled such that when the sled is in the engaged position, a front portion of each electrical contact extends through one of the openings in the housing and when the sled is in the retracted position, the front portions of the electrical contacts do not extend through the opening in the housing.

9. The connector assembly of claim 8 wherein the user-operable control includes one of:

a plunger located at a rear end of the housing;

a pull-tab located at a rear end of the housing;

a slider that moves laterally relative to the housing;

a rotary control; or a lever located at a rear end of the housing, the lever being movable in a plane transverse to a lateral plane.

10. The connector assembly of claim 8 wherein the spring mechanism includes a cartridge assembly having a curved beam disposed therein, the curved beam being connected at one end to a rear portion of the electrical contact.

11. The connector assembly of claim 10 wherein the cartridge assembly has a plurality of curved beams disposed therein, each curved beam being electrically isolated from each other curved beam, and one end of each curved beam being connected to a rear portion of a different one of the electrical contacts.

12. The connector assembly of claim 8 wherein the first electronic device is an electronic watch band and the second electronic device is a watch face unit.

* * * * *